US007451066B2

(12) United States Patent
Edwards et al.

(10) Patent No.: US 7,451,066 B2
(45) Date of Patent: Nov. 11, 2008

(54) NEAR WELLBORE MODELING METHOD AND APPARATUS

(76) Inventors: David A. Edwards, Rock House, Curry Mallet, Taunton, Somerset (GB) TA3 6DW; Jonathan A. Holmes, 29 Highdown Avenue, Emmer Green, Reading RG4 8QT (GB); Anthony J. Fitzpatrick, The Lindens, Old Boars Hill, Oxford (GB) OX1 5JJ ( * ) Notice: Subject to any disclaimer, the term of this patent is extended or adjusted under 35 U.S.C. 154(b) by 712 days.

(21) Appl. No.: 10/900,176

(22) Filed: Jul. 27, 2004
(Under 37 CFR 1.47)

(65) Prior Publication Data

US 2005/0015231 A1 Jan. 20, 2005

(51) Int. Cl.
*G06F 17/50* (2006.01)
*G01V 1/18* (2006.01)

(52) U.S. Cl. ..... 703/2; 703/10; 702/5; 702/12; 367/72

(58) Field of Classification Search ..... 703/5, 703/10, 2; 702/6–10, 5, 12; 166/335; 345/418; 367/72
See application file for complete search history.

(56) References Cited

U.S. PATENT DOCUMENTS 4,821,164 A 4/1989 Swanson (Continued)

FOREIGN PATENT DOCUMENTS

GB 2300736 A 11/1996
GB 2322702 A 9/1998
GB 2336008 A 10/1999

OTHER PUBLICATIONS

Odin Reservoir Software & Services As, "NextWell User's Manual", Sep. 7, 1995, Release 1.1.0.

(Continued)

*Primary Examiner*—Thai Phan
(74) *Attorney, Agent, or Firm*—Osha · Liang LLP

(57) ABSTRACT

A "near wellbore modeling" software will, when executed by a processor of a computer, model a localized area of a reservoir field which surrounds and is located near a specific wellbore in the reservoir field by performing the following functions: (1) receive input data representative of a reservoir field containing a plurality of wellbores, (2) establish a boundary around one specific wellbore in the reservoir field which will be individually modeled and simulated, (3) impose an "fine scale" unstructured grid inside the boundary consisting of a plurality of tetrahedrally shaped grid cells and further impose a fine scale structured grid about the perforated sections of the specific wellbore, (4) determine a plurality of fluxes/pressure values at the boundary, the fluxes/pressure values representing characteristics of the reservoir field located outside the boundary, (5) establish one or more properties for each tetrahedral cell of the unstructured grid and each cylindrical grid cell of the structured grid, (6) run a simulation, using the fluxes/pressure values at the boundary to mimic the reservoir field outside the boundary and using the fine scale grid inside the boundary, to thereby determine a plurality of simulation results corresponding, respectively, to the plurality of grid cells located inside the boundary, the plurality of simulation results being representative of a set of characteristics of the reservoir field located inside the boundary, (7) display the plurality of simulation results which characterize the reservoir field located inside the boundary, and (8) reintegrate by coarsening the grid inside the boundary, imposing a structured grid outside the boundary, and re-running a simulation of the entire reservoir field.

26 Claims, 46 Drawing Sheets

U.S. PATENT DOCUMENTS

| | | | | |
|---|---|---|---|---|
| 6,018,497 | A | 1/2000 | Gunasekera | |
| 6,078,869 | A * | 6/2000 | Gunasekera | 702/6 |
| 6,101,447 | A | 8/2000 | Poe, Jr. | |
| 6,106,561 | A | 8/2000 | Farmer | |
| 6,230,101 | B1 | 5/2001 | Wallis | |
| 2001/0006387 | A1 | 7/2001 | Bennis et al. | 345/418 |

OTHER PUBLICATIONS

Alvestad, J. et al., "Interactive Modelling of Muliphase Inflow Performance of Horizontal and Highly Deviated Wells", SPE 27577, Conference, Mar. 15-17, 1994, pp. 367-382, U.K.

Brekke, K. et al., "Horizontal Well Productivity and Risk Assessment", SPE 36578, Conference, Oct. 6-9, 1996, pp. 77-92, Denver/USA.

Waid, M.C. et al., "Improved Models for Interpreting the Pressure Response of Formation Testers", SPE 22754, Conference, Oct. 6-9, 1991, pp. 889-904, Dallas/USA.

Zhang, H.R. et al., "Modelling Scale Inhibitor Squeeze Treatments in Horizontal Wells: Model Development and Application", SPE 37140, Conf., Nov. 18-20, 1996, pp. 853-865, Calgary.

* cited by examiner

SIMULATING THE ENTIRE RESERVOIR FIELD

FIG. 14
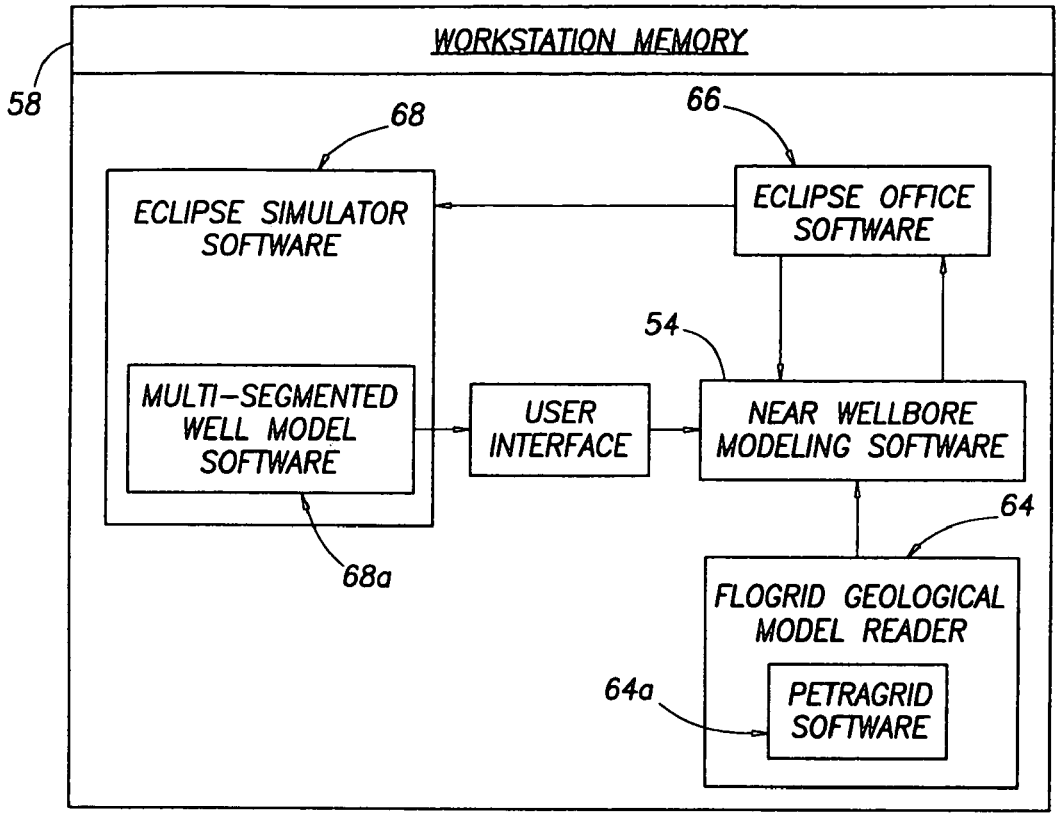
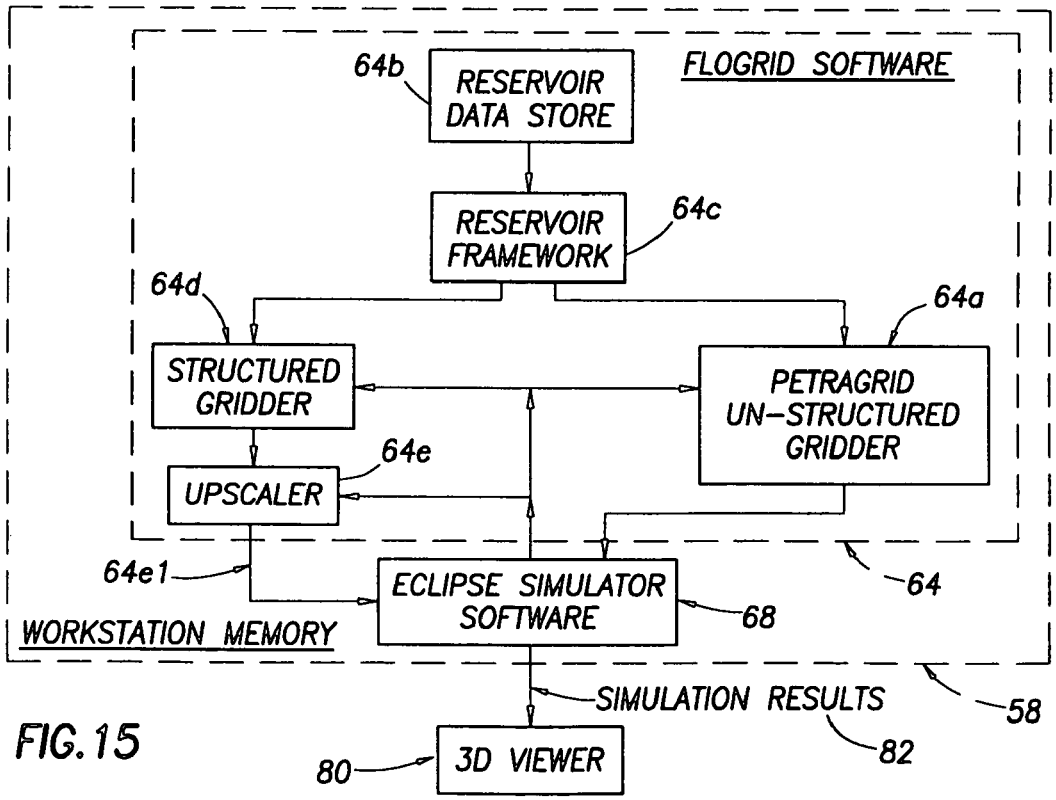
FIG. 15

FIG.20
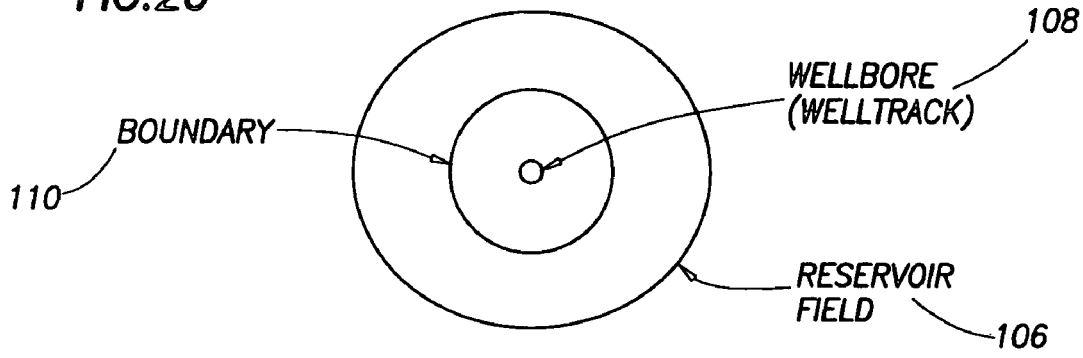
FIG.21
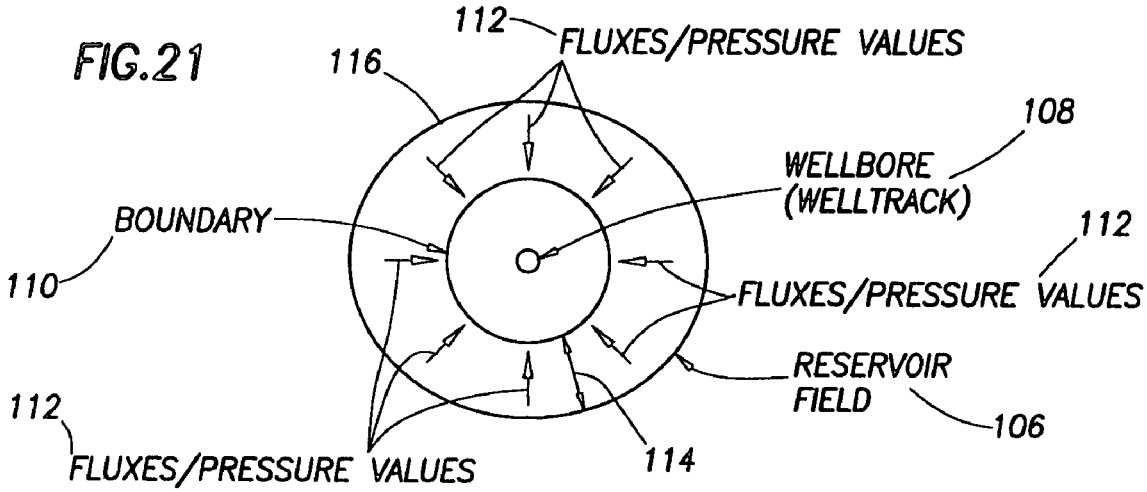
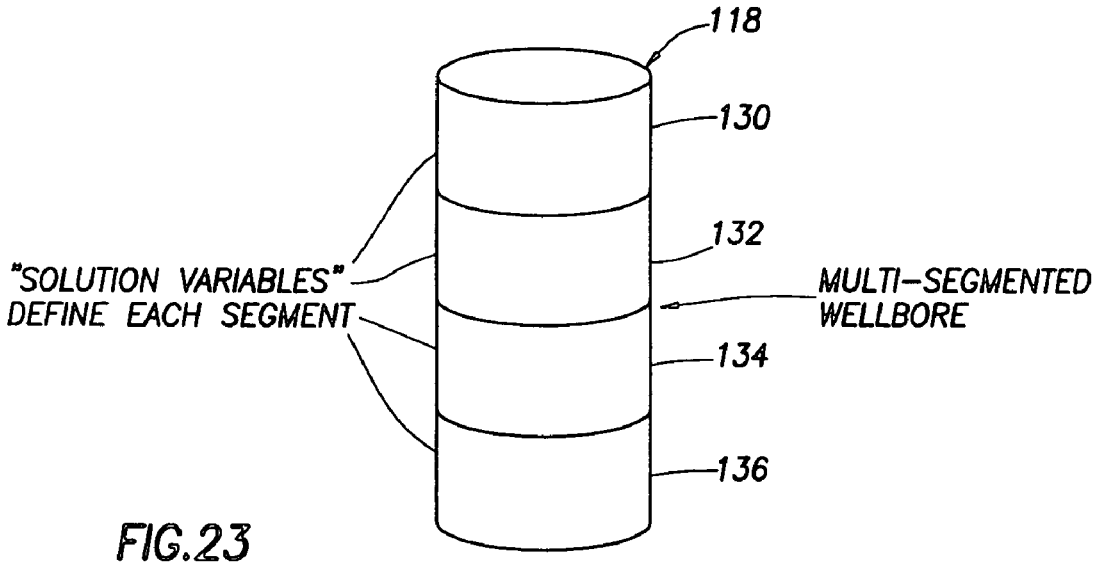
FIG.23

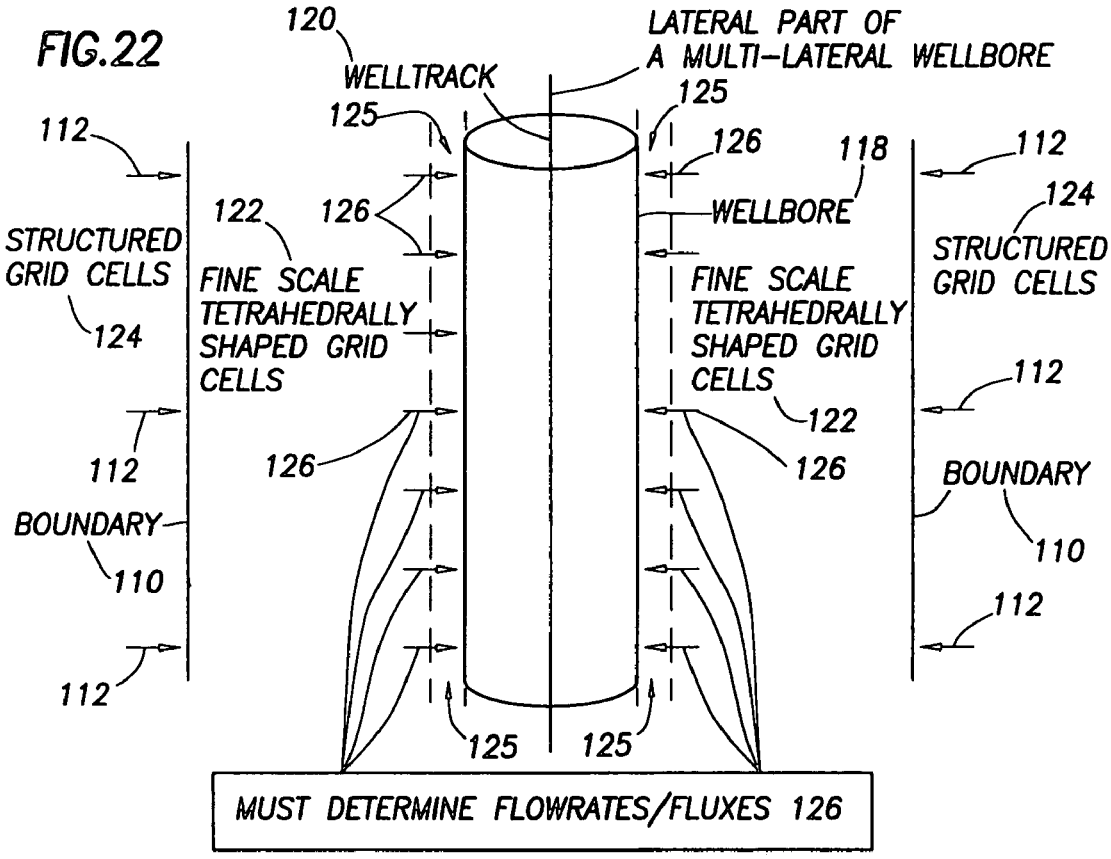
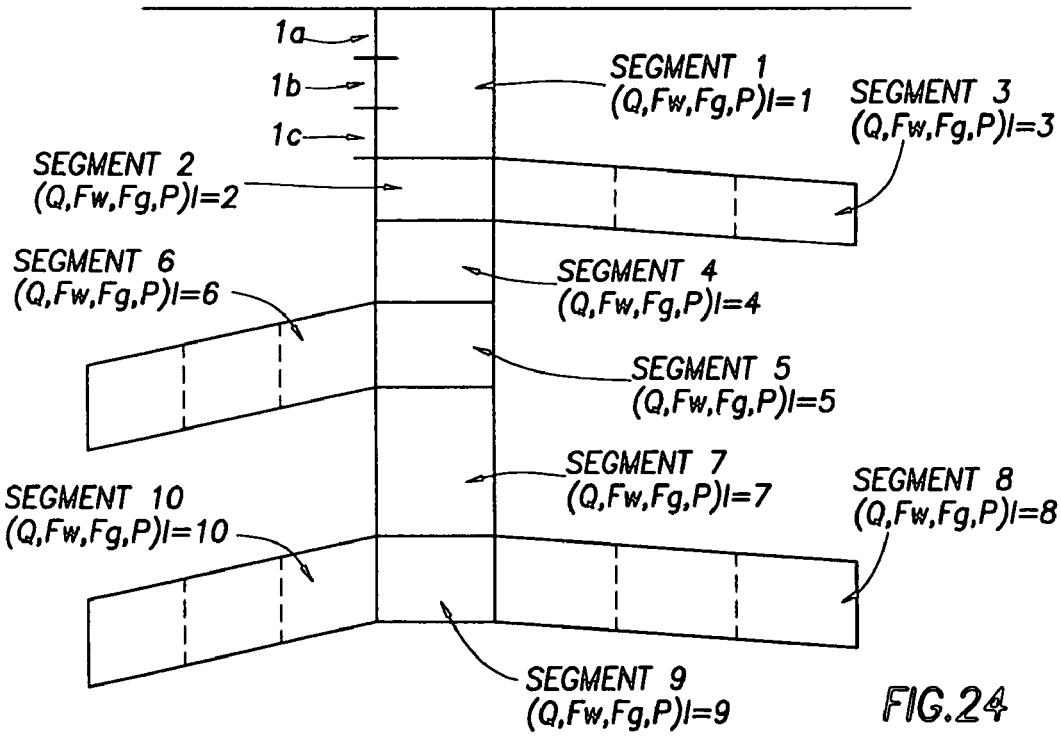
FIG.24

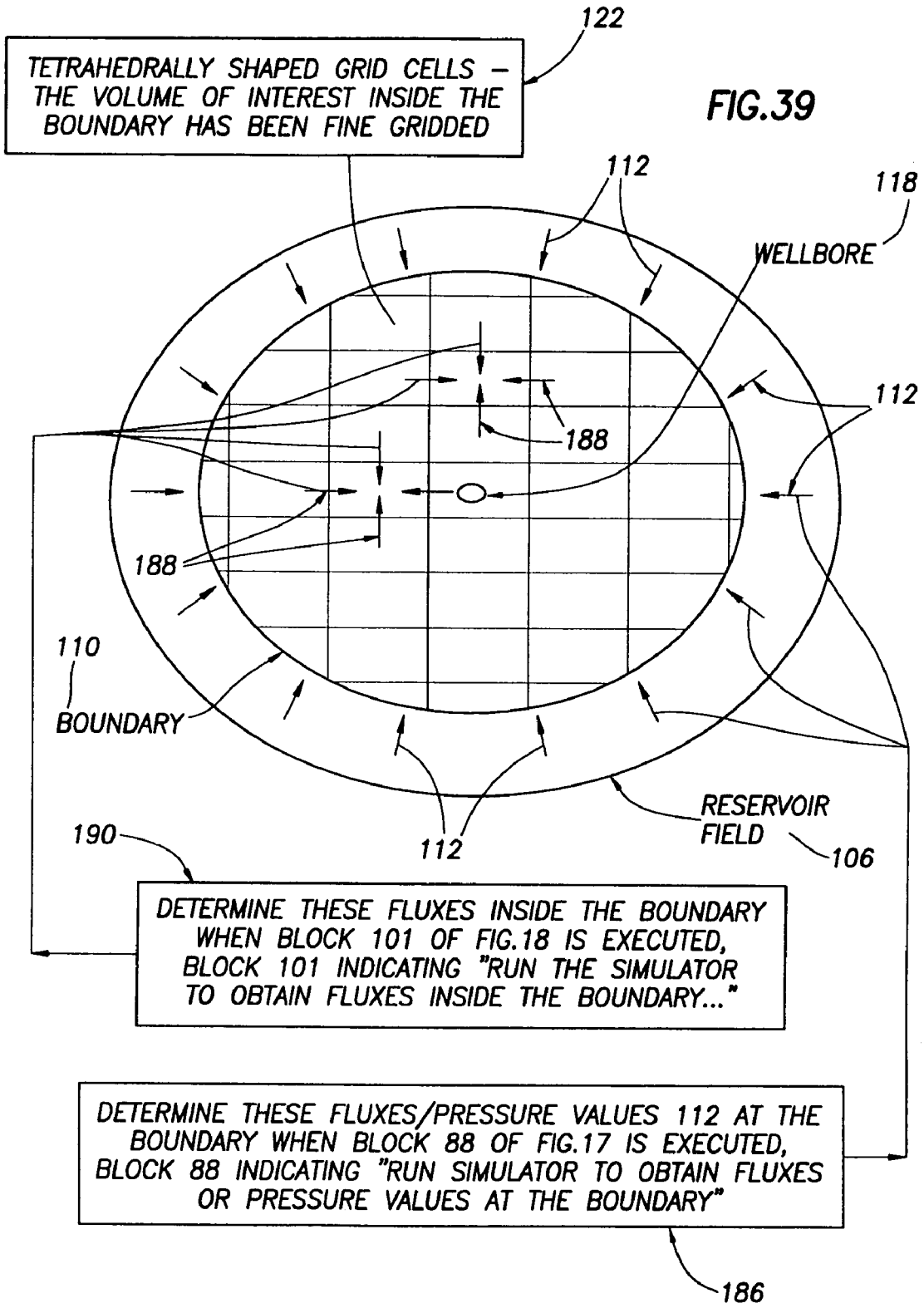
122
TETRAHEDRALLY SHAPED GRID CELLS – THE VOLUME OF INTEREST INSIDE THE BOUNDARY HAS BEEN FINE GRIDDED
FIG.39
112
118
WELLBORE
112
188
188
110
BOUNDARY
RESERVOIR FIELD
106
112
190
DETERMINE THESE FLUXES INSIDE THE BOUNDARY WHEN BLOCK 101 OF FIG.18 IS EXECUTED, BLOCK 101 INDICATING "RUN THE SIMULATOR TO OBTAIN FLUXES INSIDE THE BOUNDARY..."
DETERMINE THESE FLUXES/PRESSURE VALUES 112 AT THE BOUNDARY WHEN BLOCK 88 OF FIG.17 IS EXECUTED, BLOCK 88 INDICATING "RUN SIMULATOR TO OBTAIN FLUXES OR PRESSURE VALUES AT THE BOUNDARY"
186

FIG.41
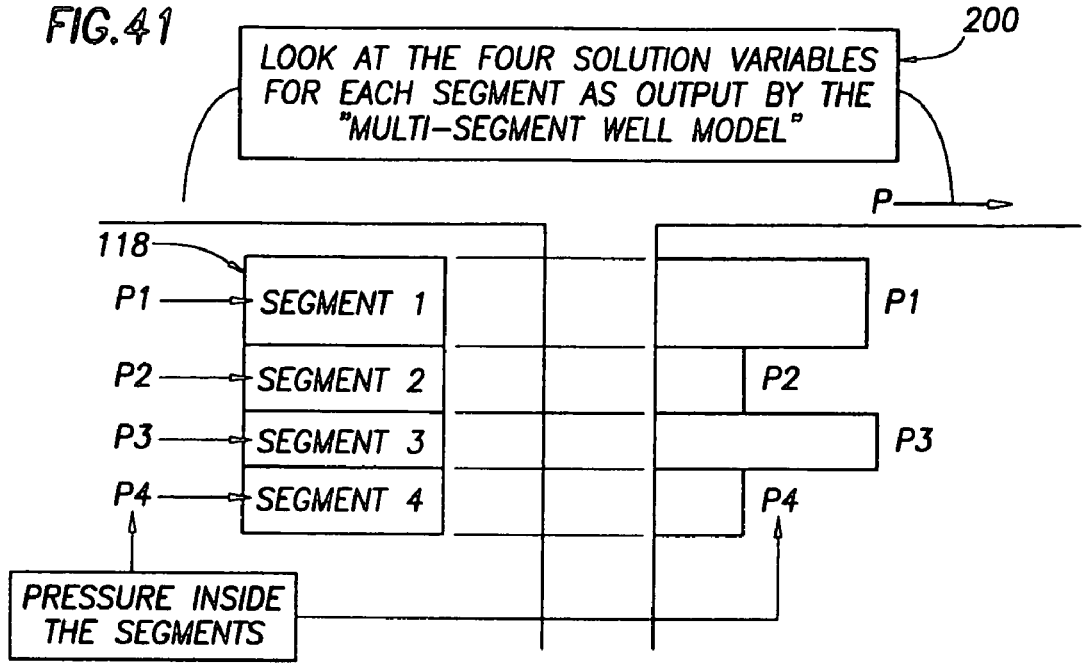
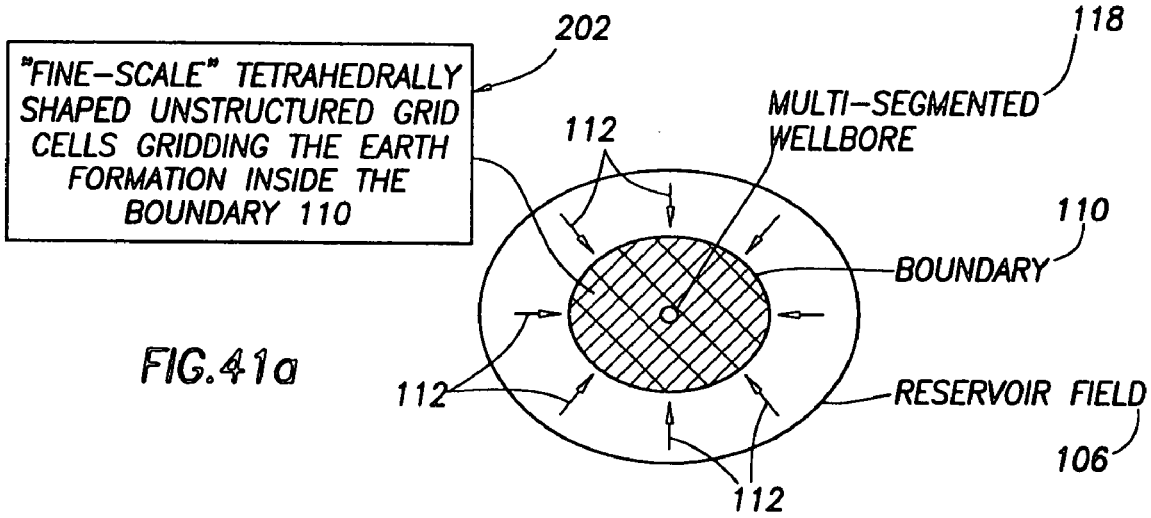
FIG.41a
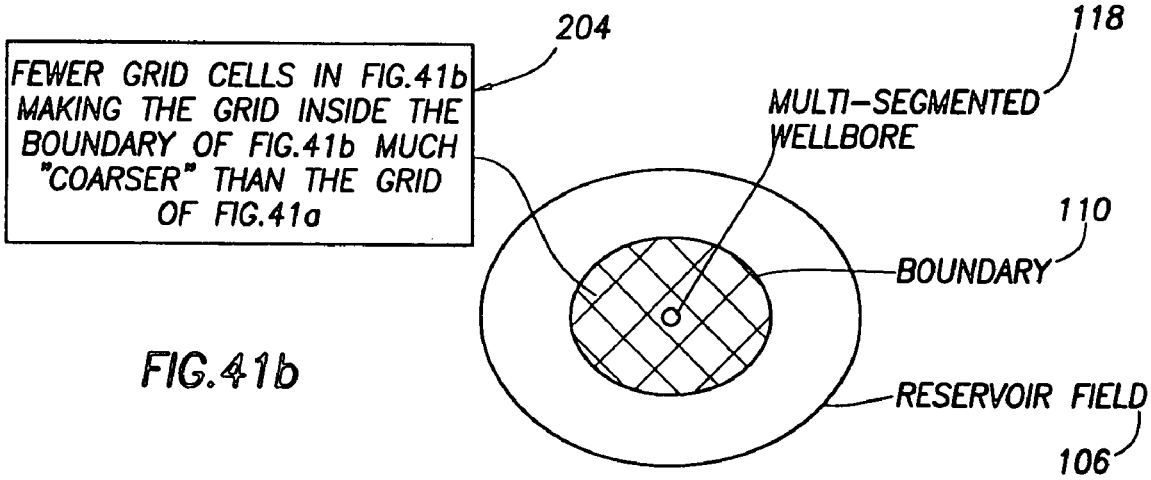
FIG.41b

206
ORIGINAL FINE GRID
208
COARSER GRID
210
3 TIMES LESS CELLS RELATIVE TO ORIGINAL FINE GRID YIELDS A GRID WHICH IS MINIMALLY ACCEPTABLE
WATER IN SEGMENT OF WELLBORE LATERAL
TIME, (t)

214
STRUCTURED RECTANGULAR GRID CELLS
60
WELLBORES
212
216
ENTIRE OILFIELD RESERVOIR FIELD
106
3D VIEWER
COLOR 1=VALUE 1
COLOR 2=VALUE 2

NEAR WELLBORE MODELING METHOD AND APPARATUS

CROSS REFERENCE TO RELATED APPLICATIONS

This is a Utility application of prior pending U.S. provisional patent application Ser. No. 60/084,018 filed May 4, 1998 and entitled "Near Wellbore Modeling".

BACKGROUND OF THE INVENTION

The subject matter of the present invention relates to a Near Wellbore Modeling method and apparatus adapted for use in connection with a workstation computer for modeling a single wellbore of a reservoir field in much greater detail during the modeling of a plurality of wellbores of the reservoir field for the purpose of determining the special characteristics of that single wellbore.

There is a growing need in the marketplace for an improved simulation tool for the modeling of individual wellbores. In some cases, individual wellbores are ceasing to produce at very low watercuts. This is believed to be the result of a subtle near wellbore effect and laboratory work is needed to characterize the processes involved at that wellbore. However, there exists no reservoir modeling software which is capable of accurately modeling the processes which are occurring near the wellbore. Consequently, there is a need for a software tool that is capable of modeling the behavior of a wellbore within and in the vicinity of the wellbore. The need for such a modeling tool is great and the need is expanding for a number of reasons. First, the number of wells with highly complex geometries is increasing steadily. The modeling tools available today are unable to reflect the flow processes which dictate the behavior of such wells accurately. Secondly, there is a need to predict the results of wellbore treatments. In the case of complex well geometries, existing tools cannot adequately represent near wellbore flow processes before and after treatment. Finally, simulation has major benefits to offer to a wide range of engineers. In the past, however, the technology has been rendered inaccessible to them because it has been insufficiently user friendly; The combination of automatic gridding technology and easy to use interfaces now makes it possible for a production engineer to gain the benefits of simulation without having to become a simulation expert. Thus, there appears to be a large market for a "Near Wellbore Modeling" tool of this kind.

A number of other products are used in conjunction with the "Near Wellbore Modeling" tool of the present invention. For example, a product known as "Eclipse Office", disclosed in prior pending UK patent application number serial number 9817501.1 filed Aug. 12, 1998, provides much of the software infrastructure which such a Near Wellbore Modeling tool would require, the "Eclipse Office" UK patent application being incorporated by reference into this specification. In addition, a software product known as "Flogrid" includes a "geological model reader"; it also includes another software product known as the "Petragrid" unstructured gridder. The "Flogrid" product is disclosed in prior pending U.S. patent application Ser. No. 09/034,701 filed Mar. 4, 1998 entitled "Simulation gridding method and apparatus including a structured areal gridder adapted for use by a reservoir simulator", the disclosure of which is incorporated by reference into this specification. The "Petragrid" unstructured gridder is disclosed in prior pending U.S. patent application Ser. No. 08/873,234 filed Jun. 11, 1997, the disclosure of which is incorporated herein by reference. The "Petragrid" unstructured gridder has developed the technology required to model the near wellbore region in fine detail. The "Multi-Segmented Well Model", disclosed in this application, enables engineers to model flow processes within the wellbore much more accurately. By combining these technologies (Eclipse Office, the Flogrid geological model reader, Petragrid, and the Multi-Segmented Well Model) with some new capabilities for interaction with the simulation model, a unique "Near Wellbore Modeling" product results which will enable an engineer to predict the behavior of individual and specific wellbores in a reservoir field.

SUMMARY OF THE INVENTION

Accordingly, it is a primary object of the present invention to provide a new reservoir modeling tool known as the "Near Wellbore Modeling (NWM)" apparatus.

In accordance with the aforementioned primary object of the present invention, it is a major feature of the present invention to provide a new modeling and simulation software, known as the "Near Wellbore Modeling" software, which, when executed by a processor of a computer, such as a workstation processor, will: (1) receive a data set which represents a reservoir field comprised of a plurality of wellbores, one of the plurality of wellbores being a specific wellbore, and (2) model and simulate a region of the reservoir field located in the immediate vicinity of the specific wellbore without also simulating the remaining portions of the reservoir field thereby focusing substantially the entire modeling and simulation effort on that region of the reservoir field which is located in the immediate vicinity of the specific wellbore and determining a resultant set of earth formation characteristics that are representative of that region of the reservoir field which is located in the immediate vicinity of the specific wellbore.

It is a further feature of the present invention to provide a new modeling and simulation software, known as the Near Wellbore Modeling software, which, when executed by a processor of a computer, will: (1) receive input data representative of a reservoir field containing a plurality of wellbores, (2) establish a boundary around one specific wellbore in the reservoir field which will be individually modeled and simulated, (3) impose a "fine scale" unstructured grid including a plurality of tetrahedrally shaped grid cells on a region of the reservoir field which is located inside the boundary (and impose a "fine scale" structured grid comprised of cylindrical cells about the perforated sections of the one specific wellbore), (4) determine a plurality of fluxes/flowrates at the boundary representing flowrates of fluids passing through the boundary and into said region and/or determine a plurality of calculated pressure values at the boundary, the fluxes/flowrates or pressure values (hereinafter called "fluxes/pressures") at the boundary representing characteristics of the reservoir field located outside the boundary, (5) establish one or more properties for each tetrahedral cell of the unstructured fine scale grid (and for each cylindrical cell of the structured fine scale grid) imposed on the region located inside said boundary, (6) run a simulation while using the fluxes/pressures at the boundary (which mimic a region of the reservoir field located outside the boundary) and using the fine scale grid inside the boundary to thereby determine a plurality of simulation results corresponding, respectively, to the plurality of tetrahedrally shaped grid cells of the unstructured fine scale grid (and the plurality of cylindrically shaped grid cells of the structured fine scale grid) located inside the boundary, the plurality of simulation results being representative of a set of characteristics of the reservoir field located inside the boundary, and (7) display the plurality of simulation results which characterize the reservoir field located inside the boundary.

It is a further feature of the present invention to provide a modeling and simulation software, known as the Near Wellbore Modeling software, which, when executed by a processor of a computer, will: (1) read-in and receive a data set, the data set including a reservoir field which further includes a plurality of wellbores, the plurality of wellbores including a particular wellbore, (2) establish a boundary around the particular wellbore in the reservoir field in the data set (also called the "volume of interest"), (3) run a simulator with that boundary to obtain either fluxes (flowrates) at the boundary representing flowrates of fluids passing through that boundary and into a region inside the boundary or pressure values at the boundary (the fluxes/pressure values at the boundary mimicking the characteristics of the reservoir field located outside the boundary), (4) analyze the particular wellbore in detail by importing deviation surveys to improve a description of a welltrack of the particular wellbore in question, (5) define "modified property zones" located inside the boundary but outside and adjacent to the particular wellbore, (6) impose a fine scale grid inside the boundary; that is, establish a plurality of "fine scale" tetrahedrally shaped grid cells of a fine scale un-structured grid inside the boundary and further establish fine scale cylindrically shaped grid cells of a structured grid inside the boundary and about the perforated sections of the particular wellbore, (7) assign several properties to each tetrahedrally shaped grid cell of the fine scale unstructured grid (and to each rectangular/cylindrically shaped grid cell of the fine scale structured grid) inside the boundary and about the perforated sections of the particular wellbore, (8) run a simulation; that is, (8*a*) set up a multisegment well model by dividing the welltrack of the particular wellbore into segments and generating solution variables for each segment and receive the solution variables, and (8*b*) run the simulator using the fluxes/pressures at the boundary and using the fine scale grid within the boundary to obtain fluxes/flowrates inside the boundary and examine the results of the simulation, (9) during "re-integration", (9*a*) regrid the 'volume of interest' inside the boundary of the reservoir field such that the volume of interest now includes fewer grid cells of a 'coarser unstructured grid' comprised of a plurality of tetrahedrally shaped grid cells, (9*b*) impose a structured grid on that part of the reservoir field located outside the boundary, and, (9*c*) while using the coarser unstructured grid inside the boundary and the structured grid outside the boundary of the reservoir field, re-run a simulation for the purpose of simulating the entire reservoir field, and (10) generate a plurality of simulation results corresponding, respectively, to a plurality of grid cells in the entire reservoir field representing the characteristics of the entire reservoir field. At this point, the reservoir field is gridded and properties are associated with each grid cell.

In accordance with the major object and other features of the present invention, a program storage device stores a plurality of software including a Near Wellbore Modeling software of the present invention, an Eclipse office software, the Flogrid geological model reader portion of a Flogrid software which includes a Petragrid software, and an Eclipse simulator software which includes a Multi-segment well model software, the plurality of software stored on the program storage device (such as a CD-Rom) being loaded into a workstation memory of a workstation and being stored therein, as illustrated in FIG. 12. A plurality of data is provided as 'input data' to the workstation, that plurality of input data including an Eclipse data set full field model, well deviation surveys, Geological models, and user input modified property zones. The aforementioned input data referred to as the 'Eclipse data set full field model' and the 'Geological models' have each been constructed using some or all of other output data referred to in this specification as the 'well log output record' and the 'reduced seismic data output record'.

In operation, when the workstation executes the plurality of software stored in the workstation memory, including the near wellbore modeling software of the present invention, while using the plurality of input data, a workstation processor embodied in the workstation will perform the following functional operations.

The workstation processor will read-in the Eclipse data set full field model which includes and represents an entire reservoir field, the reservoir field further including a plurality of wellbores. The earth formation situated in the immediate vicinity of a particular one of the plurality of wellbores of the reservoir field is determined to exhibit peculiar characteristics. Therefore, the formation near that particular wellbore of the reservoir field will be modeled in detail. In order to model/simulate the formation near the particular wellbore, without also modeling/simulating the remaining sections of the reservoir field, a boundary is placed around the particular wellbore of the reservoir field and a "fine scale" unstructured grid comprised of a plurality of tetrahedrally shaped grid cells is imposed on a region of the formation which is located inside the boundary. In addition, a "fine scale" structured grid comprised of a plurality of cylindrically shaped grid cells is imposed on the region of the formation located inside the boundary and situated about the perforated sections of the particular wellbore. Properties are assigned to each tetrahedrally shaped grid cell of the unstructured grid located inside the boundary and each cylindrically shaped grid cell of the structured grid located inside the boundary and about the perforated sections of the particular wellbore. In addition, "fluxes" (i.e., flowrates) at the boundary are determined, the "fluxes" representing the flowrates of fluids passing through the boundary and entering a region of the reservoir field located inside the boundary. Alternatively, calculated "pressure values" at the boundary are also determined. During a simulation run, these "fluxes/pressure values" will "mimic" a region of the reservoir field located outside the boundary. A simulation model has now been constructed, the simulation model consisting of the particular wellbore of the reservoir field enclosed by the boundary defining a 'volume of interest', a 'fine scale' unstructured (and structured) grid imposed on the region of the reservoir field located inside the boundary, and a plurality of fluxes/pressure values at the boundary which mimic the region of the reservoir field located outside the boundary.

Using the Eclipse simulator software, a simulation run is performed on the aforementioned simulation model using the fluxes/pressure values at the boundary and using the fine scale grid within the boundary. A first set of simulation results are generated, the first set of simulation results including a plurality of properties corresponding, respectively, to the plurality of grid cells of the unstructured (and structured) grid located inside the boundary and representing the characteristics of the formation located inside the boundary. During the aforementioned simulation run, substantially the entire simulation effort was spent simulating the reservoir field located inside the boundary "near the wellbore", the fluxes/pressure values at the boundary "mimicking" the reservoir field located outside the boundary. As a result, during the simulation run, substantially the entire simulation time was spent simulating only that part of the reservoir field which is located inside the boundary and "near the particular wellbore".

The next step includes "reintegration", the ultimate purpose of which is to simulate the entire reservoir field. During this reintegration, the number of tetrahedrally shaped grid cells of the "fine scale" unstructured grid and the number of cylindrically shaped grid cells of the "fine scale" structured grid located inside the boundary is decreased by a user defined factor. For example, if, before reintegration, there were "X" tetrahedrally shaped and cylindrically shaped grid cells in the unstructured and structured "fine scale" grid located inside the boundary, after reintegration, and using a user defined factor of "3", there are "X/3" tetrahedrally shaped and cylindrically shaped grid cells of a "coarser" unstructured and structured grid located inside the boundary. Now, after reintegration, a "coarser" grid, comprised of tetrahedrally shaped unstructured grid cells and cylindrically shaped structured grid cells, is imposed on the region of the reservoir field located inside the boundary. In addition, the region of the reservoir field located outside the boundary is gridded with a "structured" grid comprised of a plurality of approximately rectangularly shaped grid cells. A new simulation model has now been constructed.

Using the Eclipse simulator software, another simulation run is performed on the aforementioned new simulation model which now represents the entire reservoir field (not just the region of the reservoir field located inside the boundary), the aforementioned new simulation model consisting of the "coarser" unstructured and structured grid located inside the boundary in addition to the structured grid located outside the boundary. Another second set of simulation results is generated following the second simulation run, this second set of simulation results including a plurality of properties corresponding, respectively, to a plurality of grid cells of the 'coarser' unstructured/structured grid located inside the boundary and the structured grid located outside the boundary of the entire reservoir field. The second set of simulation results now represent the characteristics of the earth formation located inside the entire reservoir field.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 11 through 14 illustrate a workstation computer having a specific set of input data provided thereto and a certain set of software stored therein, that software being loaded into a memory of the workstation from a program storage device and including the "near wellbore modeling" software of the present invention;

FIG. 15 illustrates the Flogrid software and the Petragrid software of FIG. 12;

FIGS. 19 through 44 are figures which are used in connection with a description of the structure and functional operation of the "near wellbore modeling" software of FIGS. 17 and 18;

FIGS. 46 through 63 are used in connection with the "Detailed Description of the Preferred Embodiment" set forth in detail below, FIGS. 46 through 64 illustrating various dialog screen displays being presented to a workstation operator during the execution of the near wellbore modeling software of the present invention and including various functional block diagrams depicting the functional operations of certain modules which comprise the near wellbore modeling software of the present invention, wherein:

FIG. 46 illustrates the near wellbore modeling "main window";

FIGS. 47 through 63 illustrate a plurality of "sub-windows" which are called-up by using the "main window" of FIG. 46.

DESCRIPTION OF THE PREFERRED EMBODIMENT

Figure 1:
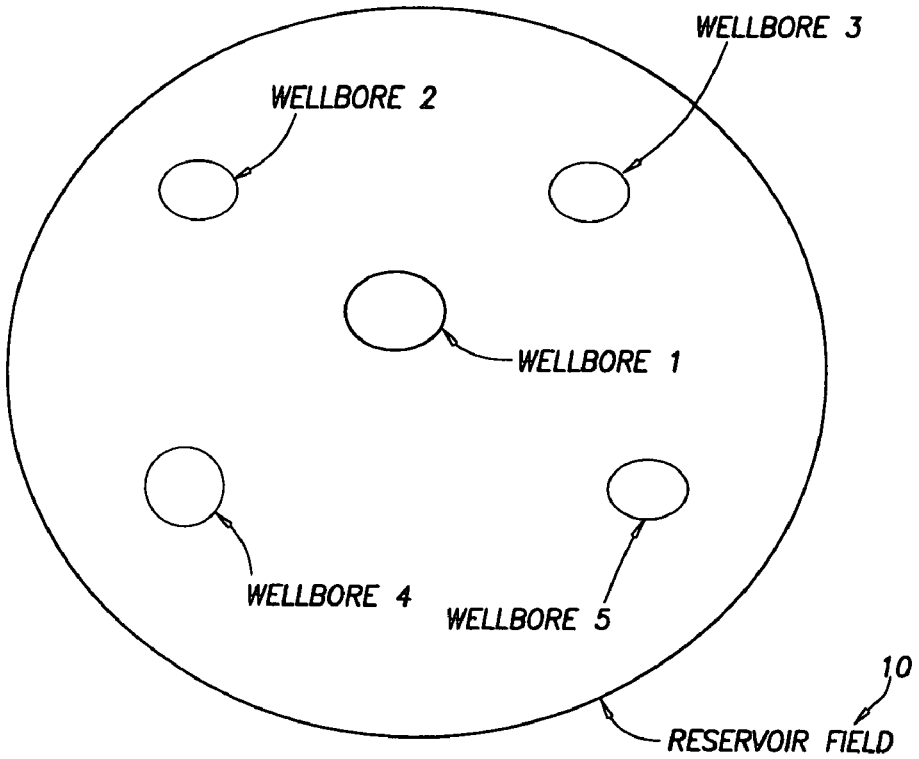
FIG. 1 represents a reservoir field.

Referring to FIG. 1, a wellbore reservoir field 10 is illustrated. The reservoir field 10 includes a plurality of wellbores including wellbore 1, wellbore 2, wellbore 3, wellbore 4, and wellbore 5.

Figure 2:
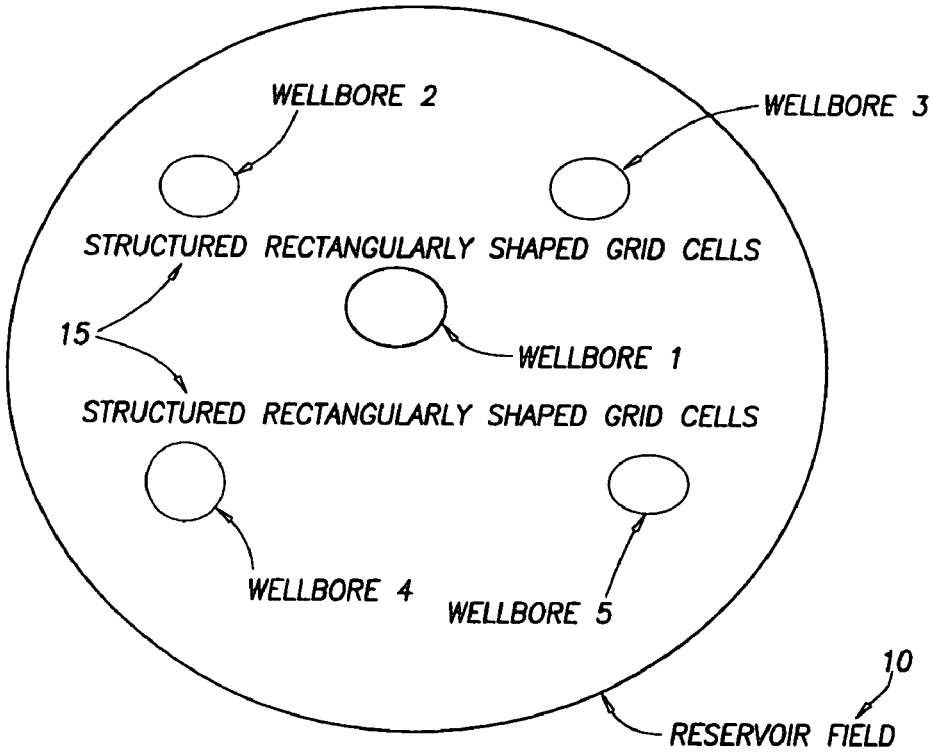
FIG. 2 illustrates the simulation of the entire reservoir field.

Referring to FIG. 2, when simulating the entire reservoir field 10, a "structured" grid 15 which includes a plurality of rectangularly shaped grid cells are imposed on the earth formation encompassed by the reservoir field 10. During that simulation, assume that the earth formation located near "wellbore 1" of the reservoir field 10 exhibits certain peculiar characteristics (such as water cut breakthrough—producing a lot of water instead of oil); however, the earth formation located near the other wellbores of the reservoir field 10 do not exhibit these peculiar characteristics. When modeling the entire reservoir field 10 by using the structured grid 15 of FIG. 2, the peculiar characteristics of the earth formation near that one particular wellbore (i.e., wellbore 1) may not be determined. Therefore, it would be desirable to model the earth formation located near only that one particular wellbore (i.e., wellbore 1) of the reservoir field, without also modeling the earth formation located near the remaining wellbores of the reservoir field 10, in order to focus the entire modeling effort on the formation near "wellbore 1" and to determine the peculiar characteristics of the earth formation located near "wellbore 1". In that case, a much more accurate model "near the wellbore" (i.e., near "wellbore 1") would be determined.

Figure 3:
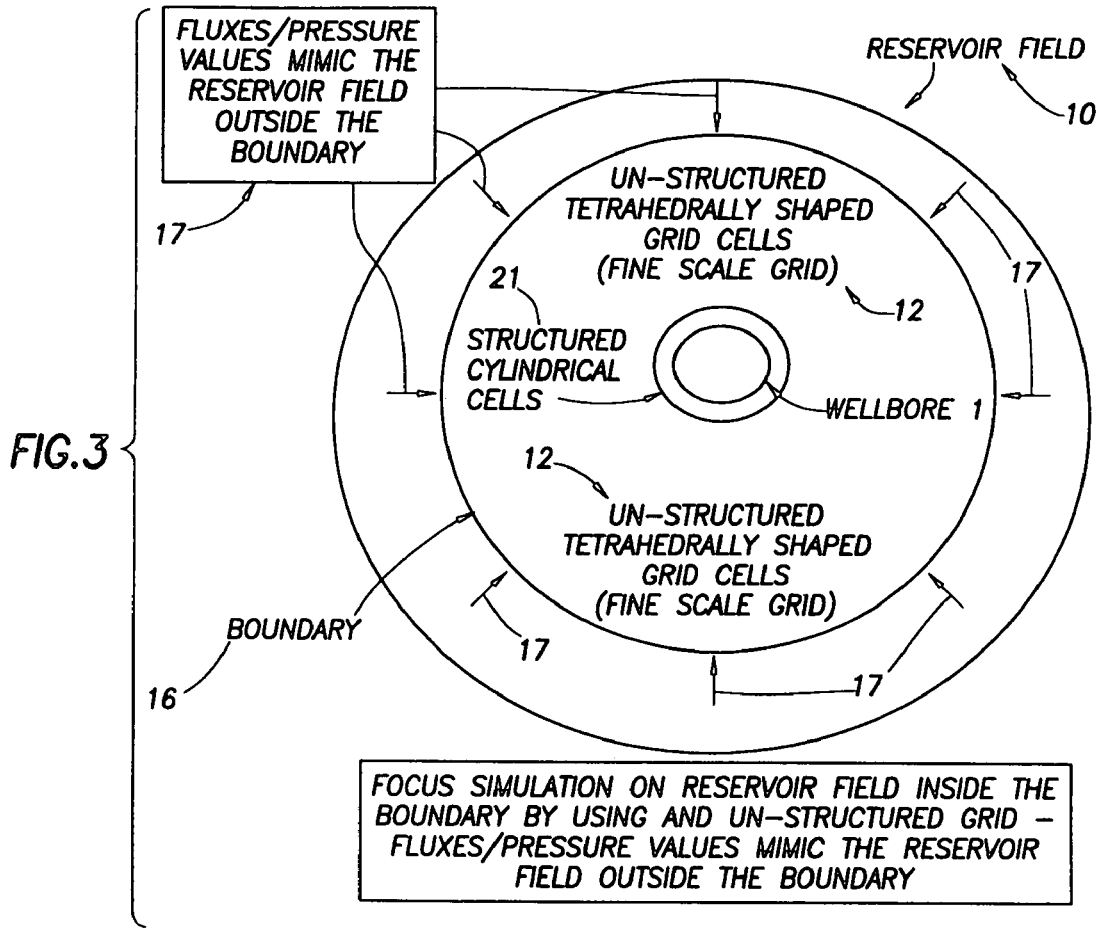
FIG. 3 illustrates the focusing of substantially the entire simulation effort on a region of the reservoir field of FIG. 2 which is located in the immediate vicinity of a specific wellbore in question.

Referring to FIG. 3, in order to focus the modeling effort on that one particular wellbore in the reservoir field 10 exhibiting the peculiar characteristics (i.e., wellbore 1) without simultaneously modeling the remaining parts of the reservoir field, (1) place a boundary 16 within the reservoir field 10 around the "wellbore 1" which exhibits the peculiar characteristics, (2) impose a "fine scale" un-structured grid 12 inside the boundary 16, the un-structured grid 12 including a plurality of tetrahedrally shaped "fine scale" grid cells (recall that the structured grid 15 of FIG. 2 included a plurality of rectangularly shaped grid cells), (3) impose a "fine scale" structured grid 21 inside the boundary 16 such that the grid 21 is situated about the perforated sections of "wellbore 1" which are disposed along the outer periphery of the "wellbore 1", the structured grid 21 including a plurality of cylindrically (i.e., rectangularly) shaped "fine scale" grid cells, and (4) determine a plurality of fluxes (i.e. flowrates) 17 at boundary 16 representing the flowrates of fluids passing through the boundary 16; alternatively or in addition, determine a plurality of calculated pressure values 17 at the boundary 16; these fluxes/pressure values 17 in FIG. 3 will mimic that part of the reservoir field 10 which located outside the boundary 16. The un-structured grid 12 of FIG. 3 and the structured grid 21 of FIG. 3 are each a "fine scale" grid; that is, the un-structured grid 12 of FIG. 3 (and the structured grid 21) have a number of tetrahedrally shaped (and cylindrically shaped) grid cells which are less, in number, than the number of tetrahedrally shaped (or cylindrically shaped) grid cells of the "coarser" grid shown in FIG. 4, discussed below. In the next step, model/simulate that part of the reservoir field 10 which is located inside the boundary 16 while using: (1) the 'fluxes/pressure values' 17 at the boundary 16 to mimic that part of the reservoir field 10 which is located outside the boundary 16 and (2) the "fine scale" tetrahedrally shaped grid cells 12 and the "fine scale" cylindrically shaped grid cells 21 located inside the boundary 16. This aforementioned modeling/simulation run will produce a 'first plurality of simulation results' for observation by a workstation operator. That is, during this modeling/simulation run, that part of the reservoir field which is located outside the boundary 16 (i.e., that part which is located between the boundary 16 and the outer periphery of the reservoir field 10) will not be simulated since the fluxes/pressure values 17 at the boundary 16 will mimic that part of the reservoir field 10 which is located outside the boundary 16. By using this method of simulation, the entire modeling/simulation run on reservoir field 10 will be focused almost entirely on that part of the reservoir field 10 which is located inside the boundary 16 thereby producing and revealing much more detailed information regarding the characteristics of the reservoir field 10 located inside the boundary 16 of FIG. 3.

Figure 4:
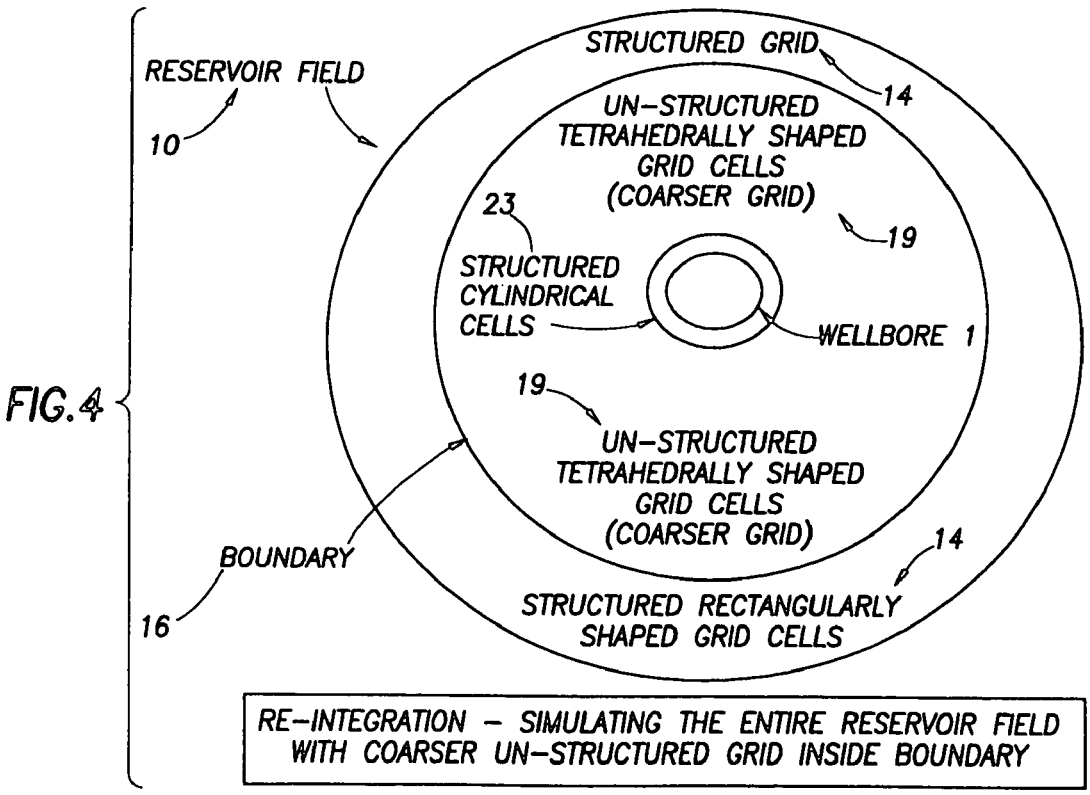
FIG. 4 illustrates re-integration following the simulation of FIG. 3 wherein the entire reservoir field is simulated after the reservoir field inside the boundary of FIG. 3 has been regridded.

Referring to FIG. 4, when the modeling/simulation run of FIG. 3 is complete and the 'first plurality of simulation results' characterizing the reservoir field inside the boundary 16 are generated, it is now necessary to "re-integrate" and model/simulate the entire reservoir field 10 of FIG. 4. In order to "re-integrate", the following additional steps must be taken: (1) impose a structured grid 14 (including a plurality of rectangularly shaped grid cells) on that part of the reservoir field 10 located outside the boundary 16, between the boundary 16 and the outer periphery of the reservoir field 10, and (2) decrease the number of tetrahedrally shaped grid cells of the un-structured "fine scale" grid 12 of FIG. 3 (and the number of cylindrically shaped grid cells of the structured "fine scale" grid 21) to thereby produce and generate an "un-structured" grid 19 of FIG. 4 (and a "structured" grid 23 of FIG. 4) which is a "coarser" grid that is also comprised of a plurality of tetrahedrally shaped (and cylindrically shaped) grid cells. Now, model and simulate the entire reservoir field 10 of FIG. 4 while using the "coarser" unstructured grid 19/structured grid 23 inside the boundary 16 and the structured grid 14 outside the boundary 16 of the reservoir field 10. A 'second plurality of simulation results' are generated for display to and observation by a workstation operator.

The un-structured grid 12 of FIG. 3 and the un-structured grid 19 of FIG. 4 is disclosed in prior pending U.S. patent application Ser. No. 08/873,234 filed Jun. 11, 1997 entitled "Method and Apparatus for generating more accurate grid cell property information . . . ", the disclosure of which is incorporated by reference into this specification. The structured grid 15 of FIG. 2, the structured grid 14 of FIG. 4, and the structured grid 21 and 23 are each disclosed in prior pending U.S. patent application Ser. No. 09/034,701 filed Mar. 4, 1998 entitled "Simulation gridding method and apparatus including a structured areal gridder . . . ", the disclosure of which is incorporated by reference into this specification.

Figure 5:
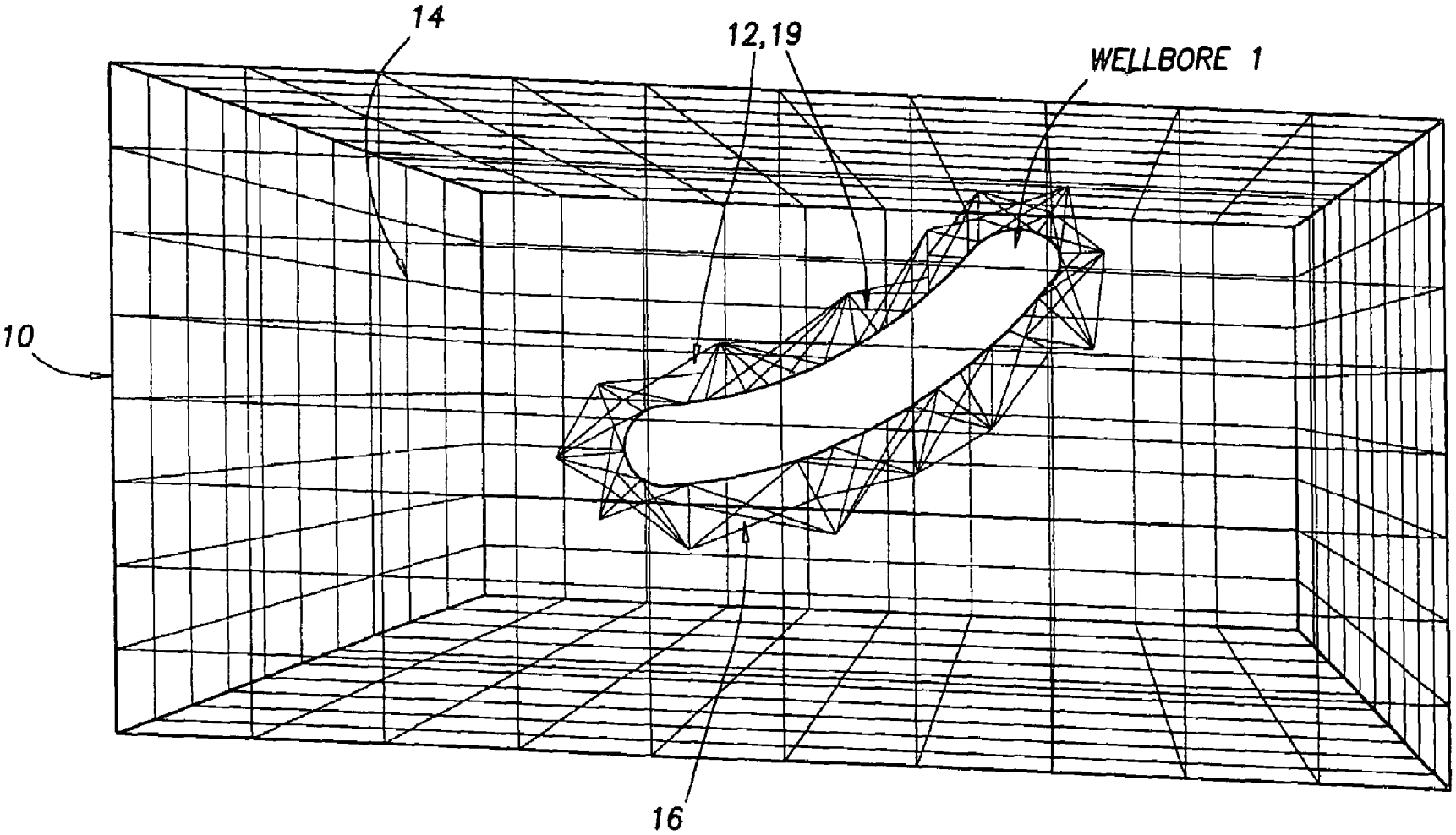
FIGS. 5 through 8 illustrate the use of the un-structured grid inside the boundary of FIG. 4 and the use of the structured grid outside the boundary of FIG. 4.

Referring to FIGS. 3, 4 and 5, referring initially to FIG. 5, a three-dimensional image is illustrated representing the "wellbore 1" of FIG. 3 initially surrounded by the "un-structured tetrahedrally shaped fine scale grid cells" 12 of FIG. 3, or by the coarser grid cells 19 of FIG. 4, the unstructured grid "12/19" of FIG. 5 being further surrounded by the "structured rectangularly shaped grid cells" 14 of FIG. 4. When modeling/simulating by using the "un-structured tetrahedrally shaped grid cells" 12 instead of the "structured rectangularly shaped grid cells" 15 in the region inside the boundary 16 of FIG. 3 immediately surrounding the wellbore being studied (wellbore 1), much more detailed information can be determined during the modeling/simulation about the earth formation in this region inside the boundary 16 located near the wellbore 1. More information is determined about the earth formation in this region inside the boundary 16 "near the wellbore" mainly because, when using an un-structured grid in the region inside the boundary 16, many more (tetrahedrally shaped and cylindrically shaped) grid cells exist in this region inside the boundary 16 of FIG. 3 located near the "wellbore 1" than would be the case if a structured grid were placed in the region inside the boundary 16 near the wellbore being studied.

Figure 6:
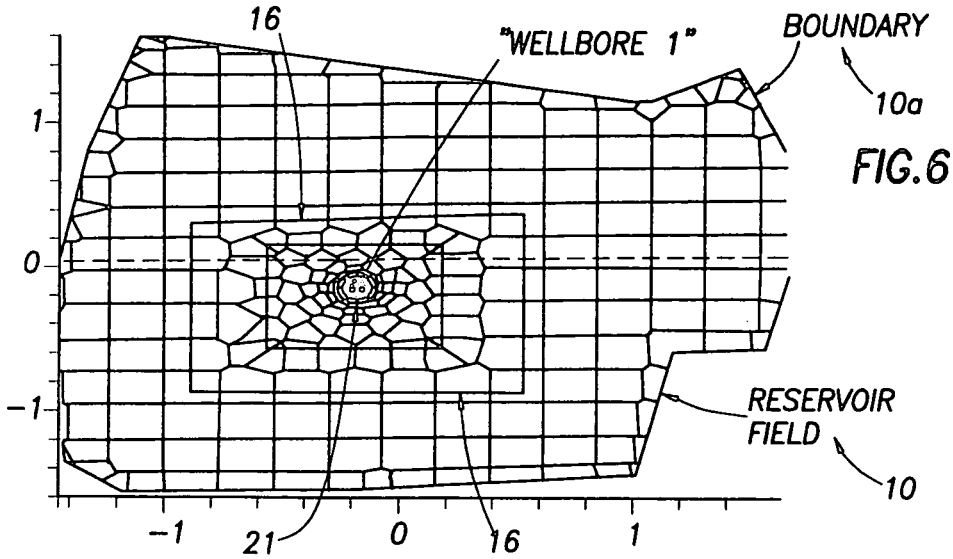
Figure 7:
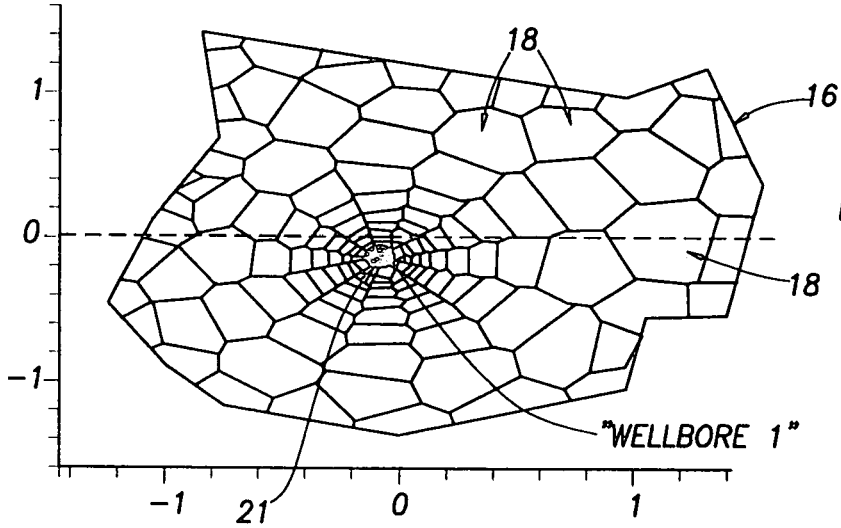
Figure 8:
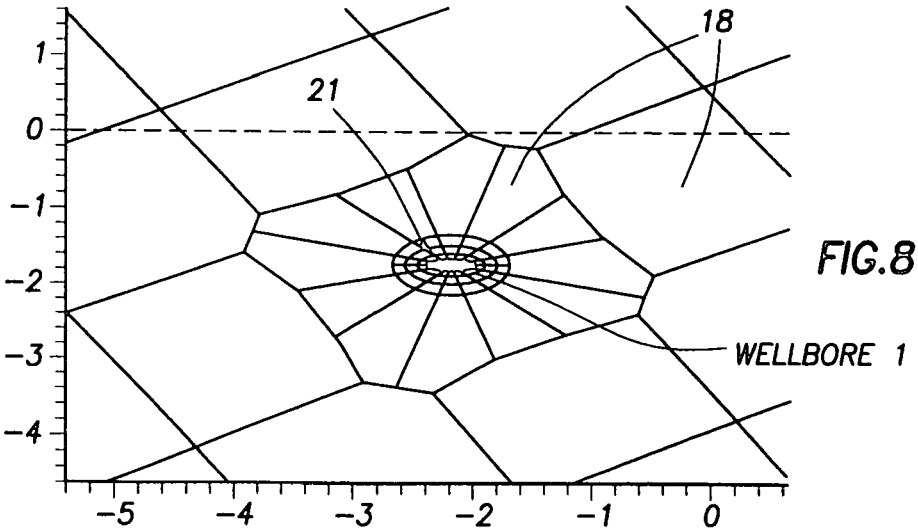

Referring to FIGS. 6, 7, and 8, the reservoir field 10 of FIG. 3 is shown in greater detail. In FIG. 6, first boundary 10*a* of the reservoir field 10 encloses a plurality of grid cells. However, the second boundary 16 located inside the first boundary 10*a* encloses a plurality of tetrahedrally shaped "unstructured" grid cells. In FIG. 6, structured cylindrically shaped grid cells 21 exist about the perforated sections of the "wellbore 1" being studied. Between the first boundary 10*a* and the second boundary 16, a plurality of rectangularly shaped "structured" grid cells are illustrated. Therefore, in FIG. 6, in the region between "wellbore 1" and the second boundary 16, when modeling by using the "un-structured" grid cells, much more detailed information can be determined relating to the earth formation located in that region.

In FIG. 7, the region of FIG. 6 between the second boundary 16 and the "wellbore 1" is shown in greater detail. In accordance with an aspect of the present invention, note that a plurality of "tetrahedrally shaped" un-structured grid cells 18 similar to grid cells 12 of FIG. 3 (instead of the "rectangularly shaped" structured grid cells 15 of FIG. 2) exist within the region of the earth formation of FIG. 7 located near the "wellbore 1" between the "wellbore 1" and the second boundary 16.

In FIG. 8, an expanded view of the plurality of "tetrahedrally shaped" unstructured grid cells 18 of FIG. 7 are illustrated. In FIG. 8, the unstructured grid 18 consisting of a plurality of tetrahedrally shaped grid cells 18 is located in a region of the reservoir field which is disposed within the boundary 16; however, a plurality of structured grid cells 21 consisting of a plurality of cylindrically shaped grid cells 21 is located about the perforated sections of the "wellbore 1" in FIG. 8, similar to the structured cylindrical grid cells 21/23 of FIGS. 3 and 4.

Figures 9, 10:
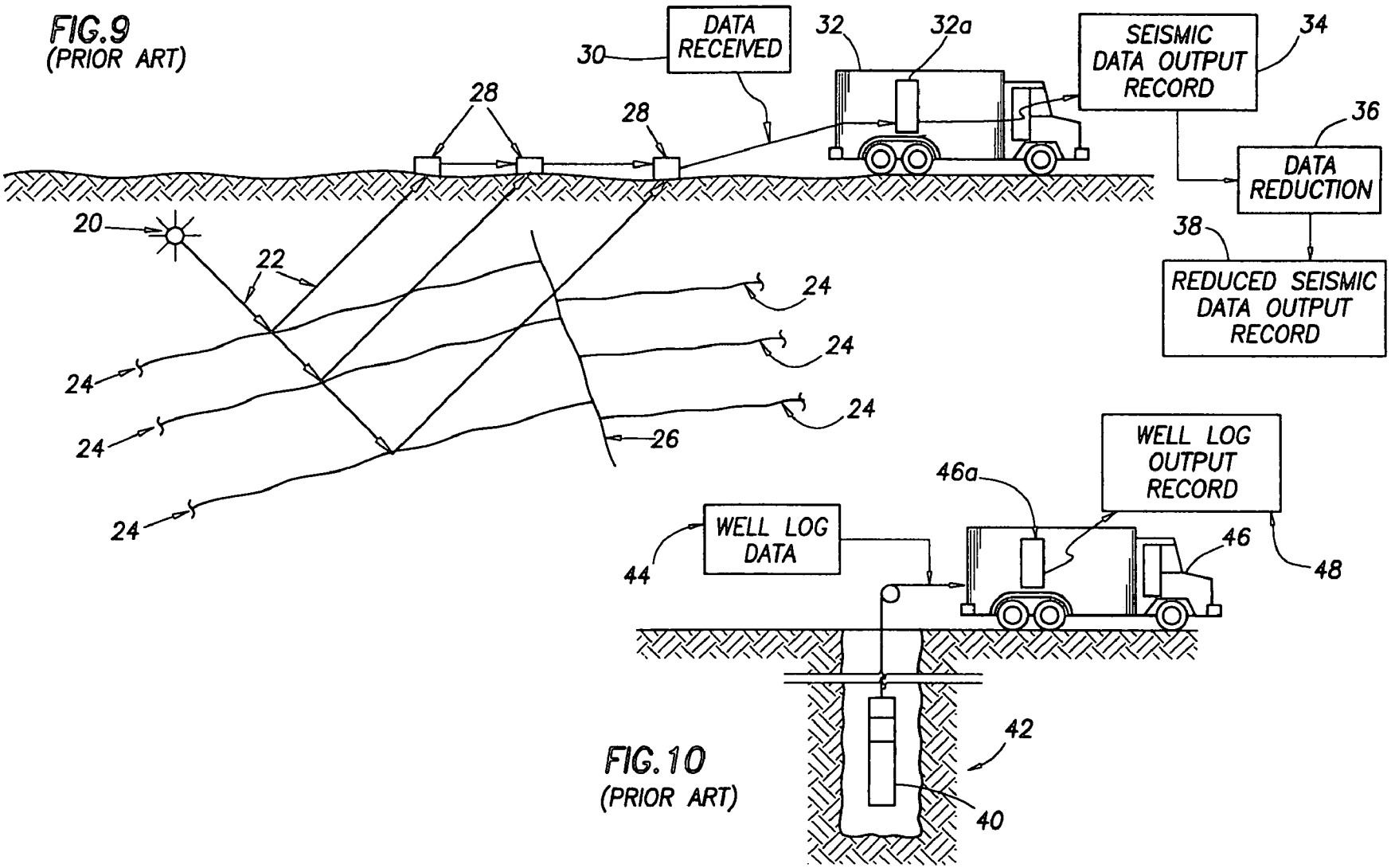
FIG. 9 (PRIOR ART)
FIG. 10 (PRIOR ART)
FIGS. 9 and 10 illustrate a well logging operation and a seismic operation.

Referring to FIGS. 9 and 10, a seismic operation and a well logging operation are illustrated.

In FIG. 9, an explosive source 20 produces sound vibrations 22 in the form of seismic waves 22 which reflect off a plurality of horizons 24 in an earth formation. The horizons 24 are intersected by faults, such as fault 26 in FIG. 9. The seismic waves 22 are received by a plurality of geophones 28 situated at the earth's surface. A plurality of data, called "data received", 30 are generated by the geophones 28, the data received 30 being provided as input data to a computer 32*a* of a recording truck 32. A seismic data output record 34 is generated by the computer 32*a* of the recording truck 32. The seismic data output record 34 undergoes a data reduction operation 36 which thereby produces a reduced seismic data output record 38.

In FIG. 10, a logging tool 40 is lowered into a borehole 42 and well log data 44 is generated from the logging tool 40. The well log data 44 is received by a computer 46*a* of a logging truck 46, and a well log output record 48 is generated.

Some or all of the reduced seismic data output record 38 and the well log output record 48 of FIGS. 9 and 10 may be used to construct the Eclipse data set full field model 70 and the Geological Model 74 of FIG. 13, the Eclipse data set full field model 70 and the Geological Model 74 of FIG. 13 being used as input data to a workstation computer, which will be discussed later in this specification.

Figure 12:
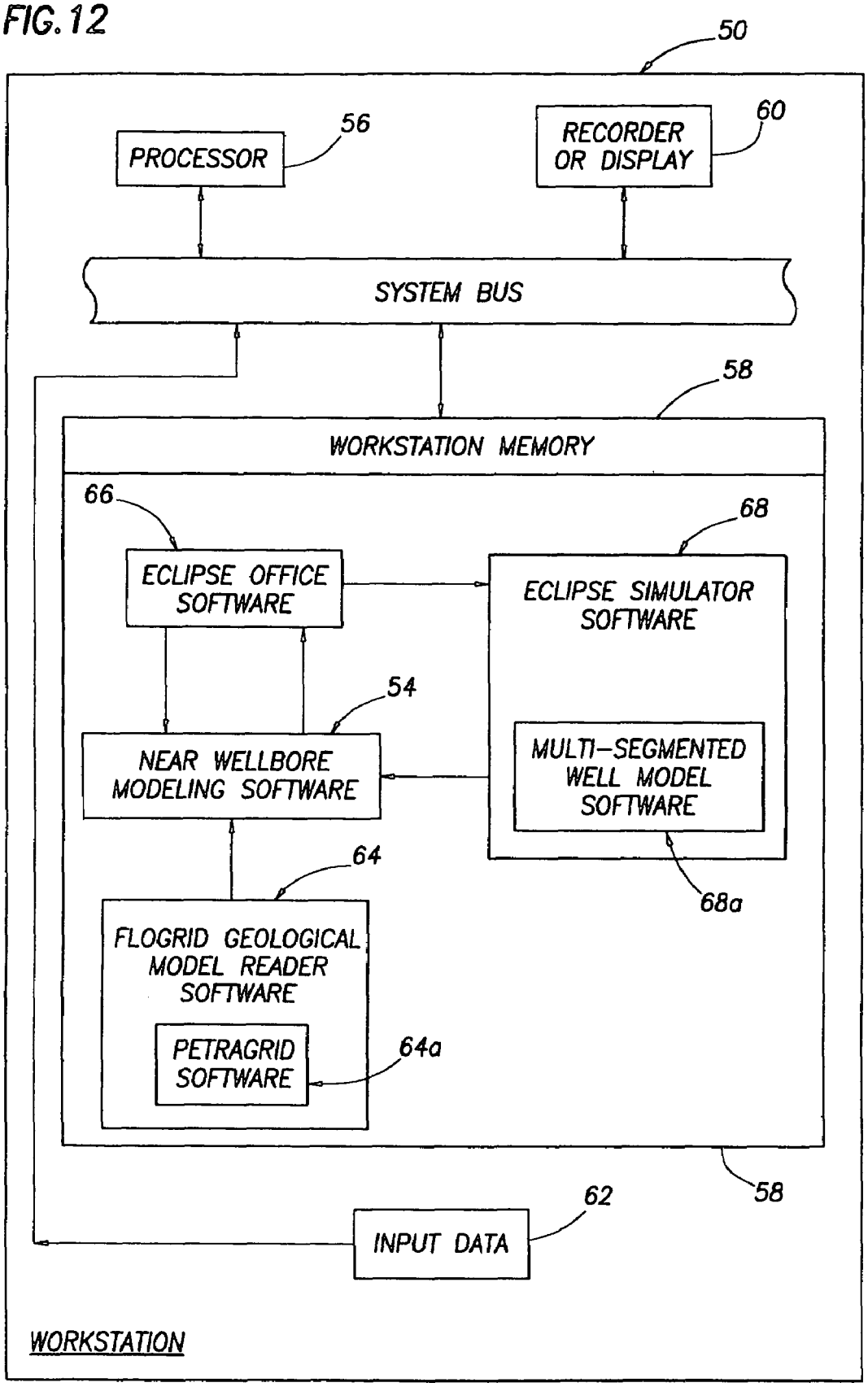

Referring to FIG. 1, a workstation computer 50 is illustrated. The workstation computer 50 includes the monitor, the processor, the keyboard, and the mouse. A program storage device, such as a CD-Rom, 52 stores a novel software in accordance with the present invention, hereinafter called the "near wellbore modeling software" 54, in addition to the other software which is illustrated in FIG. 12 discussed below. The CD-Rom 52 is inserted into the workstation 50 and the "near wellbore modeling software" 54, including the other software, is loaded from the CD-Rom 52 into a memory of the workstation computer 50.

Figure 11:
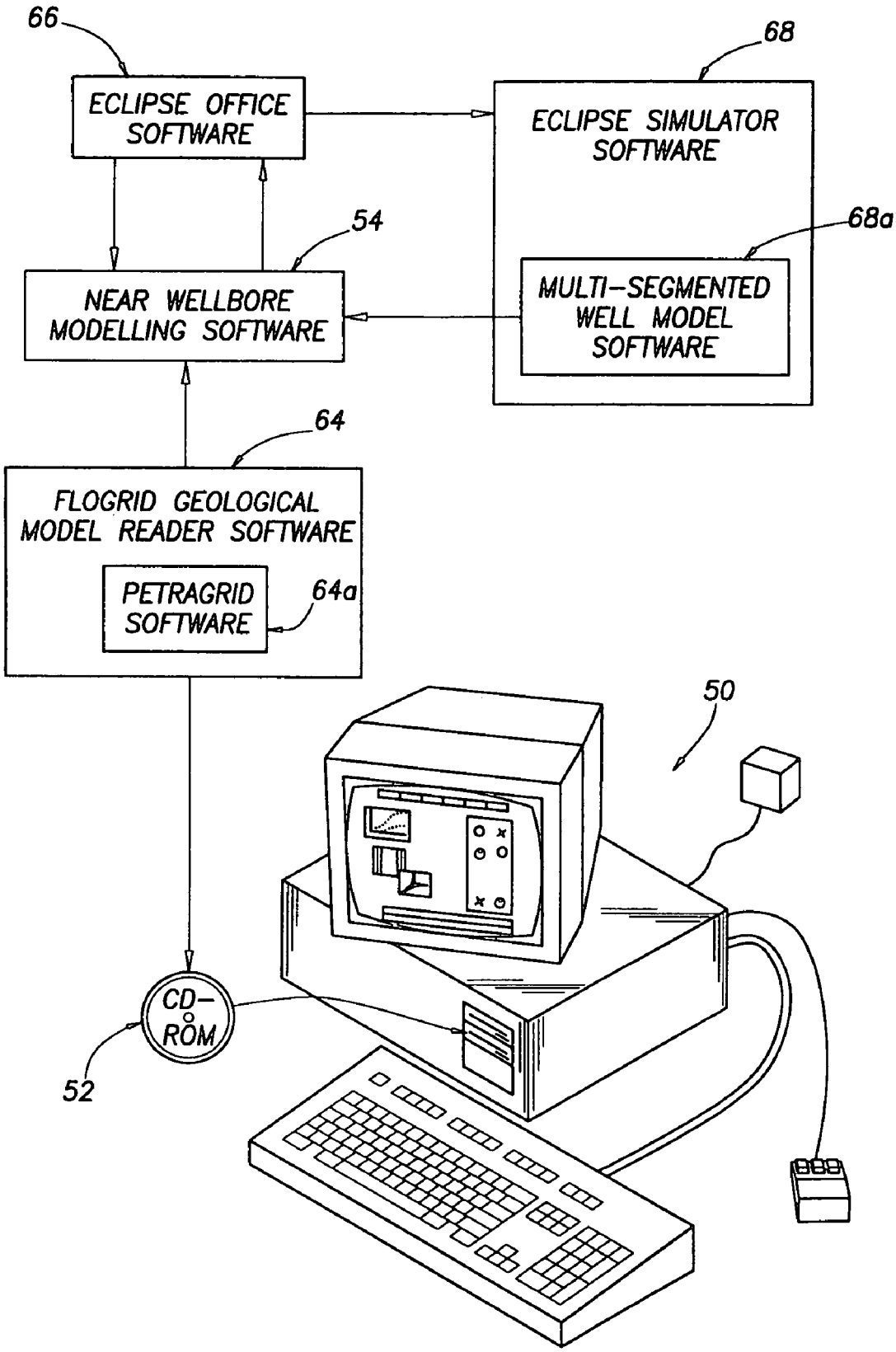

Referring to FIG. 12, the workstation 50 of FIG. 11 is illustrated in greater detail. The workstation 50 includes a processor 56 connected to a system bus, a workstation memory 58 connected to the system bus, and a recorder or display 60 also connected to the system bus, the display 60 being the monitor illustrated in FIG. 11. A set of input data 62 is provided to the workstation 50. The workstation memory 58 stores a plurality of software packages including: (1) the Near Wellbore Modeling software 54, (2) the Flogrid Geological Model Reader 64 which is incorporated into the "Flogrid software" including the Petragrid software 64*a* which is also incorporated into the "Flogrid software", (3) the Eclipse Office software 66, and (4) the Eclipse simulator software 68 which includes the Multi-Segmented Well Model software 68*a*. The input data 62 will be discussed below with reference to FIG. 13 of the drawings.

The "Flogrid software" is disclosed in prior pending U.S. patent application Ser. No. 09/034,701 filed Mar. 4, 1998, the disclosure of which has already been incorporated by reference into this specification.

The Petragrid software 64*a* is disclosed in prior pending U.S. patent application Ser. No. 08/873,234 filed Jun. 11, 1997, the disclosure of which has already been incorporated by reference into this specification.

The Eclipse Office software 66, and some of the Eclipse simulator software 68, is disclosed in prior pending U.K. patent application serial number 9817501.1 filed Aug. 12, 1998, the disclosure of which is incorporated by reference into this specification.

The Multi-segmented well model software 68*a* is discussed below in this specification.

Figure 13:
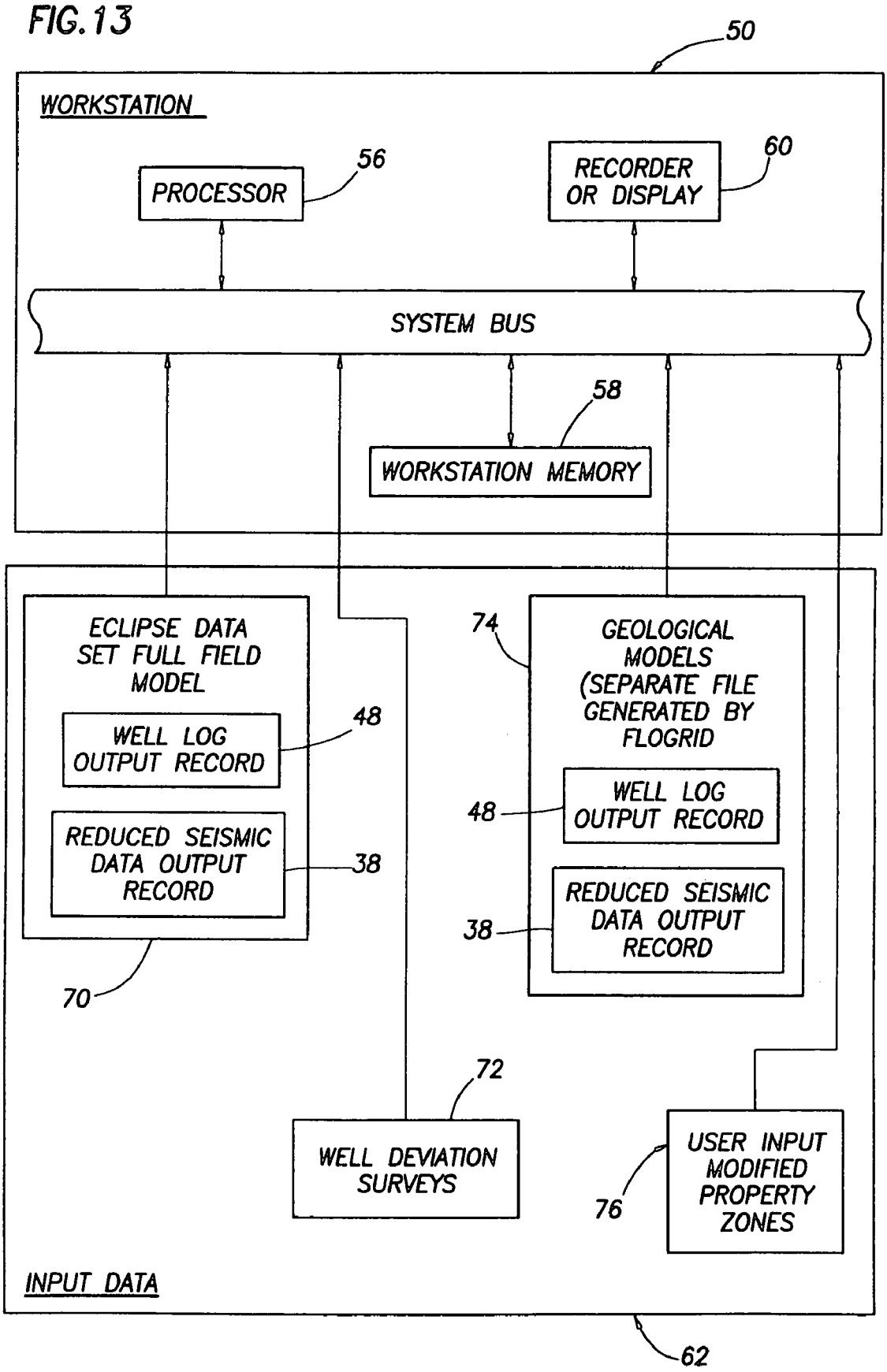

Referring to FIG. 13, the workstation 50 of FIG. 12 is again illustrated, however, in FIG. 13, the input data 62 of FIG. 12 is shown in greater detail. In FIG. 13, four types of input data 62 are provided to the workstation 50: (1) the Eclipse data set full field model 70, which is constructed using some or all of the well log output record 48 and the reduced seismic data output record 30 of FIGS. 9 and 10, (2) well deviation surveys 72, (3) Geological models 74 (a separate file generated by the Flogrid software 64) which is constructed using some or all of the well log output record 48 and the reduced seismic data output record 38, and (4) user input modified property zones. The above input data 62 will be better understood in connection with a functional description of the near wellbore modeling software 54 of the present invention set forth hereinbelow.

Referring to FIG. 14, the workstation memory 58 of FIG. 12 is again illustrated. However, in FIG. 14, a unique user interface 78 is interposed between the multi-segmented well model software 68*a* and the near wellbore modeling software 54 of the present invention.

Referring to FIG. 15, the workstation memory 58 of FIG. 12 is again illustrated. Recall from FIGS. 12 and 14 that the Flogrid Geological Model Reader software 64 stored in the workstation memory 58 is incorporated into and forms a part of the "Flogrid software". Recall again from FIG. 12 that the Petragrid software 64*a* is also incorporated into and forms a part of the "Flogrid software". In FIG. 15, the Flogrid software itself, which includes the Flogrid Geological Model Reader software 64 and the Petragrid software 64*a*, is illustrated. Recall that the Flogrid software 64 is disclosed in prior pending U.S. patent application Ser. No. 09/034,701 filed Mar. 4, 1998 and entitled "Simulation gridding method and apparatus including a structured areal gridder adapted for use by a reservoir simulator", the disclosure of which has already been incorporated by reference into this specification.

In FIG. 15, the Flogrid software 64 includes the structured gridder 64*d* for generating a structured grid (including a plurality of rectangularly or cylindrically shaped grid cells), and the Petragrid unstructured gridder 64*a* for generating an unstructured grid (including a plurality of tetrahedrally shaped grid cells). Recall that the Petragrid unstructured gridder 64*a* is disclosed in prior pending U.S. patent application Ser. No. 08/873,234 filed Jun. 11, 1997, the disclosure of which has already been incorporated by reference into this specification. In the Flogrid software 64, a reservoir data store 64*b* is provides an input to the reservoir framework 64*c* and the reservoir framework 64*c* provides an input to both the structured gridder 64*d* and the Petragrid unstructured gridder 64*a*. The structured gridder 64*d* provides an input to an upscaler 64*e*. The upscaler 64*e* and the Petragrid unstructured gridder 64*a* provide an input to the Eclipse simulator software 68. A set of simulation results 82 are generated by the Eclipse simulator software 68, the simulation results 82 being displayed on a 3-D viewer 80 for observation by a workstation operator.

Figure 16:
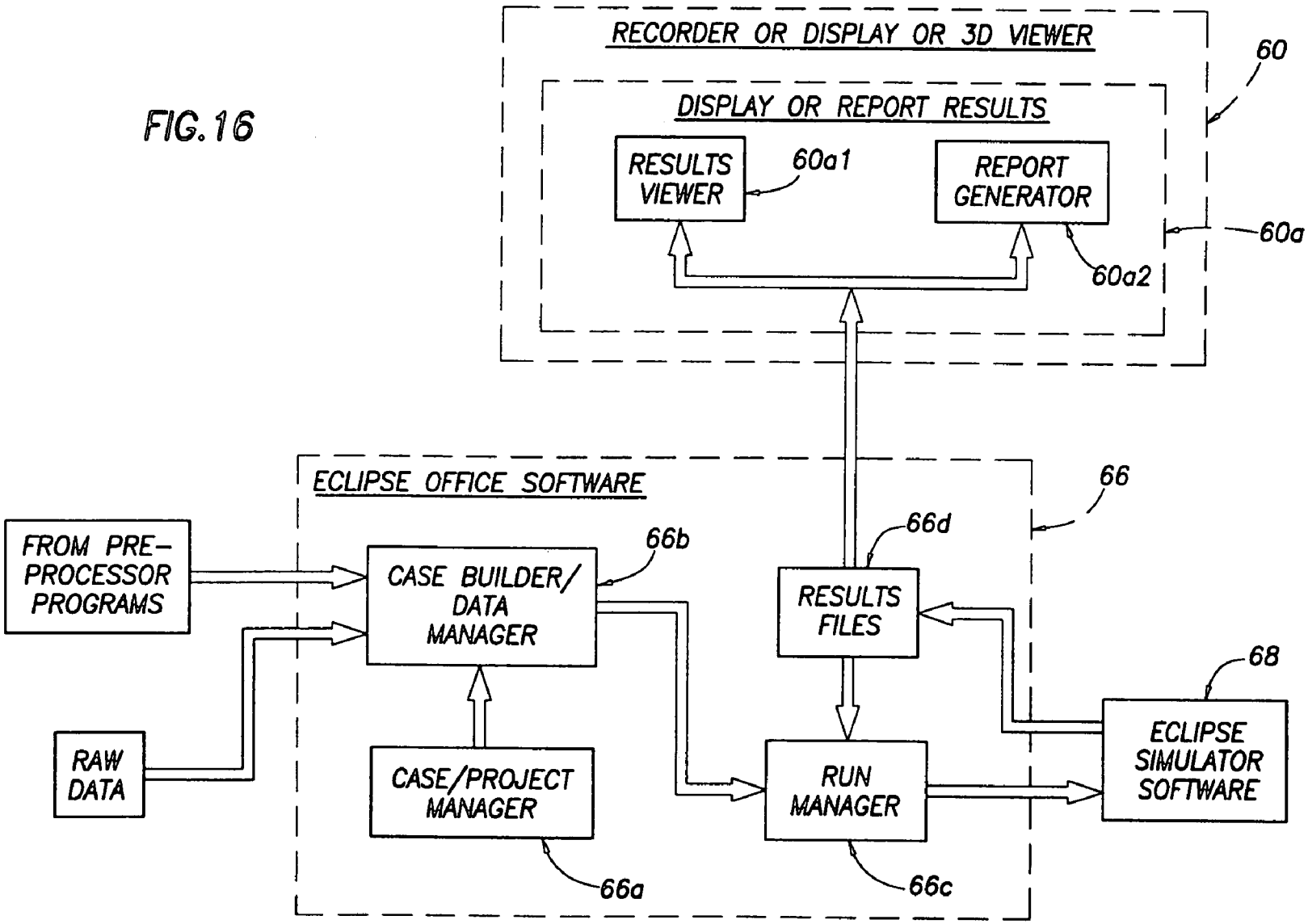
FIG. 16 illustrates the Eclipse office software of FIG. 12.

Referring to FIG. 16, a more detailed construction of the Eclipse office software 66 of FIG. 12 is illustrated. Recall that the Eclipse office software 66 is disclosed in prior pending U.K. patent application serial number 9817501.1 filed Aug. 12, 1998 and entitled "Simulation system including a simulator and a case manager adapted for organizing data files for the simulator in a tree like structure", the disclosure of which has already been incorporated by reference into this specification. The Eclipse office software 66 includes a case manager 66*a* for storing a plurality of case scenarios in a tree like structure, an operator selecting a case scenario, a case builder 66*b* for receiving the selected case scenario from the case manager 66*a* and editing or changing the selected case scenario in response to editing operations by a workstation operator, a run manager 66*c* for submitting the edited case scenarios to the Eclipse simulator 68 and monitoring the edited case scenarios submitted to the simulator, and a results file 66*d* for storing a set of simulation results generated by the Eclipse simulator 68. A recorder or display or 3D viewer 60 in FIG. 16 will display the results stored in the results file 66*d*. The recorder or display 60 will display or report results 60*a* by displaying the results on a results viewer 60*a*1 and a report will be generated via a report generator 60*a*2.

Figure 17:
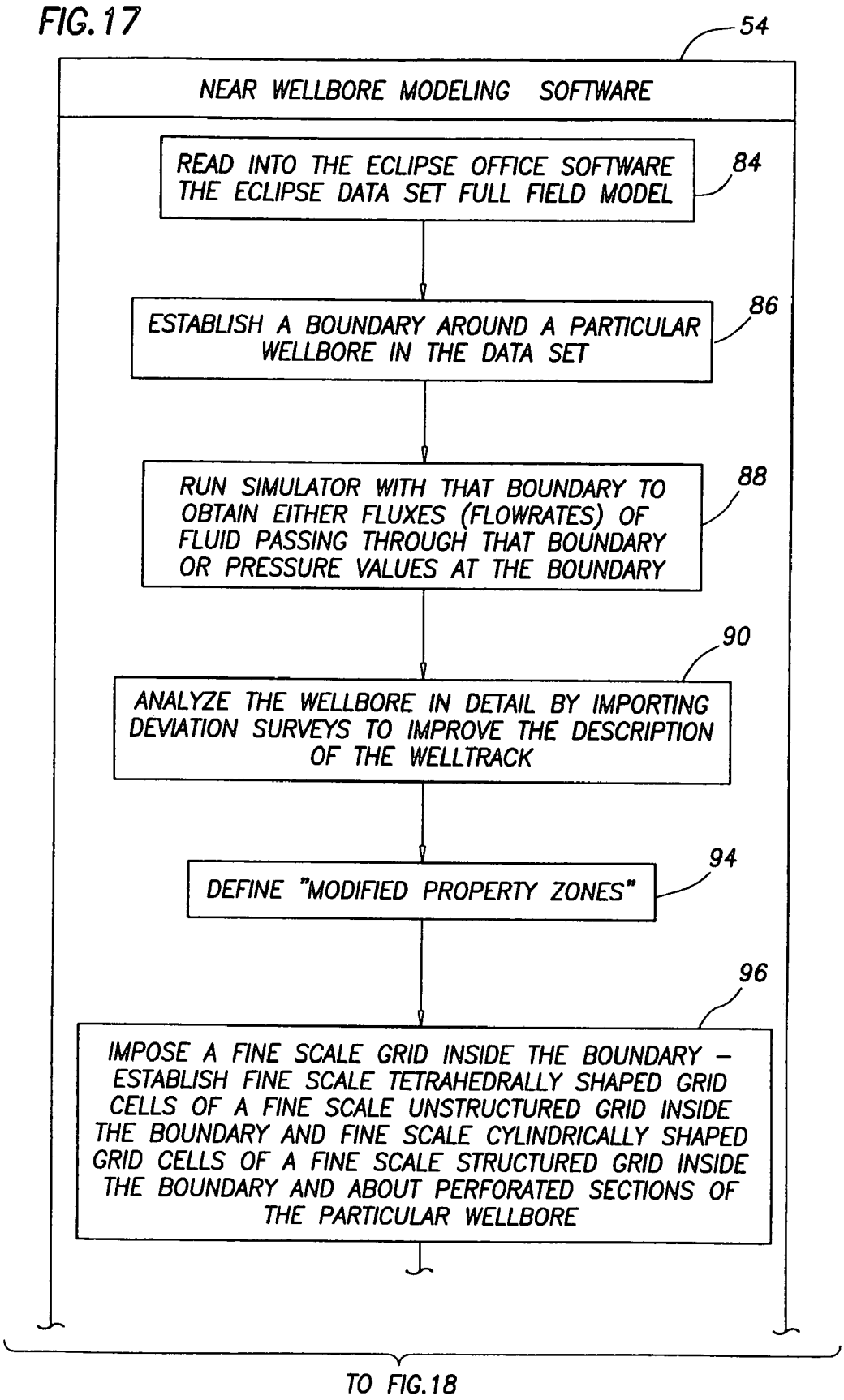
FIGS. 17 and 18 illustrate a construction of the "near wellbore modeling" software of the present invention.
Figure 18:
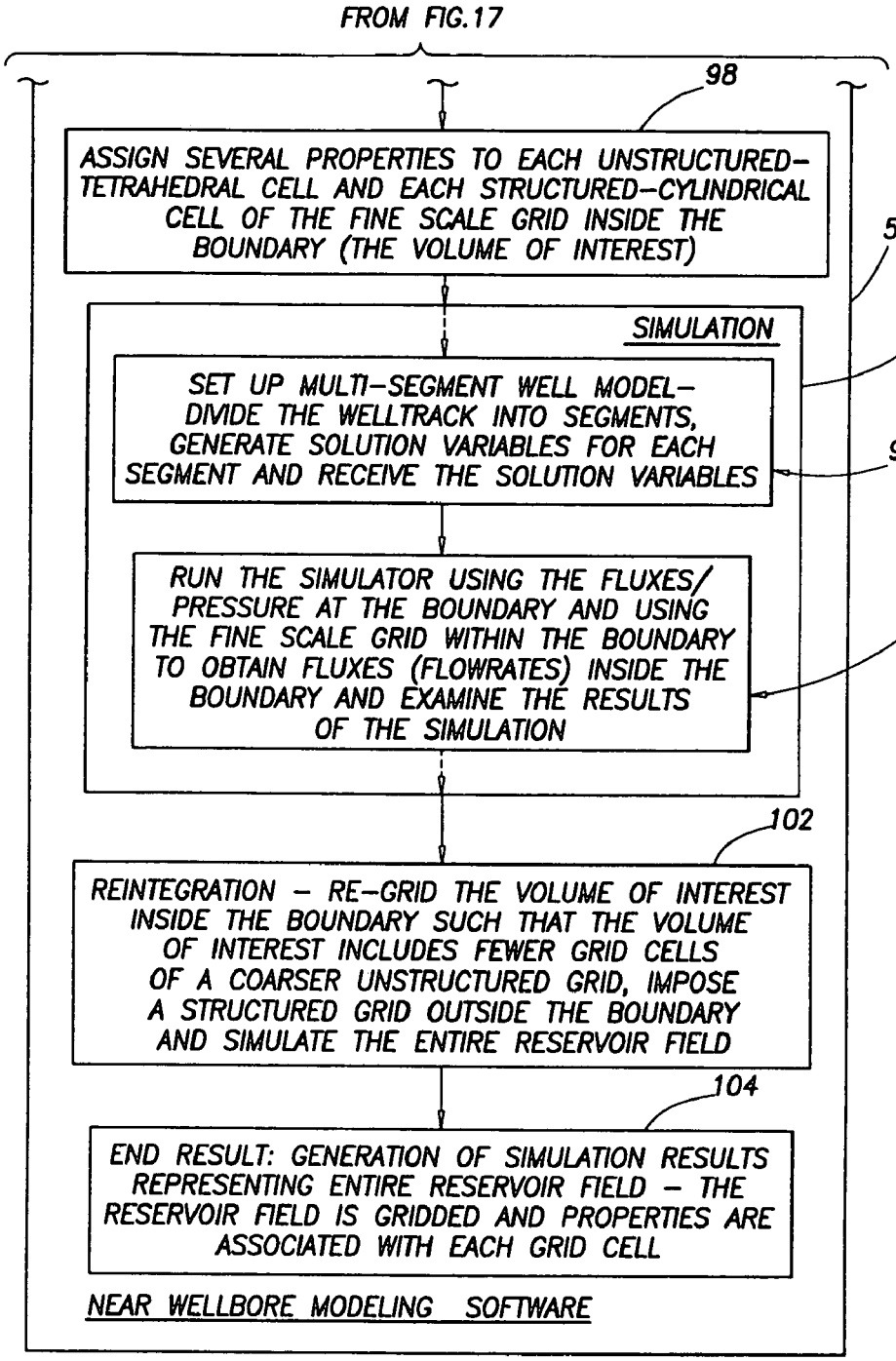

Referring to FIGS. 17 and 18, a functional block diagram associated with the Near Wellbore Modeling (NWM) software 54 of the present invention of FIG. 12 is illustrated. The functional block diagram of FIGS. 17 and 18 defines the functional steps performed by the Near Wellbore Modeling (NWM) software 54 of the present invention shown in FIG. 12. Bear in mind, however, that, because the NWM software is an interactive program, the user/operator will not, in general, move sequentially through each step described in the figures, but rather will generally progress in the direction indicated in FIGS. 17 and 18. Some steps may be missed altogether (e.g., defining modified property zones), and others may be revisited many times before moving on to the next step (e.g., gridding within the boundary). In FIG. 17, during the execution of the Near Wellbore Modeling (NWM) software 54, the first functional step performed by the near wellbore modeling software 54 is as follows:

1. Read into the Eclipse office software 66 the Eclipse data set full field model 70 of FIG. 13, block 84 of FIG. 17.

In FIG. 17, when the Eclipse data set full field model 70 is read into the Eclipse office software 66, the following additional functional steps are performed during the execution of the Near Wellbore Modeling software 54 of FIG. 17 of the present invention:

2. Establish a boundary around a particular wellbore in the data set, block 86 of FIG. 17.

3. Run the simulator 68 of FIG. 12 with that boundary to obtain either fluxes (flowrates) of fluid passing through that boundary or pressure values at the boundary, block 88 of FIG. 17.

4. Analyze the wellbore in detail by importing deviation surveys 72 of FIG. 13 to improve the description of the welltrack, block 90 of FIG. 17.

5. Define "modified property zones", block 94 of FIG. 17.

6. Impose a fine scale grid inside the boundary—establish fine scale tetrahedrally shaped grid cells of a fine scale unstructured grid inside the boundary and fine scale cylindrically shaped grid cells of a fine scale structured grid inside the boundary and about perforated sections of the particular wellbore, block 96 of FIG. 17.

In FIG. 18, the following additional functional steps are performed during the execution of the near wellbore modeling software 54 of the present invention:

7. Assign several properties to each unstructured-tetrahedral cell and each structured cylindrical cell of the fine scale grid inside the boundary (the volume of interest), block 98 of FIG. 18.

8. Run the simulator 68 of FIG. 12 and perform a simulation, block 100 of FIG. 18, and, during this simulation represented by block 100, execute the following two blocks of code: (1) set up a Multi-segment well model by dividing the welltrack into segments, generating solution variables for each segment, and receiving the solution variables, block 92 of FIG. 18, and (2) run the simulator using the fluxes/pressure values at the boundary and using the fine scale grid within the boundary to obtain fluxes (flowrates) inside the boundary and examine the results of the simulation, block 101 of FIG. 18.

9. Re-integration—regrid the volume of interest inside the boundary such that the volume of interest includes fewer grid cells of a coarser unstructured grid, impose a structured grid outside the boundary, and simulate the entire reservoir field, block 102 of FIG. 18.

10. End result: generation of simulation results representing entire reservoir field; the reservoir field is gridded and properties are associated with each grid cell, block 104 of FIG. 18.

Each of the above referenced steps 1 through 10 representing the functional steps practiced by the Near Wellbore Modeling software 54 of the present invention shown in FIGS. 17 and 18 will be discussed in detail below with primary reference to FIGS. 19 through 44 of the drawings with alternate reference to FIGS. 1 through 18 of the drawings.

Read into the Eclipse office software 66 the Eclipse data set full Field model 70 of FIG. 13, block 84 of FIG. 17.

In FIG. 13, the Eclipse data set full field model 70 was constructed using some or all of the well log output record 48 and the reduced seismic data output record 38. In FIG. 12, during this first step in the functional operation of the Near Wellbore Modeling software 54, the Eclipse data set full field model 70 is read into the Eclipse office software 66 of FIG. 12.

Figure 19:
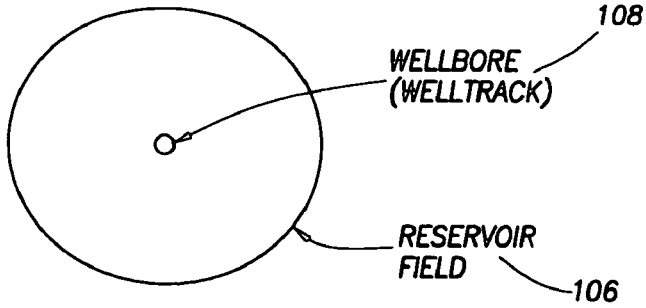

In FIG. 19, the Eclipse data set full field model 70 contains data pertaining to an entire oilfield reservoir field 106, the reservoir field 106 containing a plurality of wellbores. One of those wellbores includes the wellbore or welltrack 108 shown in FIG. 19. Assume that the earth formation surrounding and in the immediate vicinity of wellbore 108 in FIG. 19 exhibits certain peculiar characteristics and these characteristics are not well understood. Consequently, in view of these peculiar characteristics, it is necessary to "near wellbore model" the earth formation in the vicinity of wellbore/welltrack 108 shown in FIG. 19. The following paragraphs of this discussion will set forth the functional steps practiced by the Near Wellbore Modeling software 54 of this invention which will "near wellbore model" the earth formation in the vicinity of welltrack 108 in FIG. 19.

Establish a boundary around a particular wellbore in the data set, block 86 of FIG. 17.

In FIG. 20, establish a boundary 110 around the welltrack 108 within the reservoir field 106.

Run the simulator 68 of FIG. 12 with that boundary to obtain either fluxes (flowrates) of fluids passing through that boundary or pressure values at the boundary, block 88 of FIG. 17.

In FIGS. 12, 13, and 16 recalling that the Eclipse data set full field model 70 of FIG. 13 has been read into the case builder 66*b* of the Eclipse office software 66 of FIGS. 12 and 16, the case builder 66*b* will submit the Eclipse data set full field model 70 to the run manager 66*c*, and the run manager will submit the full field model 70 to the Eclipse simulator 68 in FIG. 16. The simulator 68 will execute while using the Eclipse data set full field model 70.

In FIG. 21, as a result of the execution of the Eclipse simulator 68 while utilizing the Eclipse data set full field model 70, a plurality of fluxes or flowrates 112 (illustrated in FIG. 21) of fluid passing through the boundary 110 will be determined. Alternatively, a plurality of pressure values 112 at the boundary 110 will be determined. It is necessary to determine the fluxes/pressure values 112 of FIG. 21 because these fluxes/pressure values 112 will be used during subsequent executions of the Eclipse simulator 68 for the purpose of mimicking the behavior of that portion 114 of the reservoir field 106 in FIG. 21 which is located outside the boundary 110 between the boundary 110 and the outer periphery 116 of the reservoir field 106. During such subsequent executions of the simulator 68, that portion 114 outside the boundary 110 will not be modeled because the modeling effort during such executions of the simulator 68 will be focused entirely on that portion of the reservoir field 106 which is located inside the boundary 110. However, during such executions of the simulator 68, in order to mimic the behavior of that portion 114 of the reservoir field 106 located outside the boundary 110, the fluxes/pressure values 112 will be used during such subsequent executions of the Eclipse simulator 68.

In FIG. 22, more particularly, a wellbore 118 has a certain welltrack 120, the welltrack 120 representing, for example, the lateral part of a multilateral wellbore. A boundary 110 has already been established around the wellbore 118 for the purpose of studying, in detail, the earth formation which is located between the boundary 110 and the wellbore 118 (recall that this part of the earth formation is exhibiting peculiar characteristics). A plurality of "fine scale" tetrahedrally shaped grid cells of an "unstructured grid" 122 are placed inside the boundary 110, and a plurality of rectangularly shaped grid cells of a "structured" grid 124 are placed outside the boundary 110. In addition, a plurality of "fine scale" cylindrically shaped grid cells of a "structured" grid 125 are placed about the perforated sections of the wellbore 118. As a result of the aforementioned subsequent executions of the Eclipse simulator 68, using the fluxes/pressure values 112 at the boundary 110 are being used to mimic the behavior of the reservoir field 106 that is located outside the boundary 110 and using the "fine scale" tetrahedrally shaped grid cells of the unstructured grid 122 in addition to the "fine scale" cylindrically shaped grid cells of the structured grid 125, the end result of such subsequent executions of the simulator 68 will be as follows: the fluxes/flowrates 126 of fluids flowing into the wellbore 118 will be determined.

Analyze the wellbore in detail by importing deviation surveys 72 of FIG. 13 to improve the description of the welltrack, block 90 of FIG. 17.

In FIG. 22, the welltrack 120 description may be somewhat crude. In FIG. 13, therefore, in order to improve the description of the welltrack 120 for purposes of improving the results of the simulation practiced by simulator 68, the workstation 50 of FIG. 13 will receive as input data the "well deviation surveys" 72. The well deviation surveys 72 of FIG. 13 represent detailed tracks in space. When the well deviation surveys 72 are introduced as input data to the workstation 50 of FIG. 13, the detailed tracks in space inherent in the surveys 72 will improve the description of the welltrack 120. As a result, when the Eclipse simulator 68 completes its execution, the results achieved by the simulation will be much improved.

Define "Modified Property Zones", Block 94 of FIG. 17.

Referring to FIG. 23, divide the wellbore 118 of FIG. 22 into a plurality of segments and determine a set of "solution variables" for each of the segments (the method and apparatus for determining the "solution variables" will be discussed later in this specification). For example, in FIG. 23, a multi-segmented wellbore 118 is illustrated which consists of a plurality of segments, such as segments 130, 132, 134, and 136. As illustrated in FIG. 23, a set of "solution variables" define each segment.

Figure 35:
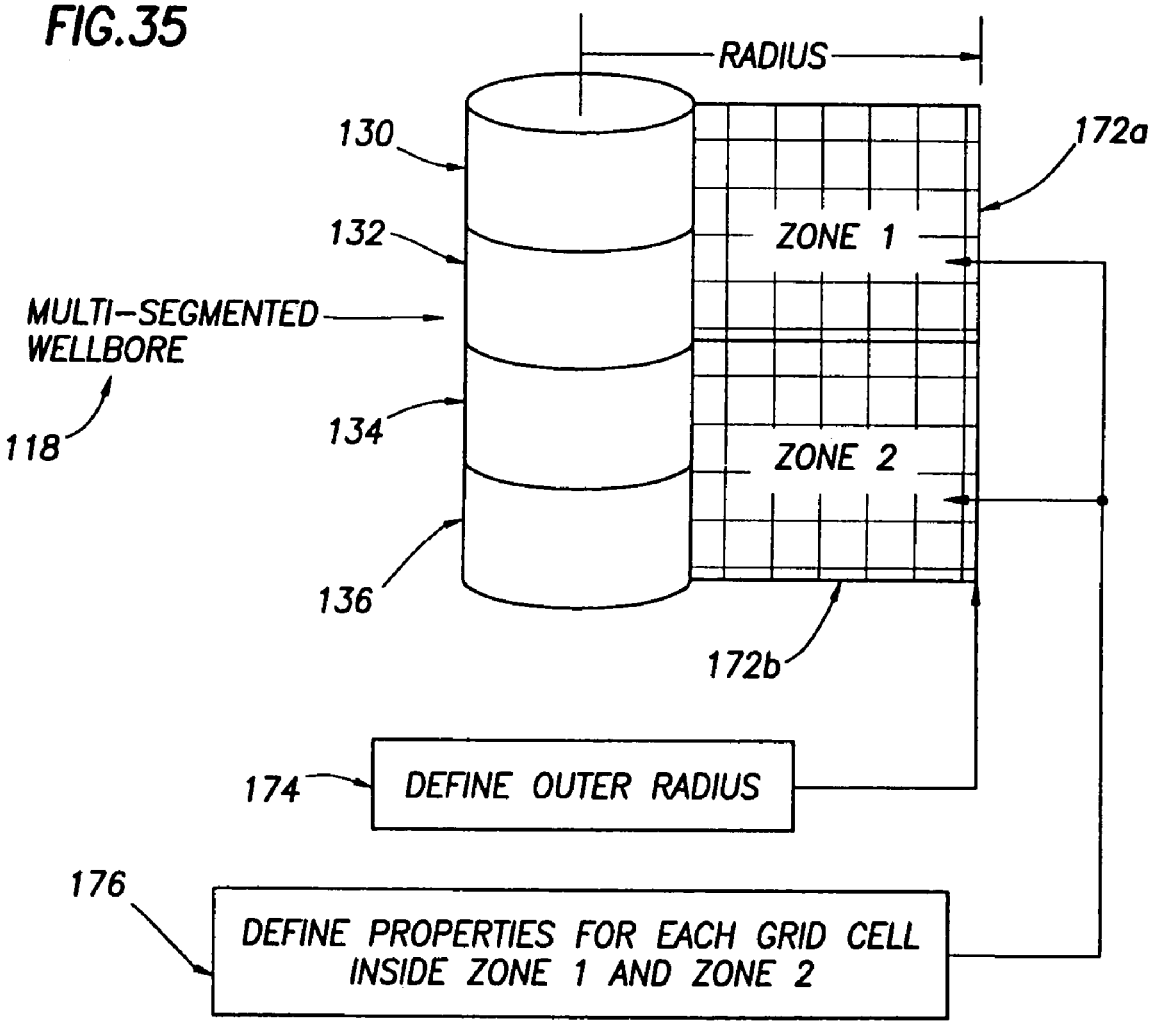

Referring to FIG. 35, the multi-segmented wellbore 118 of FIGS. 22 and 23 is illustrated again; however, in FIG. 35, certain "modified property zones" 172*a* and 172*b* are defined by the operator/user of the workstation 50 of FIG. 13. "Zone 1" 172*a* and "zone 2" 172*b* comprise the "modified property zones" in FIG. 35. These modified property zones 172*a*/172*b* are regions in the earth formation located external to the wellbore 118 of FIGS. 22 and 23 (between the boundary 110 and the wellbore 118 of FIG. 22) where the fine scale tetrahedrally shaped grid cells 122 of the unstructured grid 122 of FIG. 22 is located. In FIG. 35, the operator/user of workstation 50 must first "define the outer radius" 174 of the "zone 1" 172*a* and the "zone 2" 172*b*. Then, the operator/user must "define properties for each (tetrahedrally shaped) grid cell inside 'zone 1' and 'zone 2' " 176. However, these "properties" (assigned to each tetrahedrally shaped grid cell in the modified property zones 172*a*/172*b* of FIG. 35) are not taken from the "Eclipse Data Set full field model" 70 of FIG. 13; and, in addition, these "properties" are not taken from the Flogrid Upscaler 64*e* of FIG. 15. Rather, the "properties" for each tetrahedrally shaped grid cell in the modified property zones 172*a*/172*b* of FIG. 35 are set equal to a user defined value.

Figure 36:
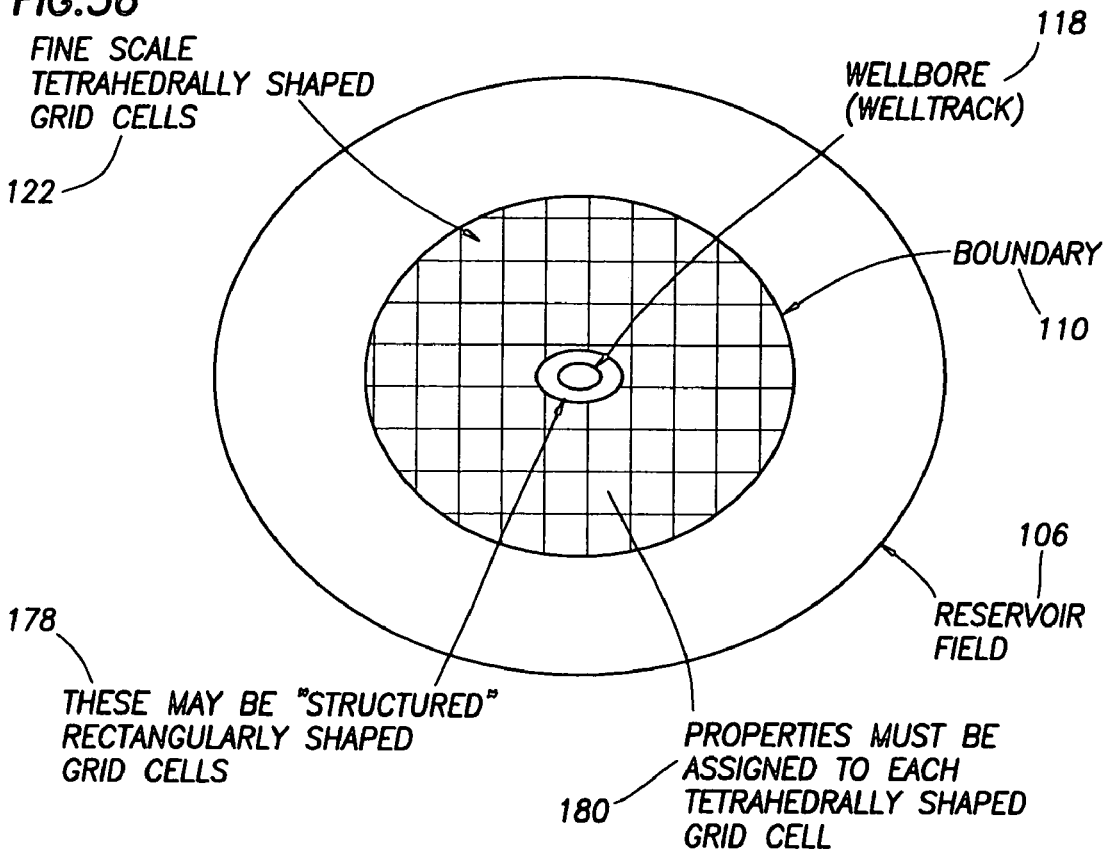

Impose a fine scale grid inside the boundary—establish fine scale tetrahedrally shaped grid cells of a fine scale unstructured grid inside the boundary and fine scale cylindrically shaped grid cells of a fine scale structured grid inside the boundary and about perforated sections of the particular wellbore Referring to FIG. 36, using the "Petragrid" unstructured gridder 64*a* of the Flogrid software 64 of FIG. 15, set up and establish a "fine scale" unstructured grid 122 comprised of a plurality of fine scale tetrahedrally shaped grid cells 122 inside the boundary 110 illustrated in FIG. 36. Note that a "fine scale" structured grid 178 comprised of a plurality of rectangularly or cylindrically shaped grid cells 178 may be located near the wellbore 118 about the perforated sections of the wellbore 118, as illustrated in FIG. 36. The structured grid 178 is established by the structured gridder 64*d* of the Flogrid software 64 in FIG. 15. At this point, certain other "properties" 180 must be assigned to each tetrahedrally shaped grid cell 122 in FIG. 36. The term "fine scale" refers to the number of grid cells of the unstructured grid 122 and the structured grid 178 inside the boundary 110. In later sections of this specification, the grids 122/178 in FIG. 36 will be "coarsened"; that is, the number of grid cells inside the boundary 110 will be reduced. At that point, the "fine scale" unstructured grid 122 and the "fine scale" structured grid 178 will each be changed to a "coarse" grid.

Assign several properties to each unstructured tetrahedral cell and each structured cylindrical cell of the fine scale grid inside the boundary (the volume of interest), block 98 of FIG. 18.

Figure 37:
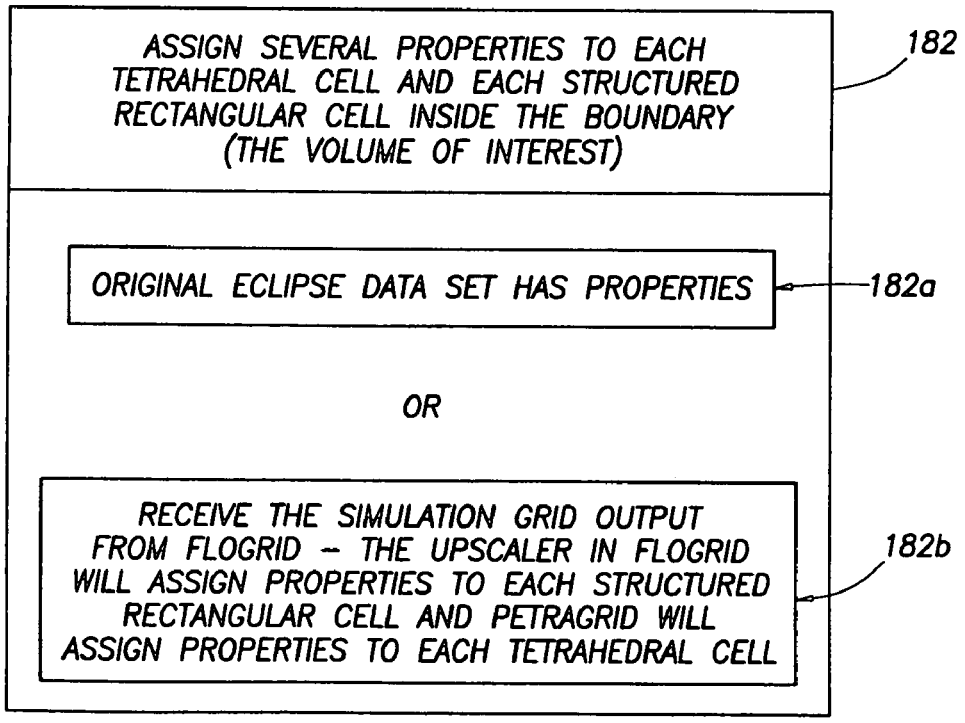
Figure 38:
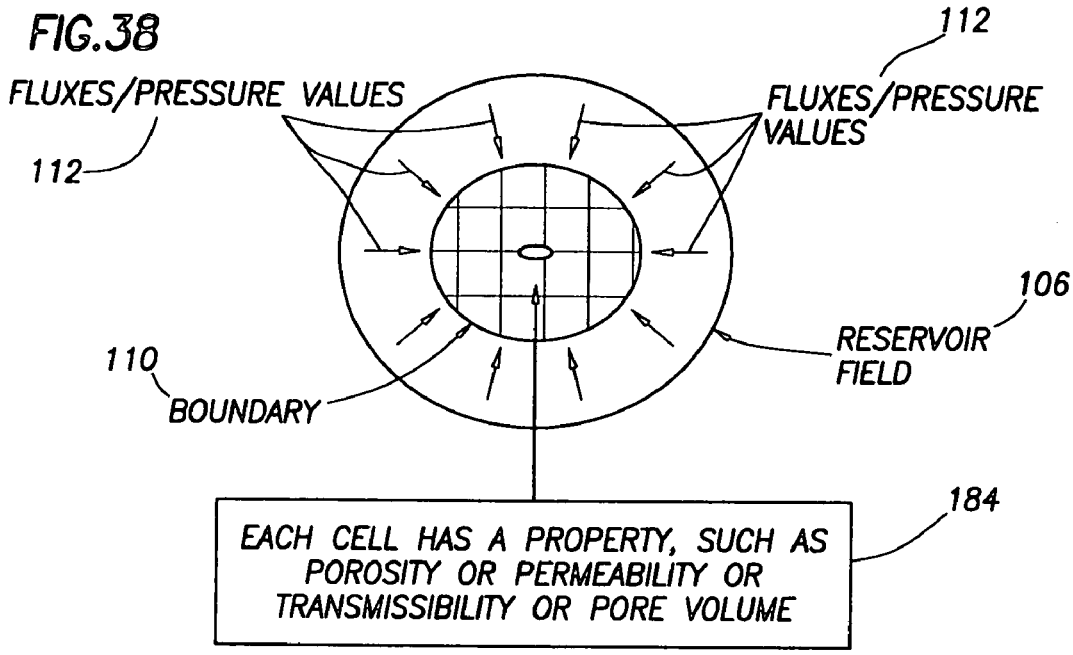

Referring to FIGS. 37 and 38, referring initially to FIG. 37, assign several "properties" to each fine scale tetrahedrally shaped unstructured grid cell 122 of FIG. 36 and to each fine scale structured grid cell 178 of FIG. 36 located inside the boundary 110 of FIG. 36, block 182 of FIG. 37. There are two ways to assign these 'properties' to each unstructured and structured grid cell inside the boundary 110 of FIG. 36: (1) the original Eclipse Data Set Full Field Model 70 of FIG. 13 has certain 'properties', block 182*a* of FIG. 37; however, these 'properties' are coarse and somewhat unacceptable; and (2) import the "Geological Models" 74 of FIG. 13 which is a separate file generated by Flogrid 64 of FIG. 15; that is, receive the "simulation grid properties" 64*e*1 which are generated by and output from the Upscaler 64*e* of the Flogrid software 64 of FIG. 15, block 182*b* of FIG. 37; in that case, the Upscaler 64*e* in the Flogrid software 64 will assign 'properties' to each structured, cylindrically shaped grid cell 178 located inside the boundary 110 of FIG. 36, and the Petragrid un-structured gridder 64*a* in the Flogrid software 64 will assign 'properties' to each un-structured, tetrahedrally shaped grid cell 122 located inside the boundary 110 of FIG. 36.

In FIG. 38, therefore, as a result of the discussion above with reference to FIG. 37, certain 'properties' have been assigned to each unstructured-tetrahedrally shaped grid cell 122 of FIG. 36 and to each structured-cylindrically shaped grid cell 178 of FIG. 36, these 'properties' including, for example, porosity or permeability or transmissibility or pore volume, block 184 of FIG. 38. In FIGS. 21 and 38, recall that certain fluxes/pressure values 112 at the boundary 110 (which were determined in connection with block 88 of FIG. 17 when the simulator 68 of FIG. 12 was run to obtain fluxes/pressure values through the boundary 110) will mimic the "remaining parts" of the reservoir field 106, which "remaining parts" are located between the boundary 110 and the external periphery 106 of the reservoir field 106 in FIG. 38.

Run the simulator 68 of FIG. 12 and perform a simulation, block 100 of FIG. 18, and, during this simulation represented by block 100, execute the following two sub-blocks of code: (1) set up a multi-segment well model by dividing the well-track into segments, generating solution variables for each segment, and receiving the solution variables, block 92 of FIG. 18, and (2) run the simulator using the fluxes/pressure values at the boundary and using the fine scale grid within the boundary to obtain fluxes (flowrates) inside the boundary and examine the results of the simulation, block 101 of FIG. 18.

Blocks 92 of block 100 in FIG. 18 will be discussed below with reference to FIGS. 23 through 34, and block 101 of block 100 in FIG. 18 will be discussed below with reference to FIGS. 39 through 41.

Setting Up the Multi-Segment Well Model, Block 92

Recall in FIG. 23 that the wellbore 118 of FIG. 22 was divided into a plurality of segments and it was determined that a set of "solution variables" should be calculated for each of the segments. For example, in FIG. 23, a multi-segmented wellbore 118 consisted of a plurality of segments, such as segments 130, 132, 134, and 136, and it was indicated that a set of "solution variables" would define each segment. During this next step in the execution of the Near Wellbore Modeling software 54 of the present invention, the "solution variables" corresponding to each segment 130 through 136 of the multi-segmented wellbore 118 of FIG. 23 is determined.

In FIGS. 24 through 34, the process or method for determining the set of "solution variables" for each segment 130, 132, 134, 136 of the multi-segement wellbore 118 in FIG. 23 is discussed in detail the following paragraphs with reference to FIGS. 24 through 34.

Referring to FIG. 24, a multilateral wellbore is illustrated. In FIG. 24, the multilateral wellbore includes a main stem and four lateral branches; however, the four lateral branches include an upper lateral branch, a middle lateral branch, and two bottom lateral branches. Segments 1, 2, 4, 5, 7, and 9 lie on the main stem. The upper lateral branch of the multilateral wellbore of FIG. 24 includes a plurality of segments, one of those segments being Segment 3. The middle lateral branch of the multilateral wellbore of FIG. 24 also includes a plurality of segments, one of those segments being Segment 6. The two bottom lateral branches of the multilateral wellbore of FIG. 24 each include a plurality of segments. That is, the left-most bottom lateral branch of the multilateral wellbore of FIG. 24 includes a plurality of segments, one of those segments being Segment 10; and the right-most bottom lateral branch of the multilateral wellbore of FIG. 24 includes a plurality of segments, one of those segments being Segment 8. In FIG. 24, each segment can be further divided up into a plurality of sub-segments. For example, Segment 1 can, for example, be divided up into several other sub-segments, such as sub-segments 1*a*, 1*b*, and 1*c*.

In FIG. 24, each "segment" can be characterized and represented by a set of "solution variables". That is, each segment can be characterized or represented by the following set of "solution variables": "Q", the flowrate of fluid in said each segment, "Fw", the fraction of water in that segment, "Fg", the fraction of gas in that segment, and "P", the absolute pressure in that segment. A shorthand notation for each set of "solution variables" for a particular segment is selected to be: "(Q, Fw, Fg, P)i", where "i" identifies the particular segment. Therefore, in FIG. 24, segment 1 of the multilateral wellbore can be characterized or represented by the solution variables "(Q, Fw, Fg, P) i=1", segment 2 of the multilateral wellbore can be characterized or represented by the solution variables "(Q, Fw, Fg, P) i=2", . . . , and segment 10 of the multilateral wellbore can be characterized or represented by the solution variables "(Q, Fw, Fg, P)i=10", etc. See FIG. 24 for a complete list of each set of solution variables "(Q, Fw, Fg, P) i" which characterize and represent each of the segments 1 through 10 of the multilateral wellbore of FIG. 24.

A single bore wellbore has a single pipeline or branch, and that single branch could also be divided up into a plurality of segments, where each segment is characterized or represented by a set of solution variables (Q, Fw, Fg, P)i.

Referring to FIGS. 25 through 33, a more detailed construction of the Eclipse simulator software 68 of FIG. 12 is illustrated.

Figure 25:
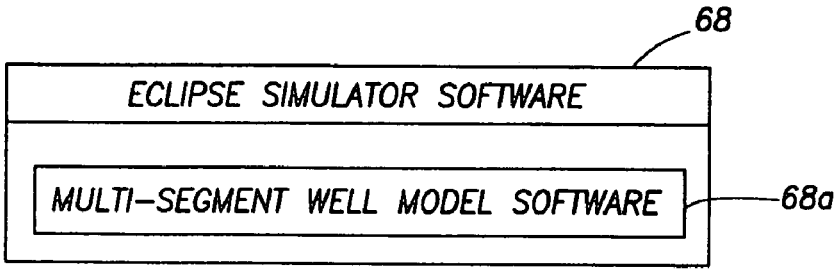
Figure 26:
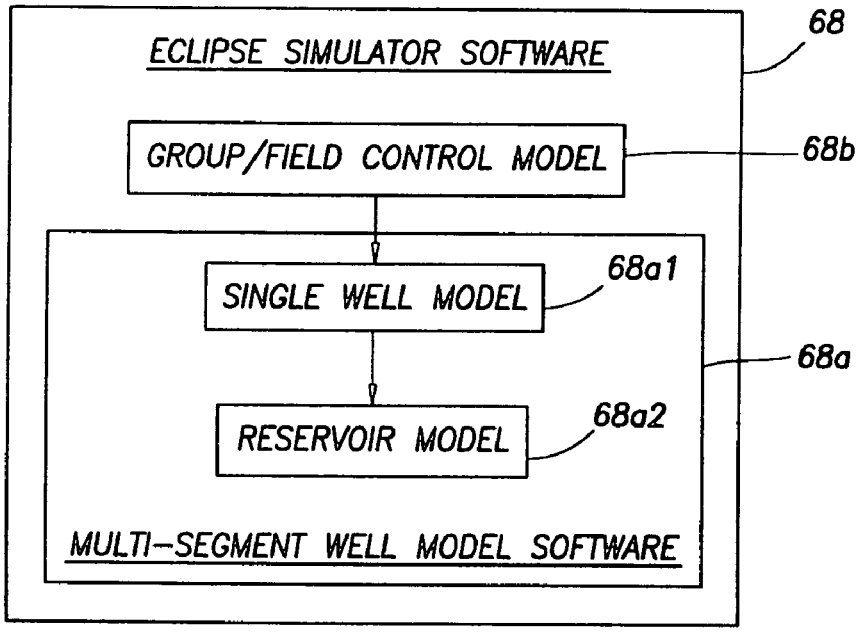

In FIGS. 25 and 26, referring initially to FIG. 25, the Eclipse simulator software 68 of FIG. 12 includes a multi-segment well model software 68*a*. In FIG. 26, the Eclipse simulator software 68 includes a group/field control model software 68*b* and the multi-segment well model software 68*a* which is responsive to the group/field control model software 68*b*. However, in FIG. 26, the multi-segment well model software 68*a* further includes a single well model software 68*a*1 and a reservoir model software 68*a*2 which jointly determine the solution variables (Q, Fw, Fg, P) for each segment of a well.

In FIG. 26, the group/field control model software 68*b* sends targets/limits to the single well model 68*a*1. These targets might be a flow target, such as an oil rate production target, or a pressure target if the group/field control model includes a surface network model (each well has its own target to which the well must produce). The group/field control model 68*b* must deal with all the collective aspects of production and injection; that is, producing a field to a certain target, allowing for pressure losses for pipelines on the surface, etc.

In response to the targets/limits from the group/field control model 68*b*, the single well model 68*a*1 sends well flow rates up to the group/field control model 68*b*. In addition, the single well model 68*a*1 sends grid block connection flow rates and derivatives down to the reservoir model 68*a*2. The single well model 68*a*1 models each individual well within the reservoir; that is, the single well model operates on a plurality of wells, one at a time.

The reservoir model 68*a*2 provides information about fluid conditions in the grid blocks up to the single well model 68*a*1; in addition, the reservoir model 68*a*2 provides the increments to the segment solution variables, needed by the single well model 68*a*1, at the end of each iteration, to be discussed below.

Figure 27:
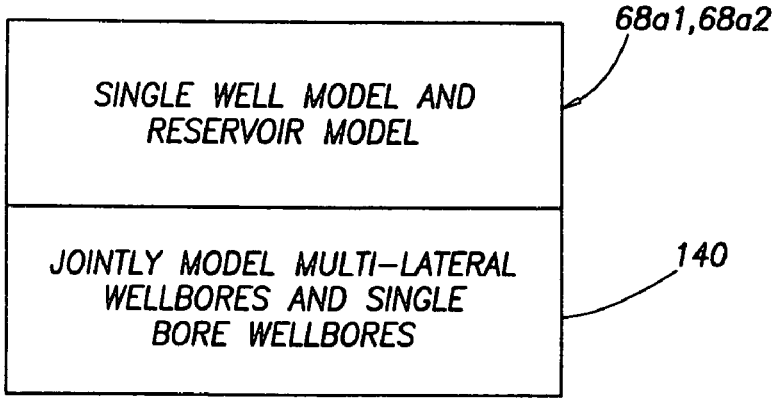
Figure 28:
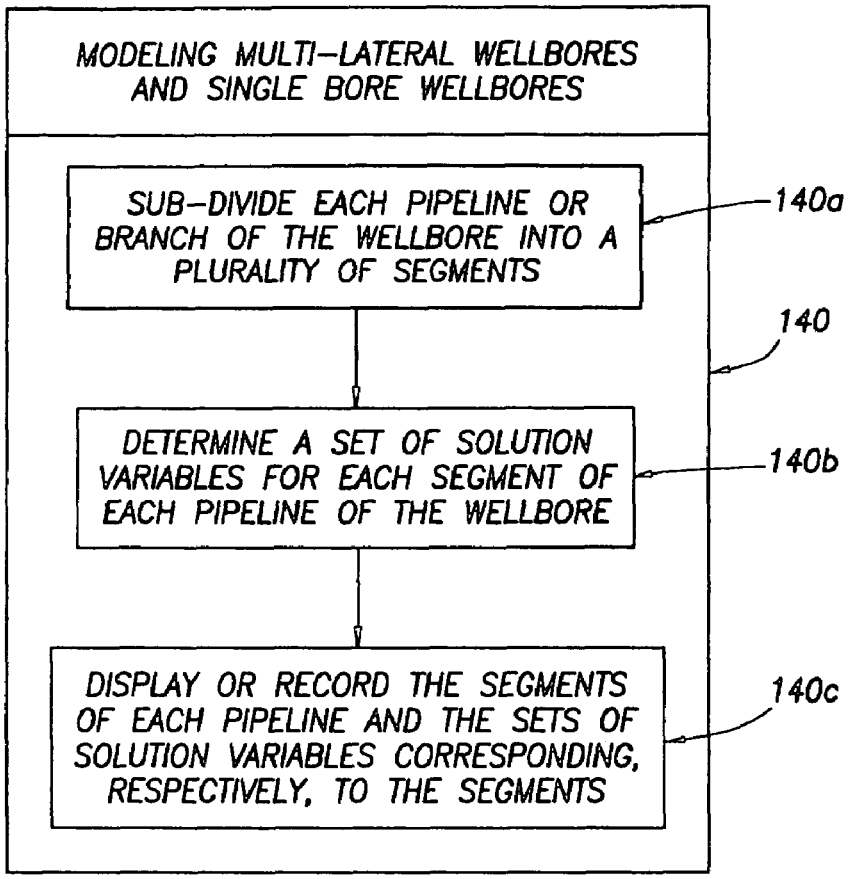

In FIG. 26, the single well model 68*a*1 interacts with the reservoir model 68*a*2 because the reservoir grid blocks act as boundary conditions to the well model single well model. From the reservoir model's point of view, the single well model 68*a*1 acts as a source of a set of "source/sink" terms used by the reservoir model. The single well model 68*a*1 therefore interacts with the reservoir model 68*a*2 and extracts fluid from it, or injects fluid into it, and the Group/Field control model 68*b* interacts with the single well model 68*a*1 in that it decides how to allocate field targets, and gives each single well an operating target.

in FIGS. 27 and 28, referring initially to FIG. 27, the single well model software 68*a*1 functions to model a multilateral wellbore and a single bore wellbore, block 140 of FIG. 27. In FIG. 28, however, the step of modeling multilateral wellbores and single bore wellbores (block 140 of FIG. 27) comprises the following additional steps: (1) sub-divide each pipeline or branch of the wellbore into a plurality of segments, block 140*a*, (2) determine a set of solution variables (Q, Fw, Fg, P) for each segment of each pipeline of the wellbore, block 140*b*, and (3) display and/or record the plurality of segments of each pipeline and plurality of solution variables (Q, Fw, Fg, P) which correspond, respectively, to the plurality of segments, block 140*c*.

The step of sub-dividing each pipeline or branch of the wellbore into a plurality of segments (block 140*a*) was discussed briefly above with reference to FIG. 24. However, the step of determining a set of solution variables (Q, Fw, Fg, P) for each segment of each pipeline of the wellbore (block 140*b*) is practiced by both the single well model 68*a*1 and the reservoir model 68*a*2 and it will be discussed in detail below with reference to FIGS. 29 through 33.

In FIGS. 29 through 33, a more detailed discussion of block 140*b* of FIG. 28, which determines a set of solution variables (Q, Fw, Fg, P) for each segment of each pipeline of a multilateral or single bore wellbore, is set forth in the following paragraphs with reference to FIGS. 29 through 33 of the drawings.

Figure 29:
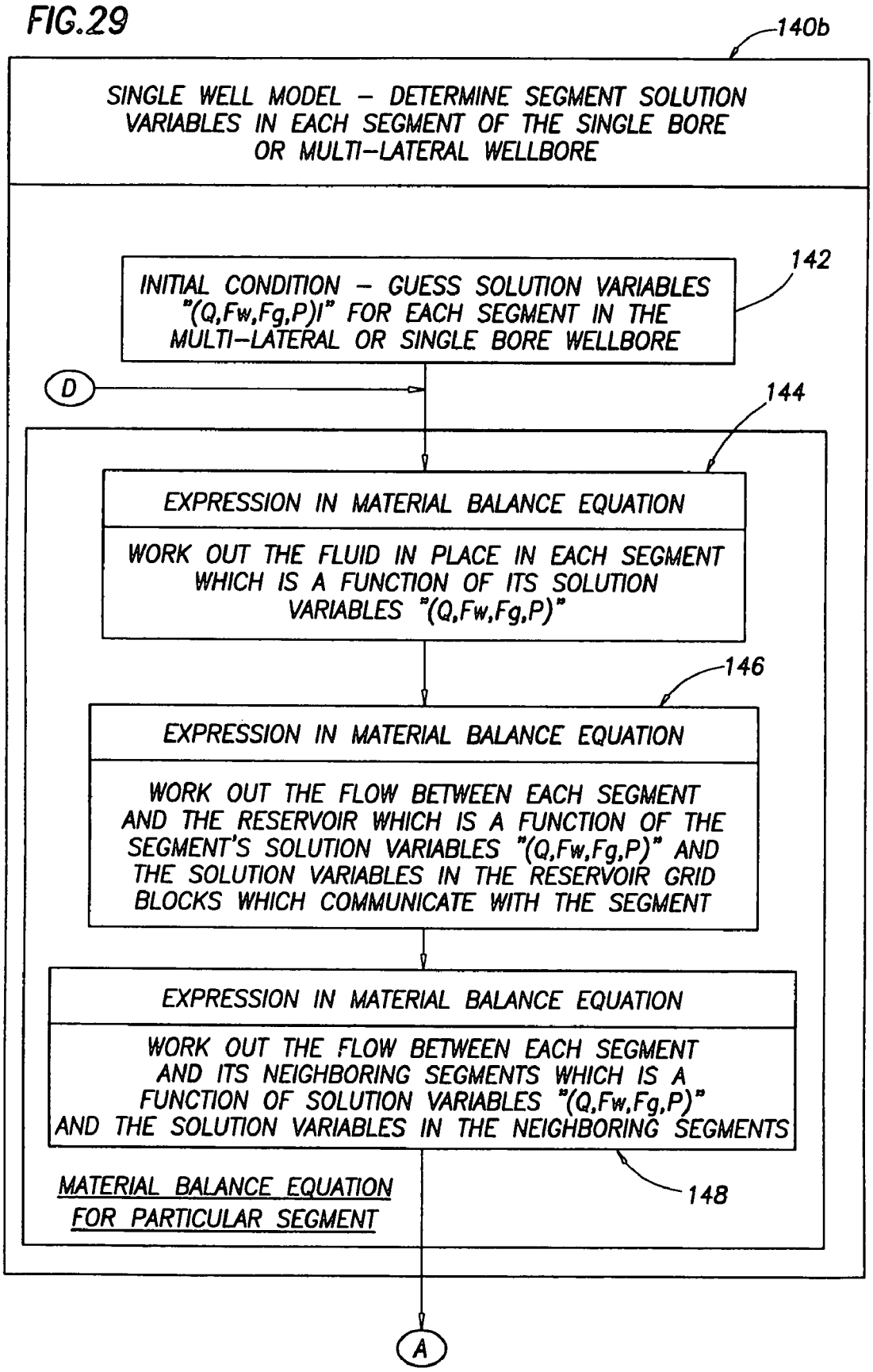
Figure 30:
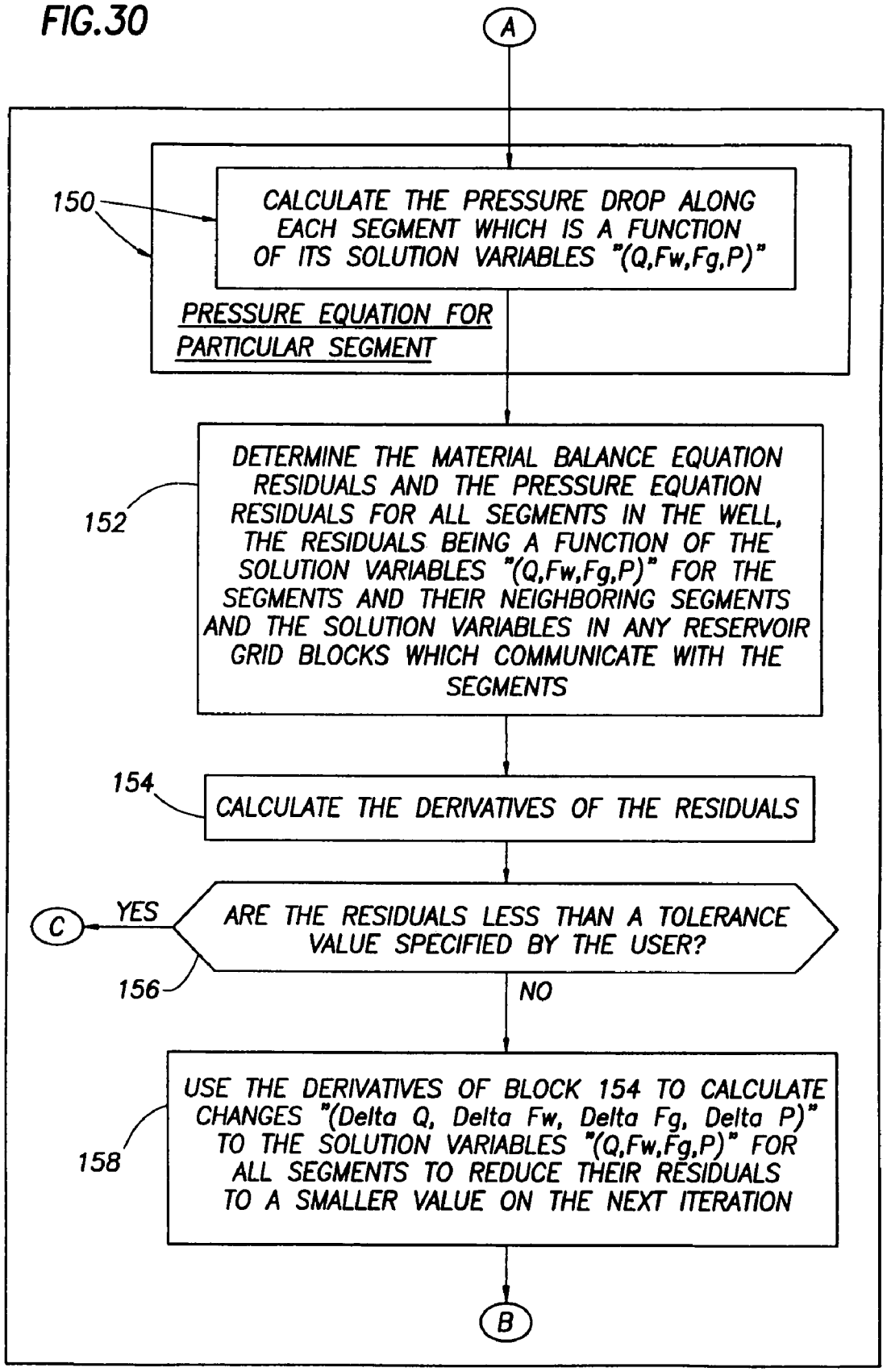
Figure 31:
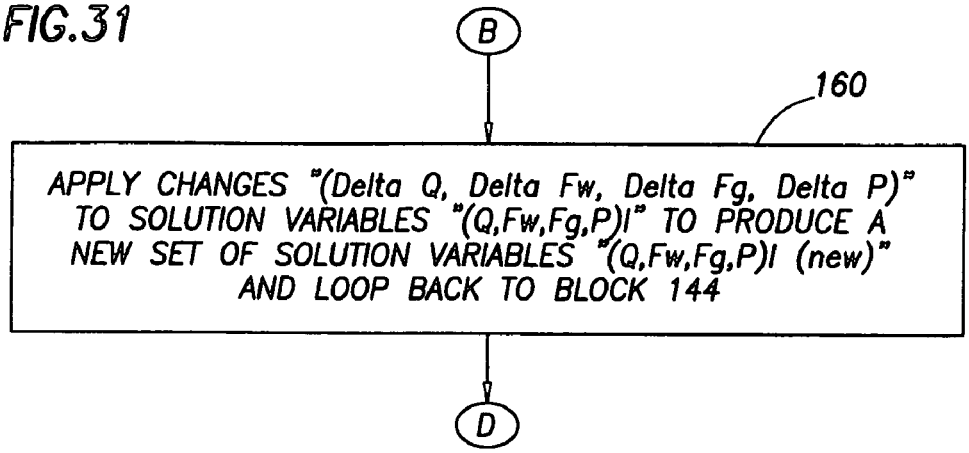
Figure 32:
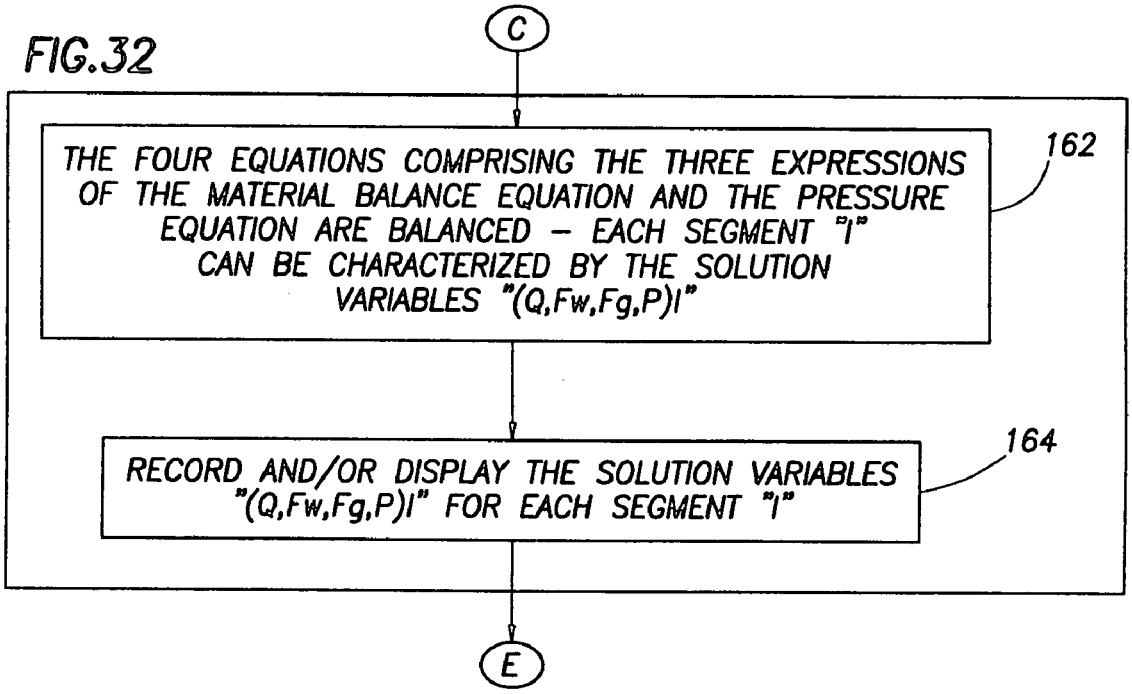
Figure 33:
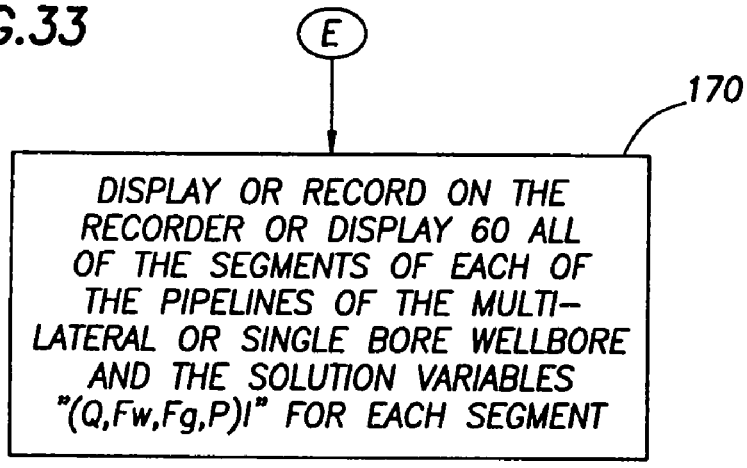

In FIGS. 29, 30, 31, 32, and 33, referring intially to FIG. 29, in order to determine a set of solution variables (Q, Fw, Fg, P) for each segment of each pipeline of the wellbore (block 140*b* of FIG. 28), the following steps are performed by the single well model software 68*a*1 of FIG. 26: (1) initial condition—guess solution variables "(Q, Fw, Fg, P)i" for each segment in the multi-lateral or single bore wellbore, block 142 in FIG. 29; (2) work out the fluid in place in each segment which is a function of its solution variables "(Q, Fw, Fg, P)i", block 144 in FIG. 29; (3) work out the flow between each segment and the reservoir which is a function of the segment's solution variables "(Q, Fw, Fg, P)i" and the solution variables in the reservoir grid blocks which communicate with the segment, block 146 in FIG. 29, (4) work out the flow between each segment and its neighboring segments which is a function of its solution variables "(Q, Fw, Fg, P)i" and the solution variables in the neighboring segments, block 148 in FIG. 29. In FIG. 30, (5) calculate the pressure drop along each segment which is a function of its solution variables "(Q, Fw, Fg, P)i", block 150 in FIG. 30; (6) since blocks 144, 146 and 148 in FIG. 29 represent three expressions in a Material Balance Equation for each segment, and since block 150 in FIG. 30 represents a Pressure Equation for each segment, determine the Material Balance Equation residuals and the Pressure Equation residuals for all segments in the well, the residuals being a function of the solution variables "(Q, Fw, Fg, P)i" for the segments and their neighboring segments and the solution variables in any reservoir grid blocks which communicate with the segments, block 152 of FIG. 30; (7) calculate the derivatives of the residuals, block 154 of FIG. 30; (8) ask the question "are the 'residuals' less than a tolerance value specified by the user?", block 156 of FIG. 30—if no, go to step "9" below—if yes, go to step "11" below; (9) since "no" was the answer to the question of block 156 of FIG. 30, use the derivatives of block 154 to calculate changes (delta Q, delta Fw, delta Fg, delta P) to the solution variables (Q, Fw, Fg, P) for all segments to reduce their residuals to a smaller value on the next iteration, block 158 of FIG. 30; (10) in FIG. 31, apply the changes (delta Q, delta Fw, delta Fg, delta P) to the solution variables (Q, Fw, Fg, P) of all segments to produce a new set of solution variables "(Q, Fw, Fg, P)i (new)" and go back to step "2" which is block 144 of FIG. 29, block 160 of FIG. 31; (1) since "yes" was the answer to block 156 of FIG. 30, in FIG. 32, the "four equations" comprising the three expressions of the material balance equation (blocks 144, 146, 148 of FIG. 29) and the pressure equation (block 150 of FIG. 30) are balanced—each segment "i" can be characterized by the solution variables "(Q, Fw, Fg, P)i"; block 162 of FIG. 32; (12) record and/or display the solution variables "(Q, Fw, Fg, P)i" for each segment "i", block 164 of FIG. 32. In FIG. 33, display or record on "recorder or display or 3D viewer" 60 of FIG. 12 all of the segments of each of the pipelines of the multilateral or single bore wellbore and the solution variables "(Q, Fw, Fg, P)" for each segment, block 140*c* of FIG. 28 and block 170 of FIG. 33.

Figure 34:
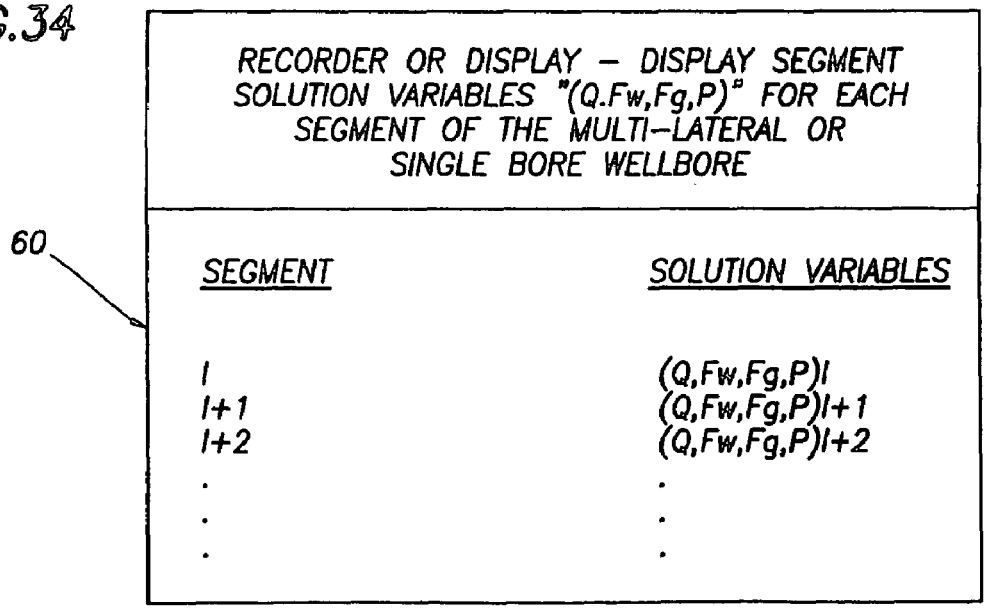

Referring to FIG. 34, when block 170 of FIG. 33 has completed its execution, all of the segments of each of the pipelines of the multilateral or single bore wellbore and the solution variables "(Q, Fw, Fg, P)" for each segment will be displayed on the "recorder or display or 3D viewer" 60 of FIG. 12. A typical example of that display is illustrated in FIG. 34. As a result, at this point, the multilateral wellbore of FIG. 24 will have been modeled by the multi-segment well model software 68*a* of FIGS. 12 and 25.

Run the simulator using the fluxes/Pressure values at the boundary and the fine scale grid within the boundary to obtain fluxes (flowrates) inside the boundary and examine the results of the simulation, block 101

Referring to FIG. 39, the earth formation inside the boundary 110 adjacent the multi-segmented wellbore 118 has been "fine gridded" by gridding the formation with an "un-structured" grid comprised of a plurality of tetrahedrally shaped grid cells 122. However, in order to mimic the remaining parts of the reservoir field 106 which are located outside the boundary 110, block 88 of FIG. 17 (which indicates "run simulator to obtain fluxes . . . or pressure values at the boundary") was executed for the purpose of determining the fluxes/pressure values 112 at the boundary 110, block 186 of FIG. 39. Consequently, since we now know the fluxes/pressure values 112 at the boundary 110, that part of the reservoir field 106 of FIG. 39 which is located outside the boundary 110 will not be simulated by the Eclipse simulator software 68 of FIG. 12 because that part located outside the boundary 110 is being mimicked. In addition, since we have fine gridded (with tetrahedrally shaped grid cells 122) the earth formation located inside the boundary 110 and adjacent the multisegmented wellbore 118 in FIG. 39, more time will be spent, by the Eclipse simulator software 69 of FIG. 12, simulating the earth formation located "inside" the boundary 110 and thereby determining the flow of fluids "inside" the boundary 110 in FIG. 39. Consequently, when block 101 of FIG. 18 (which reads "run the simulator . . . to obtain fluxes inside the boundary") is executed, the Eclipse simulator software 68 of FIG. 12 will again be executed but, this time, during such execution, the fluxes/flowrates 188 of fluids flowing "inside" the boundary 110 (i.e., the fluxes/flowrates 188 of fluids flowing into the tetrahedrally shaped grid cells as illustrated in FIG. 39) will be determined, block 190 of FIG. 39. For example, in FIG. 39, note element numeral 188, which represents the fluxes/flowrates 188 of fluids flowing into the tetrahedrally shaped grid cells. During the execution of block 101 of FIG. 18, these fluxes/flowrates 188 will be determined.

Figure 40:
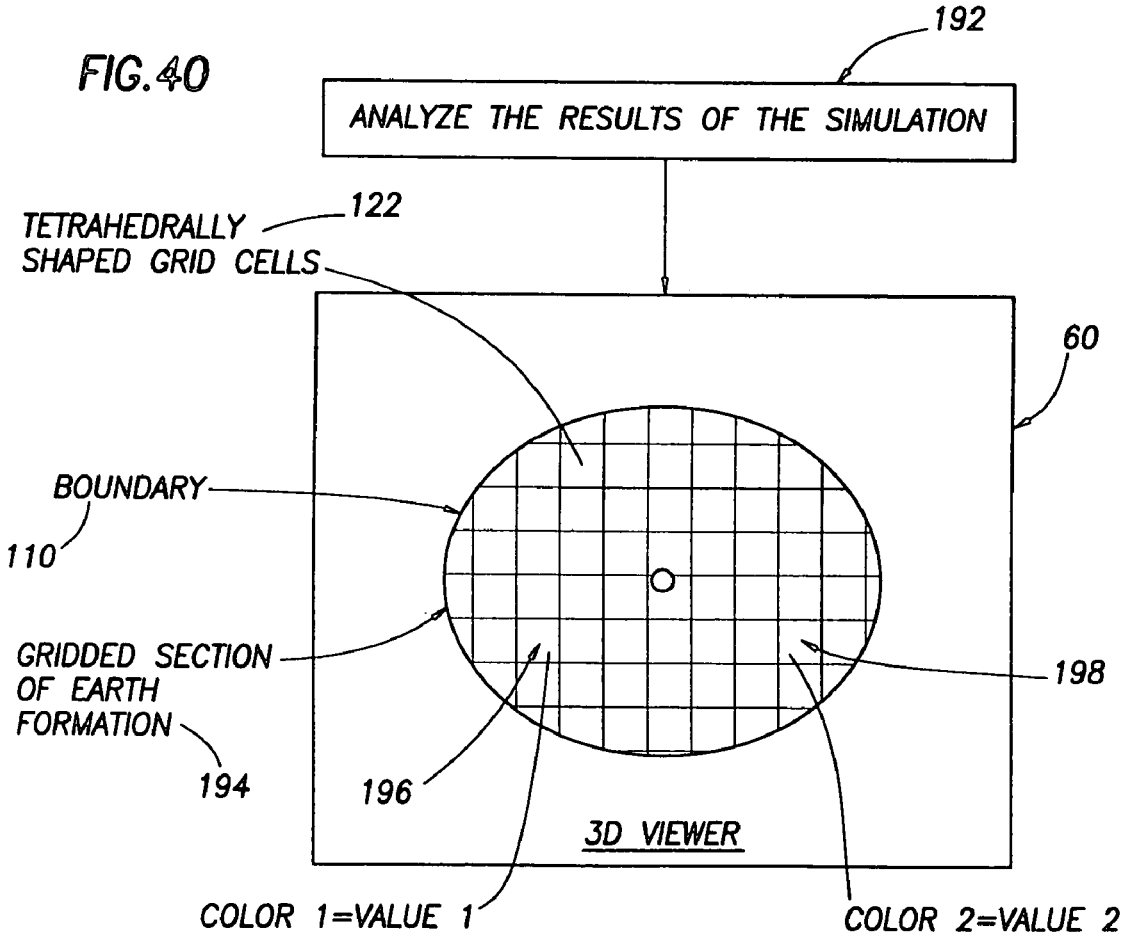

Referring to FIG. 40, the user/operator at workstation 50 of FIG. 13 will now "analyze the results of the simulation" by viewing and analyzing the results shown on the "recorder or display or 3D viewer" 60 of FIG. 12, block 192 of FIG. 40. To reiterate, in FIG. 39, the "volume of interest" located inside the boundary 110 of FIG. 39 has been "fine gridded" with a plurality of tetrahedrally shaped "un-structured" grid cells (and with a plurality of cylindrically shaped "structured" grid cells about the perforated sections of the wellbore), each cell having 'properties' assigned thereto, such as transmissibility, porosity, permeability, etc. The remaining parts of the reservoir field 106 located outside the boundary 110 are not be simulated, since those remaining parts are being mimicked by the flux/pressure values 112 which have been determined (in block 88 of FIG. 17) at the boundary 110. In addition, in FIG. 39, the fluxes/flowrates 188 of fluid flowing into and through each of the individual tetrahedrally shaped grid cells 122 have been determined. Consequently, since the earth formation located outside the boundary 110 is not being simulated, the earth formation located inside the boundary 110 is being modeled in detail, and the results of that modeling is illustrated in FIG. 40 that is, the results are visible on the "recorder or display or 3D viewer" 60 of FIG. 12 and are shown in detail in FIG. 40.

In FIG. 40, a gridded section of earth formation 194 is being displayed on a 3D viewer 60, such as the recorder or display or 3D viewer 60 of FIG. 12. The gridded section of earth formation 194 being displayed on the 3D viewer 60 includes a plurality of tetrahedrally shaped grid cells 122 bounded on all sides by the boundary 110. Certain 'properties' are associated with each grid cell 122 in FIG. 40, such properties including, for example, transmissibility or permeability or porosity or pore volume. These properties have certain 'values', and a color is assigned to each 'value'. For example, in FIG. 40, a 'color 1=value 1', the 'color 1' being associated with grid cell 196; and a 'color 2=value 2', the 'color 2' being associated with grid cell 198. Bear in mind, however, that the results being displayed on the 3D viewer 60 in FIG. 40 reflect the results of the simulation by the Eclipse simulator 68 of FIG. 12 when (as shown in FIG. 39) the earth formation located outside the boundary 110 is not being simulated (recall that the fluxes/pressure values 112 mimic the formation outside the boundary 110); however, the tetrahedrally gridded earth formation located inside the boundary 110 is being simulated.

Figure 53:
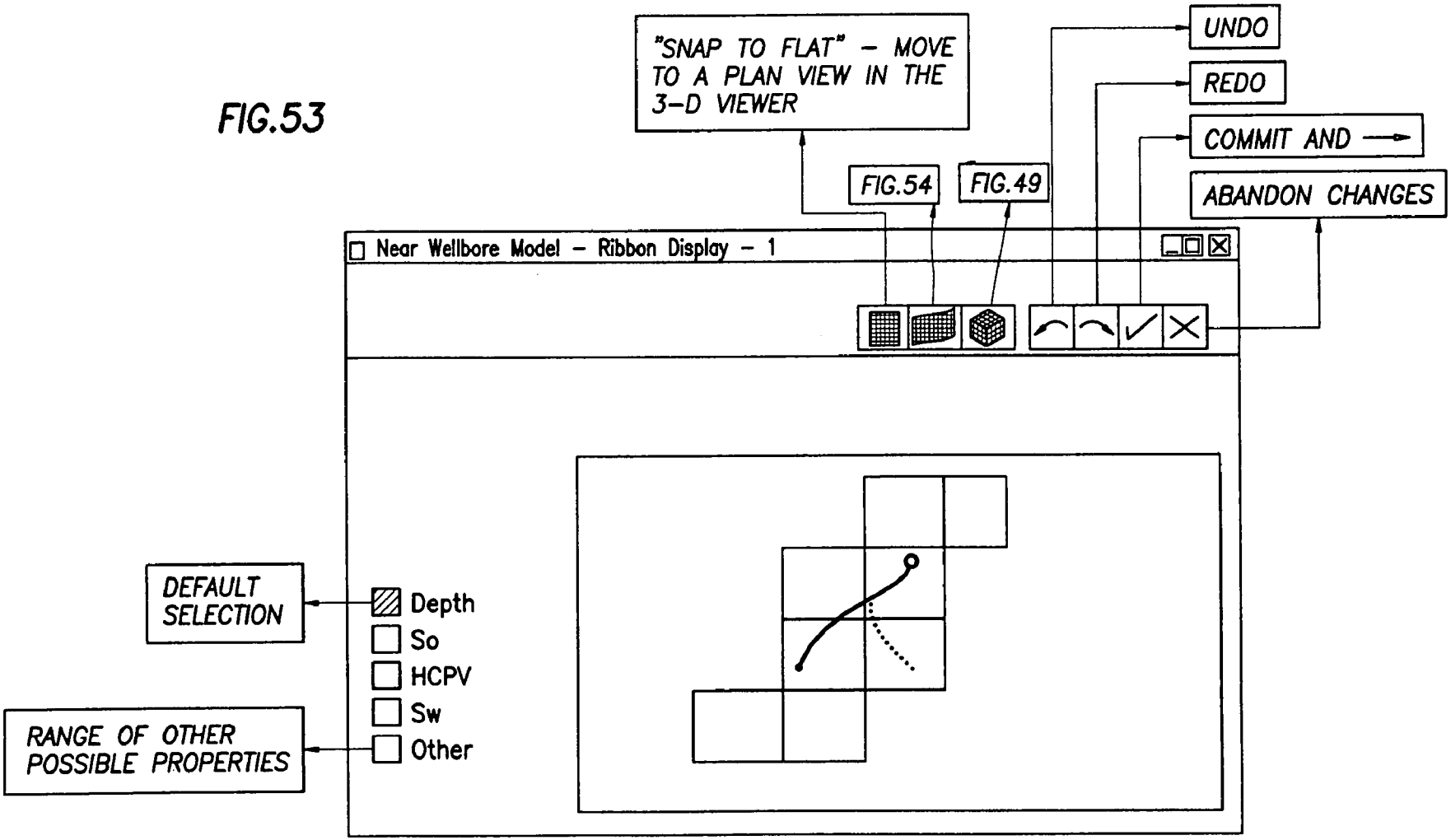
Figure 54:
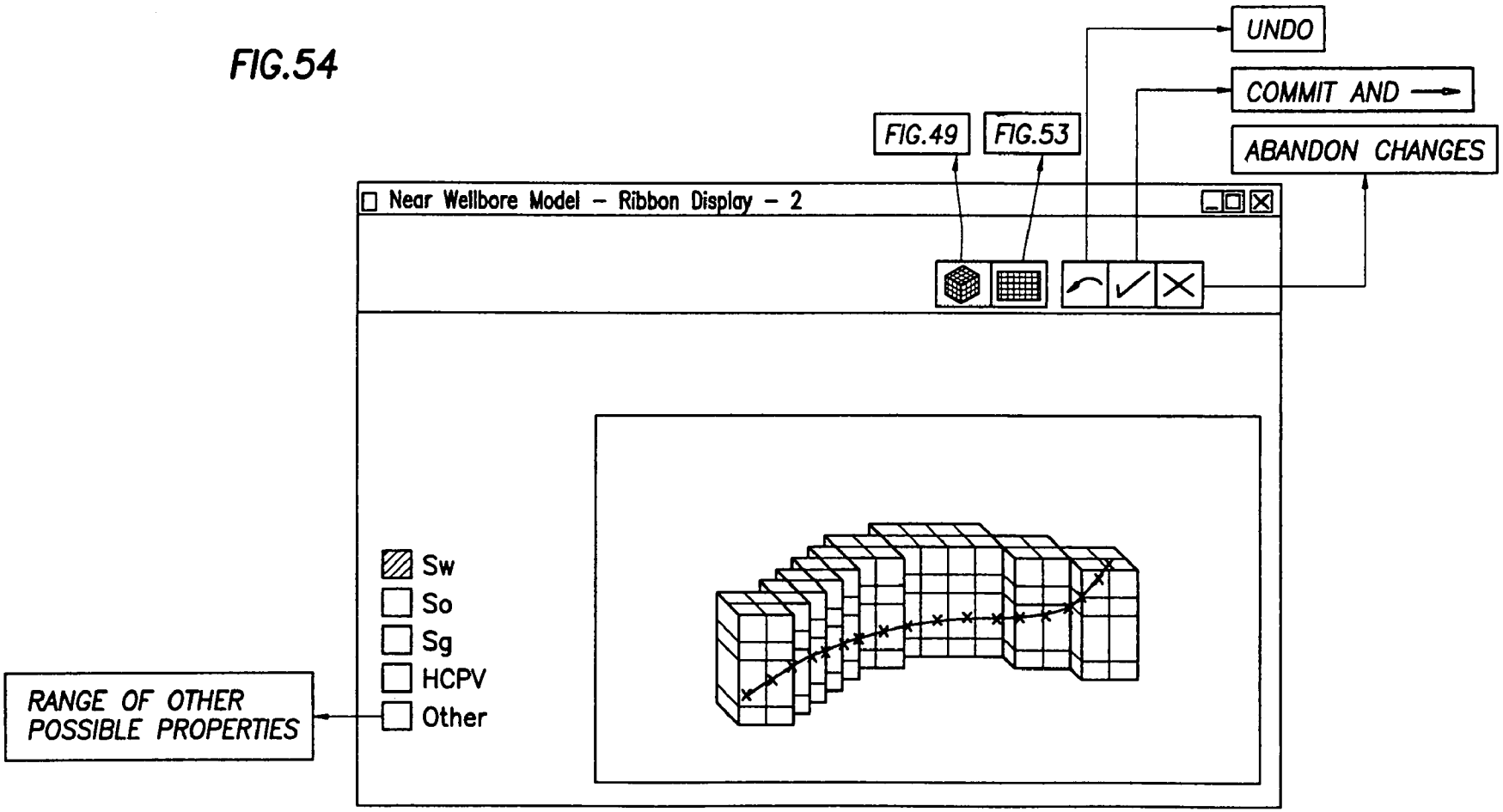

FIGS. 53 and 54, which will be discussed in more detail below, illustrate certain "ribbon displays" which represent a more sophisticated and real-life example of the display of FIG. 40.

Referring to FIG. 41, when analyzing the results of the simulation (block 192 of FIG. 40), the user/operator at workstation 50 will review the results of the simulation displayed on the 3D viewer 60 of FIG. 40. However, in addition, in FIG. 41, the user/operator at workstation 50 will also look at the four solution variables for each segment of the multi-segment wellbore 118 as output by the 'multi-segment well model', block 200 of FIG. 41.

In FIGS. 12 and 34, the multi-segmented well model software 68*a* of FIG. 12, when executed, generated the plurality of solution variables "(Q, Fw, Fg, P)i" of FIG. 34 corresponding, respectively, to the plurality of segments 130 through 136 (of FIG. 23) of the multi-segmented wellbore 118.

The user/operator at the workstation 50 will now review and analyze the plurality of solution variables (Q, Fw, Fg, P)i associated, respectively, with the plurality of segments of the multi-segmented wellbore 118. Note that the four solution variables for each segment include the pressure "P" in that segment.

In FIG. 41, for example, the operator of the workstation 50 will review and analyze the pressure "P" (e.g., P1 through P4) inside each of the segments (e.g., segment 1 through segment 4) of the multi-segmented wellbore 118.

Re-integration—regrid the volume of interest inside the boundary such that the volume of interest includes fewer grid cells of a coarser unstructured grid, impose a structured grid outside the boundary, and simulate the entire reservoir field, block 102 of FIG. 18.

Referring to FIGS. 41*a* and 41*b*, referring initially to FIG. 41*a*, "fine scale tetrahedrally shaped unstructured grid cells grid the earth formation located inside the boundary 110", block 202 of FIG. 41*a*. When the "fine scale" grid 202 of FIG. 41*a* is established, the Eclipse simulator software 68 of FIG. 12 runs a simulation on only that part of the earth formation which is located inside the boundary 110 (fluxes/pressure values 112 mimic that part of the reservoir field 106 which is located outside the boundary 110).

In FIG. 41*a*, assume now that we are happy with the results of that simulation (which simulated only that part of the formation located inside the boundary 110 of the reservoir field 106), which results are illustrated in FIGS. 40 and 41 (and by the ribbon displays of FIGS. 53 and 54). Assume, further, that we now want to simulate the entire reservoir field 106 of FIG. 41*a*, and not merely the formation located inside the boundary 110.

If the Eclipse simulator software 68 simulates the entire reservoir field 106 of FIG. 41*a* when the formation inside the boundary 110 is simultaneously "fine scale" gridded with the tetrahedrally shaped grid cells of the unstructured grid of FIG. 41*a* (and with the cylindrically shaped grid cells of the structured grid about the perforated sections of the wellbore), the presence of that "fine scale" grid will slow down the simulation.

In FIG. 41*b*, in order to simulate the entire reservoir field 106 without slowing down the simulation, it is necessary to decrease the number of grid cells of the "fine scale grid" inside the boundary 110 of FIG. 41*a*. Accordingly, in FIG. 41*b*, when the number of grid cells of the unstructured grid (and the structured grid) located inside the boundary 110 is reduced, the "fewer grid cells in FIG. 41*b* make the grid inside the boundary 110 of FIG. 41*b* much 'coarser' than the grid of FIG. 41*a*", block 204 of FIG. 41*b*. As a result of this 'coarser' unstructured grid located inside the boundary 110 of FIG. 41*b*, the simulation practiced by the Eclipse simulator 68 of FIG. 12 when simulating the entire reservoir field 106 of FIG. 41*b* is much faster than the simulation practiced by the Eclipse simulator 68 when simulating the entire reservoir field 106 in FIG. 41*a*.

Figure 42:
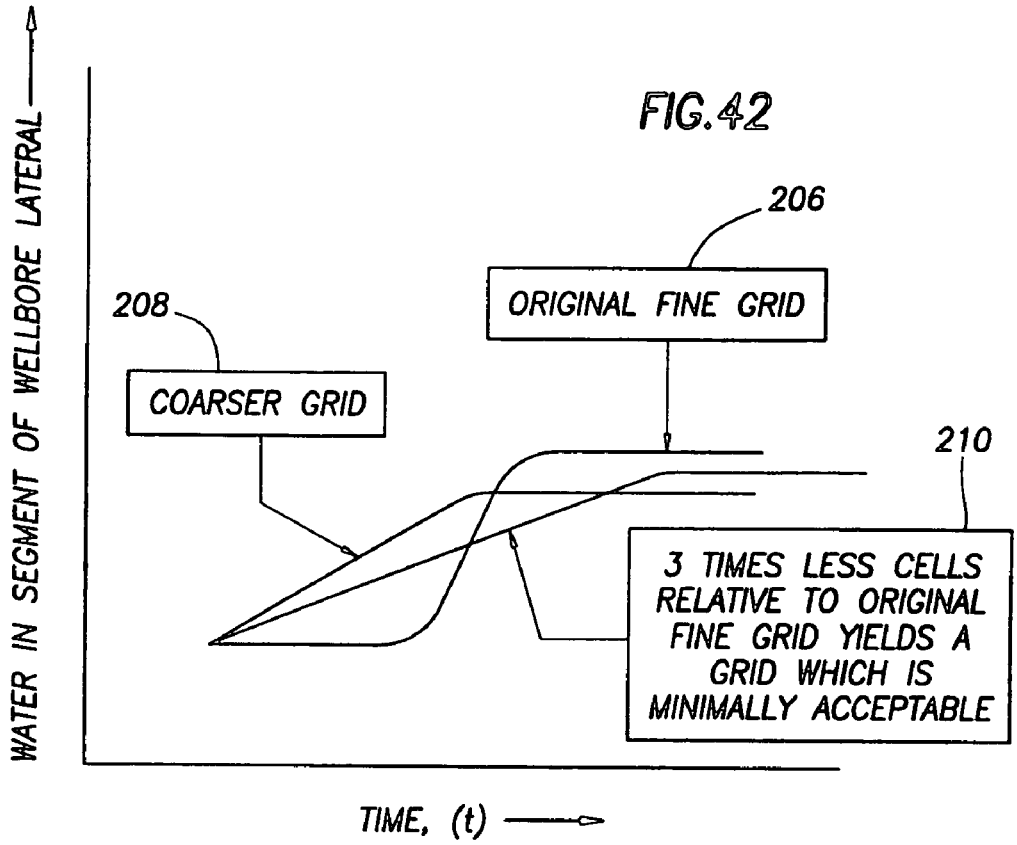

To what extent should the unstructured grid 204 of FIG. 41*b* be made "coarse" (for the purpose of simulating the entire reservoir field 106 of FIG. 41*b*) without simultaneously and unacceptably reducing the accuracy of the simulation results generated by the Eclipse simulator 68 of FIG. 12 when the entire reservoir field 106 of FIG. 41*b* is being simulated? That is, how many tetrahedrally shaped and cylindrically shaped grid cells 202 inside the boundary 110 of FIG. 41*a* should be eliminated for the purpose of producing the coarser grid 204 of FIG. 41*b* without also simultaneously and unacceptably reducing the accuracy of the simulation results generated by the simulator 68 when the entire reservoir field 106 of FIG. 41*b* is being simulated? The answer to that question is illustrated in FIG. 42.

Referring to FIG. 42, a graph is illustrated, the graph representing water in a segment of wellbore lateral versus time. Block 206 in FIG. 42 reflects the original "fine scale" grid of FIG. 41*a*. Block 208 in FIG. 42 reflects a much "coarser" grid of FIG. 41*b*. However, in order to reduce the number of grid cells 202 inside the boundary 110 of FIG. 41*a* without unacceptably and simultaneously reducing the accuracy of the simulation results generated by the simulator 68 when the entire reservoir field 106 is simulated, block 210 of FIG. 42 reflects the minimally acceptable "coarser" grid. Bear in mind, however, that the factor "3" in block 210 of FIG. 42 may or may not result in a minimally acceptable coarser grid. The "factor" of block 210 of FIG. 42 is determined as follows: the process of 'coarsening' may be repeated until any further reduction in the number of grid cells inside the boundary 110 would result in a "feature" (which is deemed essential by the user and which was exhibited by the fine scale near wellbore model) being lost.

In FIG. 42, as noted in block 210, the minimally acceptable "coarser" grid of FIG. 41*b* is one which reduces the number of grid cells inside the boundary 110 of FIG. 41*a* by a "factor" (which could be, for example, "3") until any further reduction in the number of grid cells inside the boundary would result in a "feature" being lost. For example, if the "factor" is "3", and if the original 'fine scale' grid 202 inside the boundary 110 of FIG. 41*a* contained "X" number of tetrahedrally shaped and cylindrically shaped grid cells, the minimally acceptable number of grid cells of the "coarser" grid inside the boundary 110 of FIG. 41*b* would be "(1/3)(X)" or "[X/3]" grid cells. Bear in mind, however, that the factor by which the number of grid cells is reduced will be a user defined quantity; as a result, instead of "3", the factor could be "4" (in which case the minimally acceptable number of grid cells would be "X/4") or the factor could be 2.75 (in which case the minimally acceptable number of grid cells would be "X/2.75").

End result: generation of simulation results representing entire reservoir field; the reservoir field is gridded and properties are associated with each grid cell, block 104 of FIG. 18.

In FIG. 41*b*, following "reintegration" (block 102 of FIG. 18), when the "coarser" grid 204 is determined (i.e., when the number of tetrahedrally shaped and cylindrically shaped grid cells of the 'coarser' grid 204 is determined using the algorithm discussed above with reference to FIG. 42), the entire reservoir field 106 of FIG. 41*b* can now be simulated by the Eclipse simulator 68 of FIG. 12. When the entire reservoir field 106 is simulated by the simulator 68, the results of that simulation (called "simulation results") is reproduced on the "recorder or display or 3D viewer" 60 of FIG. 12.

Figure 43:
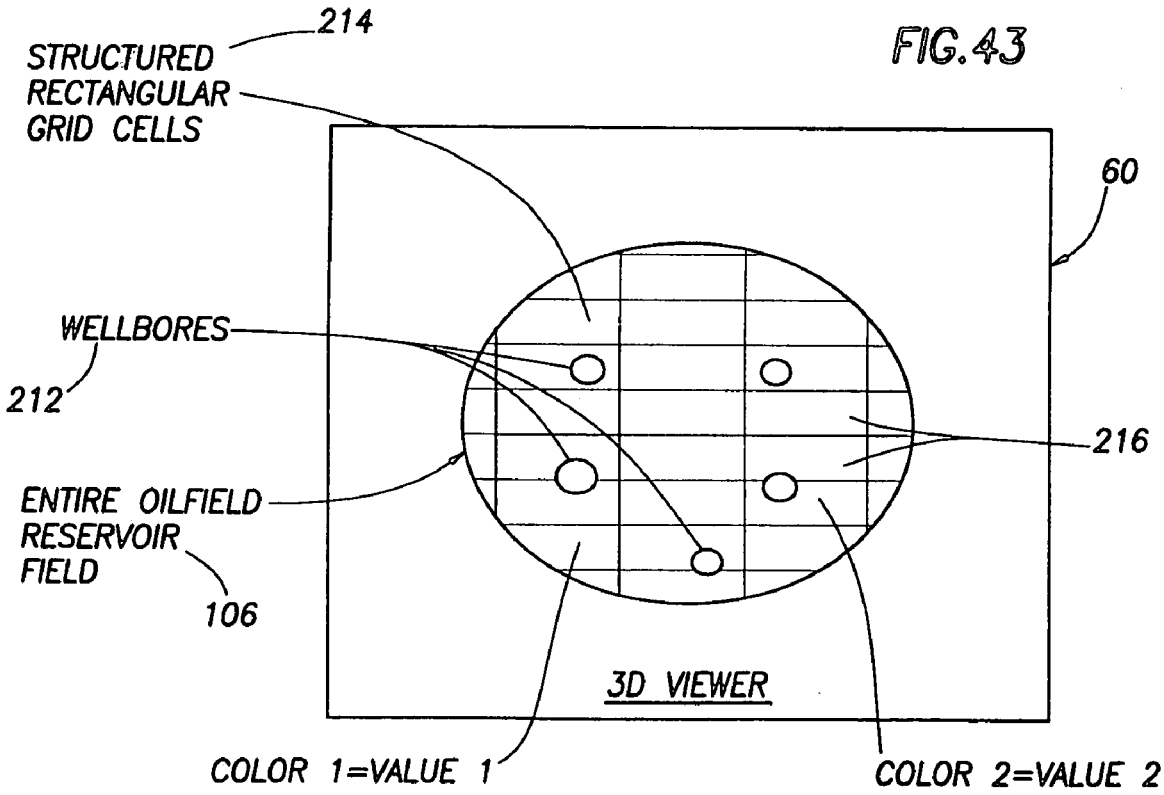

Referring to FIG. 43, an example of those "simulation results" is illustrated in FIG. 43. The entire reservoir field 106 including its wellbores 212 are displayed on the 3D viewer 60, the earth formation surrounding the wellbores 212 being gridded by a structured, rectangular grid 214. Each grid cell 216 of the structured grid 214 will have a color, where each color indicates a value of a 'property', such as transmissibility or permeability or porosity or pore volume.

Figure 44:
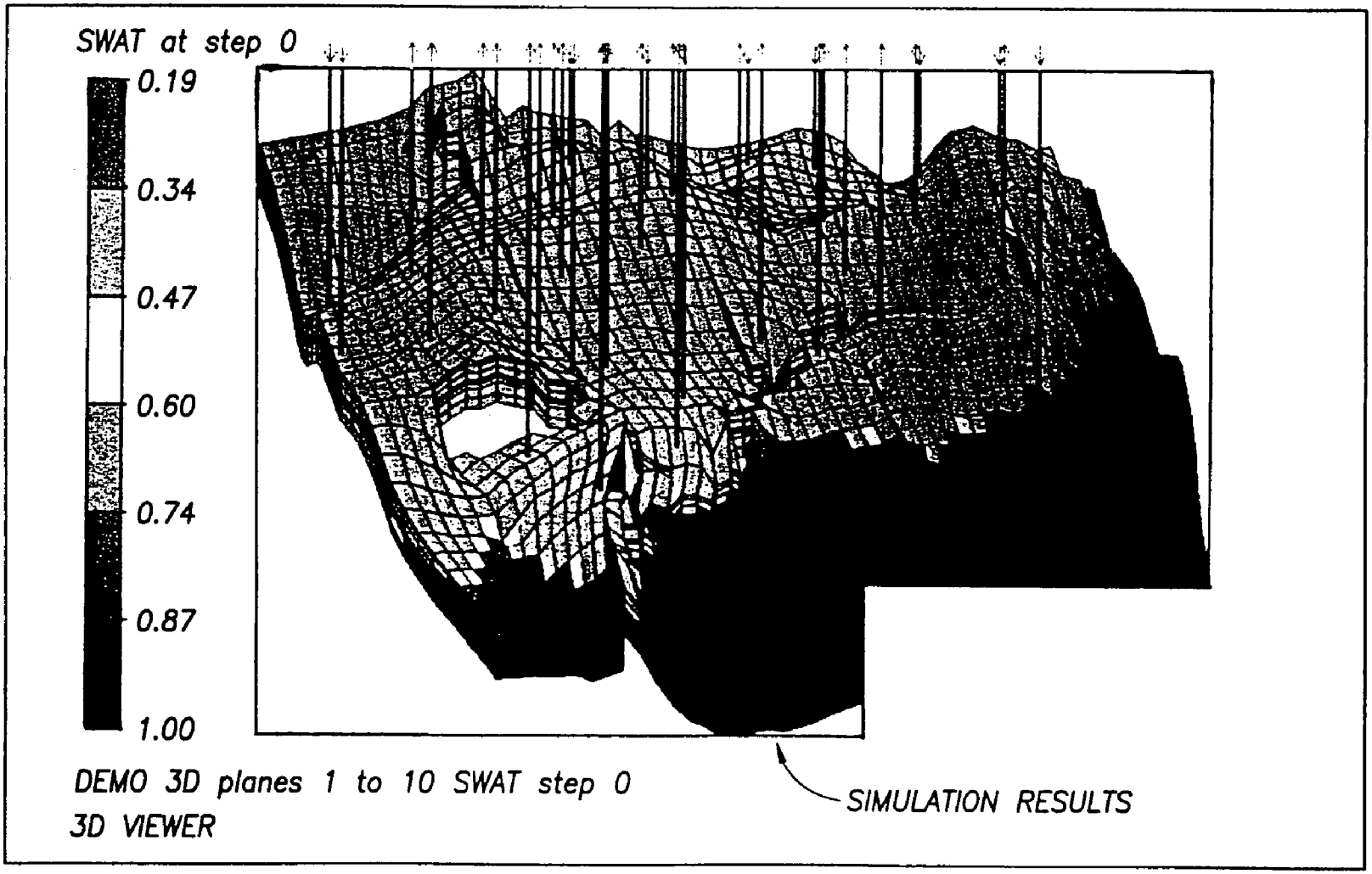

Referring to FIG. 44, a more realistic display 60 of those "simulation results" of FIG. 43 is illustrated in FIG. 44.

Figure 45:
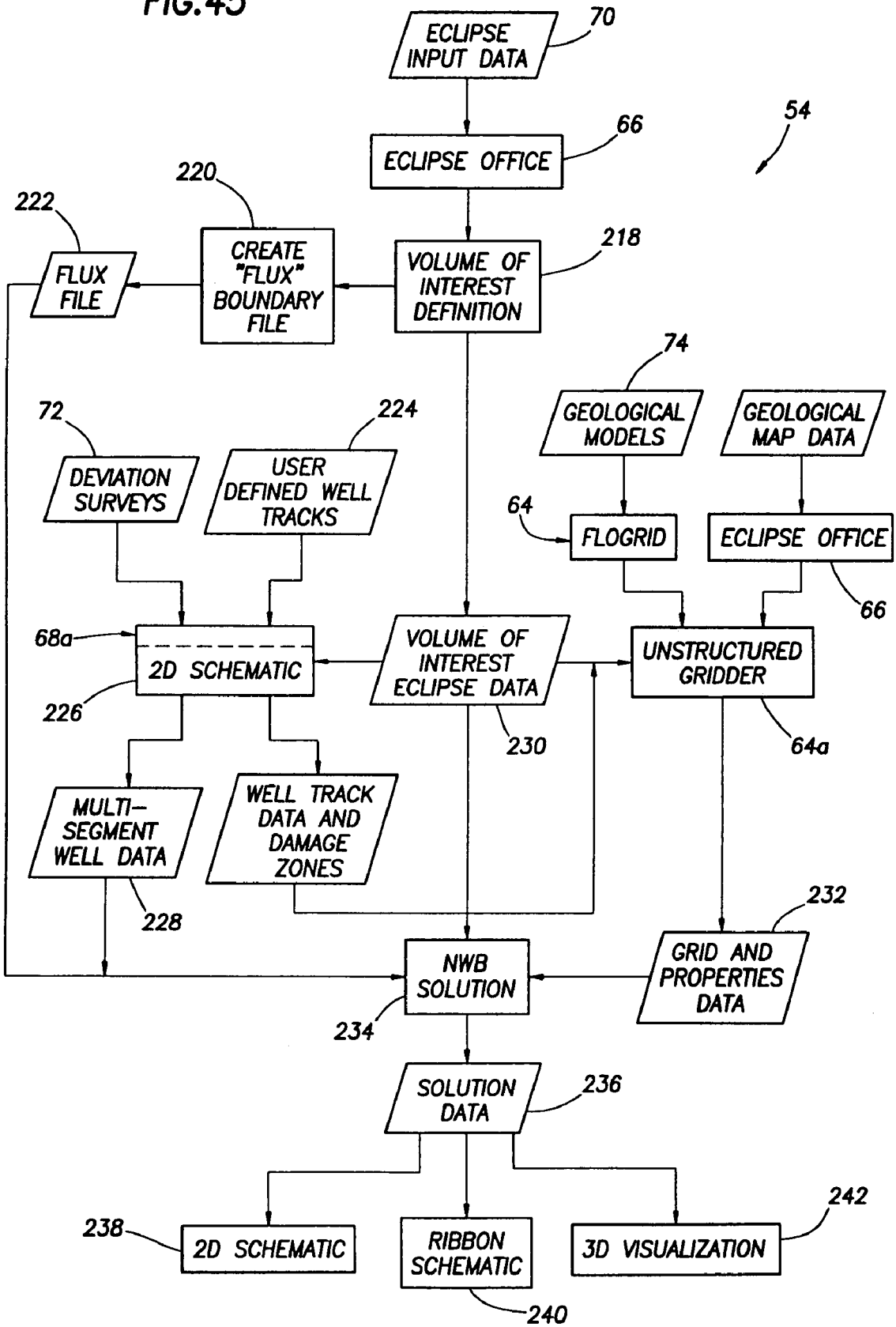
FIG. 45 illustrates a functional block diagram depicting a functional operation of the near wellbore modeling software of the present invention when the near wellbore modeling software is executed by a workstation processor.

Referring to FIG. 45, a functional block diagram of the "Near Wellbore Modeling" software 54 of the present invention is illustrated. During the discussion below with reference to FIG. 45, alternate reference will be made to some of the other FIGS. 1 through 44 of the drawings.

In FIG. 45, the Eclipse data set full field model 70 is provided as input data to the Eclipse office software 66, the Eclipse office software 66 defining a "volume of interest" 218, the "volume of interest" 218 being the area inside the boundary 110 of FIG. 21. The "create flux boundary file" 220 will create the "flux file" 222. The "flux file" 222 represents the fluxes/pressure values 112 of FIG. 21 at the boundary 110. Well deviation surveys 72 of FIG. 13 and FIG. 45 and "user defined well tracks" 224 are provided to the block 226 in FIG. 45 entitled "2D schematic", which block 226 includes the "multi segment well model" software 68*a* of FIG. 12. The multi-segment well model software 68*a* of FIG. 45 will generate the "multi segment well data" 228 which, as noted in FIG. 34, includes a plurality of segments of the wellbore 118 of FIG. 23 and a plurality of solution variables "(Q, Fw, Fg, P)i" corresponding, respectively, to the plurality of segments. The "volume of interest definition" 218 will create a "volume of interest Eclipse data file" 230 representing the boundary 110 of FIG. 21. In the meantime, in FIG. 45, the Flogrid software 64 of FIGS. 15 and 45 will generate, via the unstructured gridder 64*a* of FIGS. 15 and 45, an "unstructured grid" and "properties" associated with each tetrahedral grid cell of the "unstructured grid" by creating a "grid and properties" data file 232 in FIG. 45. The "near wellbore modeling" software 54 of FIG. 12 will perform a near wellbore modeling simulation "NWM simulation" 234 in response to the "grid and properties" data file 232, the "volume of interest Eclipse data file" 230, and the "flux file" 222. During this "NWM simulation 234, the "volume of interest Eclipse data file" 230 will generate the boundary 110 around the wellbore 118 thereby defining the 'volume of interest' of FIG. 39, the "grid and properties" data file 232 will generate the tetrahedrally shaped grid cells 122 located inside the boundary 110 of FIG. 39, and the "flux file" 222 will generate the fluxes/pressure values 112 at the boundary 110 in FIG. 39 which 'mimic' that part of the reservoir field 106 which is located outside the boundary 110 of FIG. 39. When the "NWM simulation" 234 is complete, a "solution data" file 236 is created which includes a "plurality of simulation results", that "plurality of simulation results" representing the characteristics of the earth formation located inside the boundary 110, and not outside the boundary 110, of FIG. 39. That "plurality of simulation results" is displayed to an operator of the workstation 50 of FIG. 13, via the "recorder or display" 60 of FIG. 13, in the form of three different types of displays: a 2D schematic 238, a "ribbon schematic" or "ribbon display" 240, and a 3D visualization 242.

DETAILED DESCRIPTION OF THE PREFERRED EMBODIMENT

Referring to FIGS. 46 through 64, the general features of the Near Wellbore Modeling (NWM) Tool of the present invention are set forth in the following paragraphs with reference to FIGS. 46 through 64.

Figure 46:
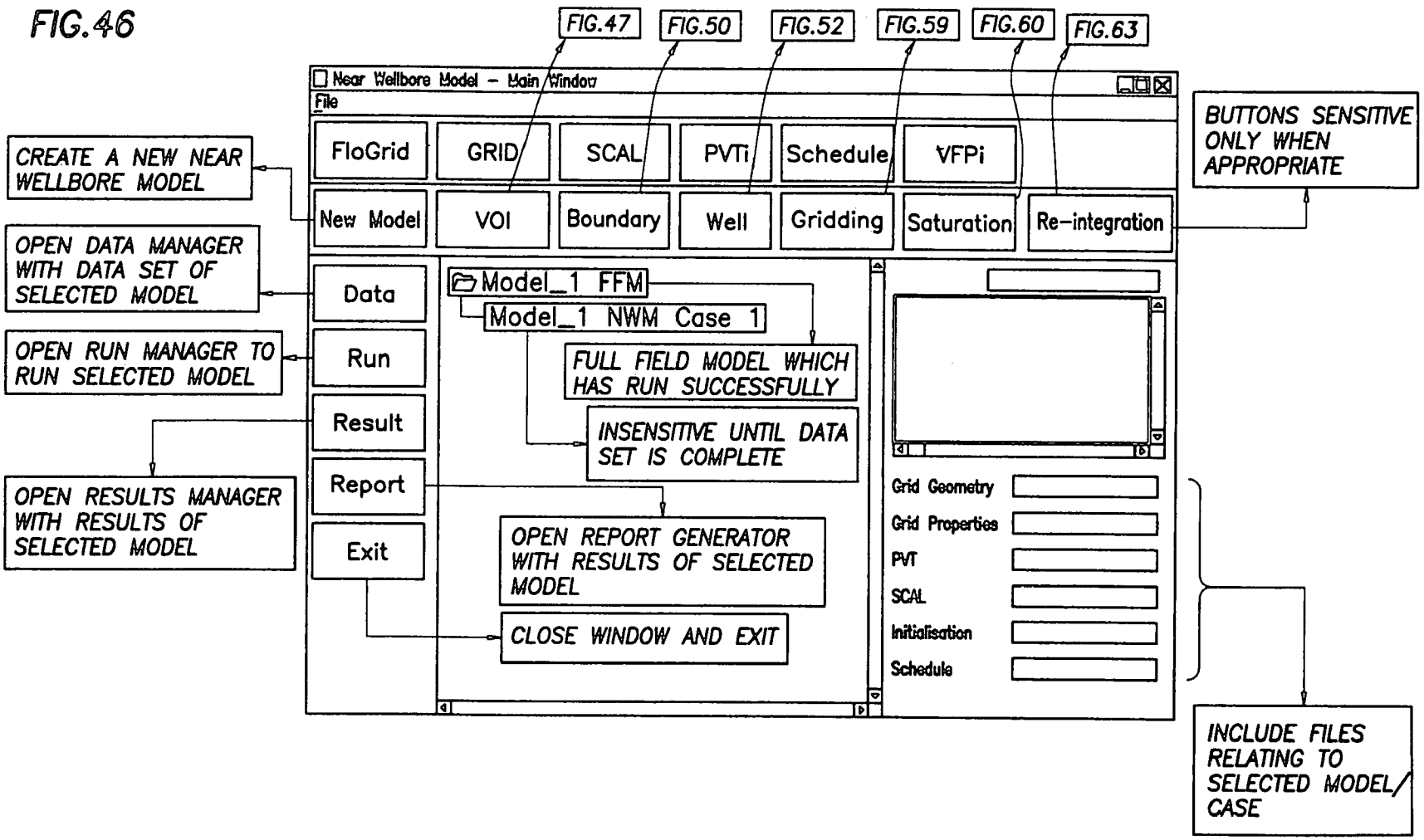

Referring to FIG. 46, the "Main Window" of the near wellbore modeling (NWM) tool of the present invention is illustrated.

In FIG. 46, the Main Window constitutes the integration focus for all of the activities involved in developing and using a Near Wellbore Model (NWM). It provides the following capabilities:

1. launcher for the NWM functions;

2. launcher for other GeoQuest Simulation applications and functionality; and 3. management of a suite of NWM data sets based on a single full field model (FFM)

Inputs

When the application is started, the Main Window is the point of entry. The user uses the File Import model option to bring in the FFM data set together with any NWM data sets for which it is the parent. This is the starting point for an NWM study. Other inputs to the Main Window are Include files associated with individual models. These are absorbed into the NWMs in the same way as in ECLIPSE Office. They can be loaded using the File Import Include file command Processing There are seven active areas in the NWM Main Window.

Area (A) includes all the buttons used to launch individual areas of NWM functionality. Clicking on the New Model button creates a new NWM as an appropriately labelled entry in the Case Manager area (B). The NWM is created as a "child" of the data set currently selected in the Case Manager area. The button is insensitive if no model is selected. At the creation stage, the new NWM inherits all of the Include files of the parent model. The remaining buttons in area (A) initiate other functions of the NWM application which are used to create, modify or interact with elements of the selected NWM. In each case, the appropriate data from the model selected in area (B) becomes available to the application when it is started up. If no model is selected, all of these buttons are insensitive. In setting up a model, the user typically progresses through the functions initiated by these buttons, from left to right. In general, each button requires that the operations initiated by the previous button should have been completed before it can be used. Each button (with the exception of the New Model button) is therefore insensitive until this condition has been met. The exception to this is the use of the VOI button and the Well button. Both of these become sensitive when a New Model has been set up. This allows either the principal well or the VOI to be set up first. When the model selected is a fully defined NWM, all of the buttons are sensitive.

Area (B) shows the hierarchy of models which make up a NWM study. Each NWM is created as a separate model: the NWM does not recognize the concept of cases. By default, each model inherits the properties of its parent data set but the default is over-written whenever data specific to the model is loaded or created.

Area (C) shows the names of the Include files which are included in the model currently selected in the Case Manager window.

Area (D) provides a launch point for the standard ECLIPSE Office utilities. The Data button opens the Data Manager with data for the model selected in the Case Manager window. The Run button opens the Run Manager to run the currently selected model. Specification for these applications is unchanged from those for ECLIPSE Office. The Results button opens the Results Viewer—3-D Viewer and so gives access to the five linked viewing applications discussed below. The Report button gives access to the Report Generator for the selected data set. The Exit button closes the Main Window and thus the application.

Area (E) provides access to the other applications of GeoQuest Simulation Software. In each case, the button serves only to start the application. There is no transfer of data into the application and no facility for automatically transferring data back to the NWM tool when the application is closed. The results of use of the application are absorbed back into a NWM by adding a reference to the Include file(s) created.

Each of the items in area (F) provides a drop down menu. Many of the options provide alternative access routes to the functionality otherwise reached through buttons and icons.

Area (G) is the Main Window title bar. Icons are provided to close the window and return to ECLIPSE Office, to re-size the window or to minimize the window.

Error Handling

There is no error handling by the Main Window. All error handling is managed by the individual applications spawned from the Main Window.

Outputs

Files

The "File Export Project" exports all of the models shown in the Case Manager window in a form which can subsequently be imported into either the NWM tool or ECLIPSE Office.

The "File Export Model" command saves a full data set for the selected model outside the NWM application.

The "File Export Model As An LGR" saves those parts of the data set, with the appropriate keywords, needed to define the model as an LGR for use in the FFM. This option is only applicable to NWMs. It saves all of the grid data, grid property data, saturation tables and saturation table numbers and completion data for the wells include within the NWM volume. PVT and scheduling data are also saved. The data are saved as a series of Include files.

The Main Window is closed by using the Exit button, the File Exit option or the X icon. All three have the same effect.

Hardcopy

There is no hardcopy output from the Main Window.

Performance

Operation of the Main Window should be subject to the following performance criteria when running on the benchmark hardware platform:

1. Selections should take no more than one second to take effect.

2. Import or export of an NWM of benchmark size should take nor more than five seconds.

3. Import or export of a FFM of benchmark size should take no more than 30 seconds.

4. Import or export of a NWM project of benchmark size should take no more than one minute.

Attributes

Maintainability

Most of the technology used in the Main Window is derived from the ECLIPSE Office integration desktop. This imposes three constraints on the NWM tool Main Window.

1. NWM tool releases must be synchronised with ECLIPSE Office releases

2. At each release, the NWM tool must use the contemporary release of ECLIPSE office 3. As far as possible, the degree of entanglement of the NWM Main Window functionality with the ECLIPSE Office functionality should be minimized.

Testability

The Main Window must satisfy the following high level test criteria.

1. Ability to import each of the test data sets individually.

2. Ability to import individual Include files.

3. Ability to export a project of benchmark complexity to ECLIPSE Office and successfully run each of the individual models.

4. Ability to export individual models and run them successfully using ECLIPSE.

5. Ability to export an LGR, incorporate it into the parent FFM and run the FFM successfully.

6. Ability to initiate each of the ECLIPSE Office utilities with data from the selected model in the Case Manager.

7. Ability to launch each of the other GeoQuest Simulation Software applications from the appropriate tool bar.

8. Ability to progress through a NWM study using the NWM application buttons.

9. Check that the appropriate Include file names are shown in area C.

FIGS. 47 through 63 illustrate a plurality of "sub-windows" which are called-up by using the "main window" of FIG. 46. FIG. 64 illustrates the "main window" of FIG. 46 in connection with all the plurality of sub-windows of FIGS. 47 through 63 which are called-up by using the "main window" of FIG. 46.

Figure 47:
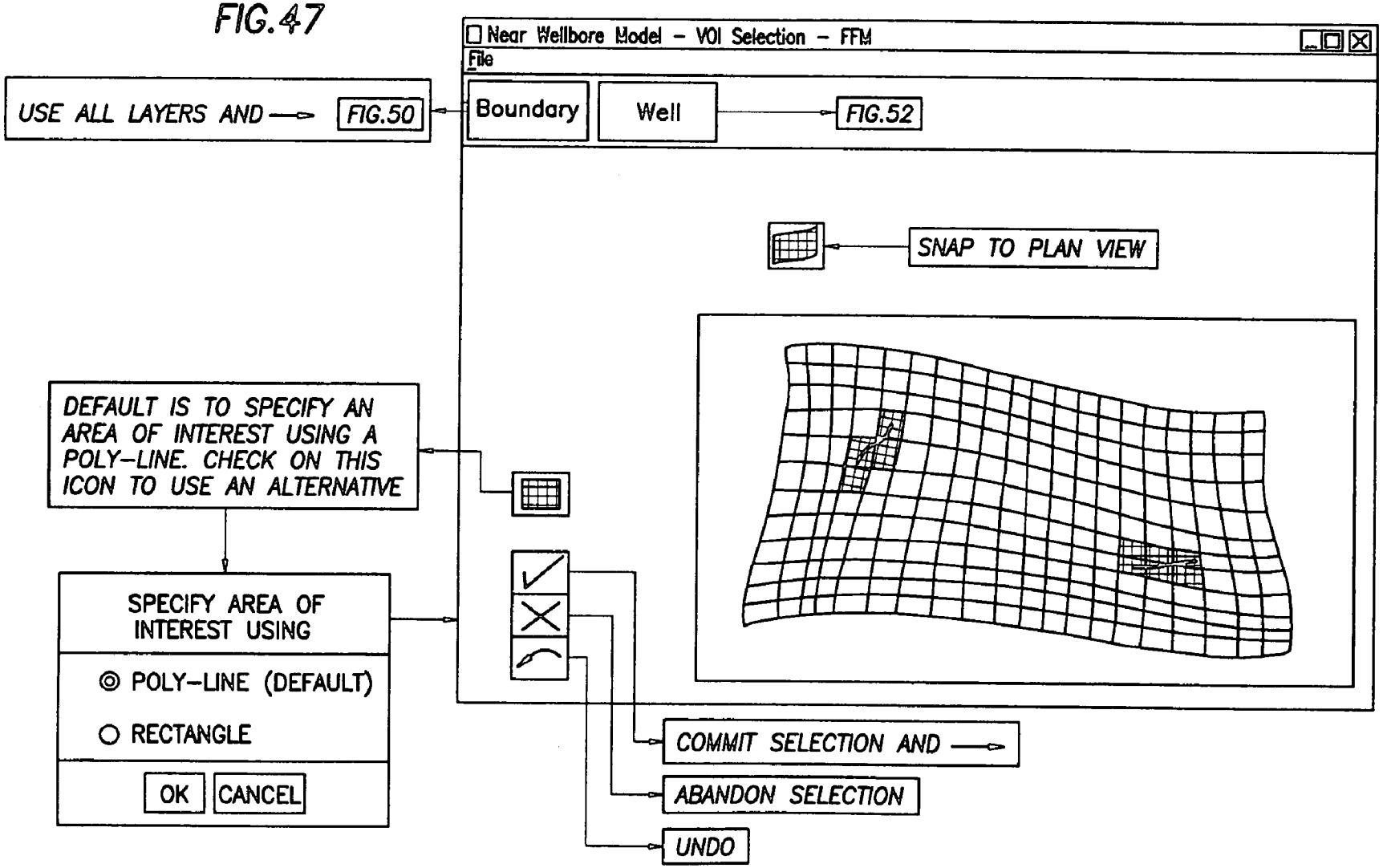
Figure 48:
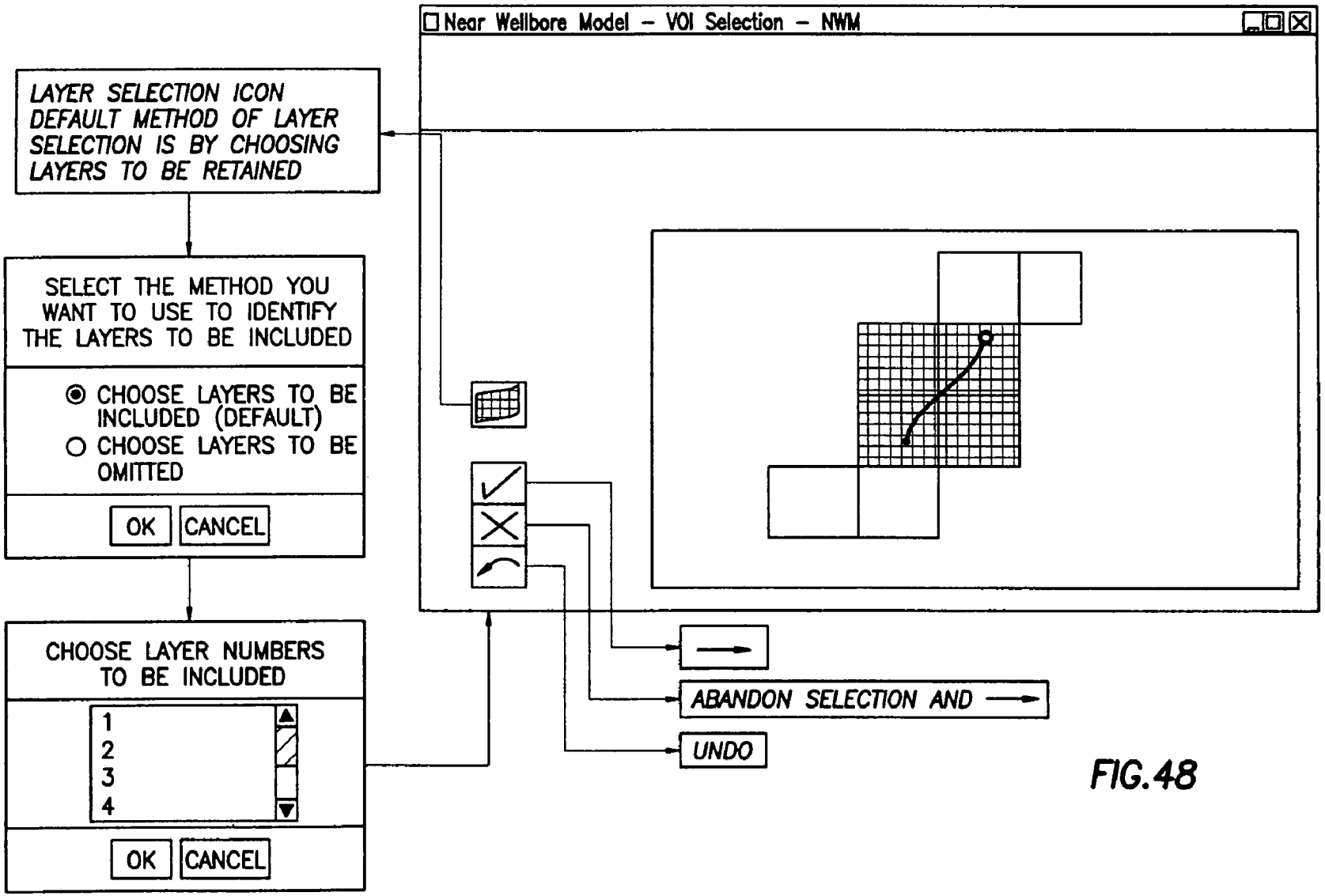
Figure 49:
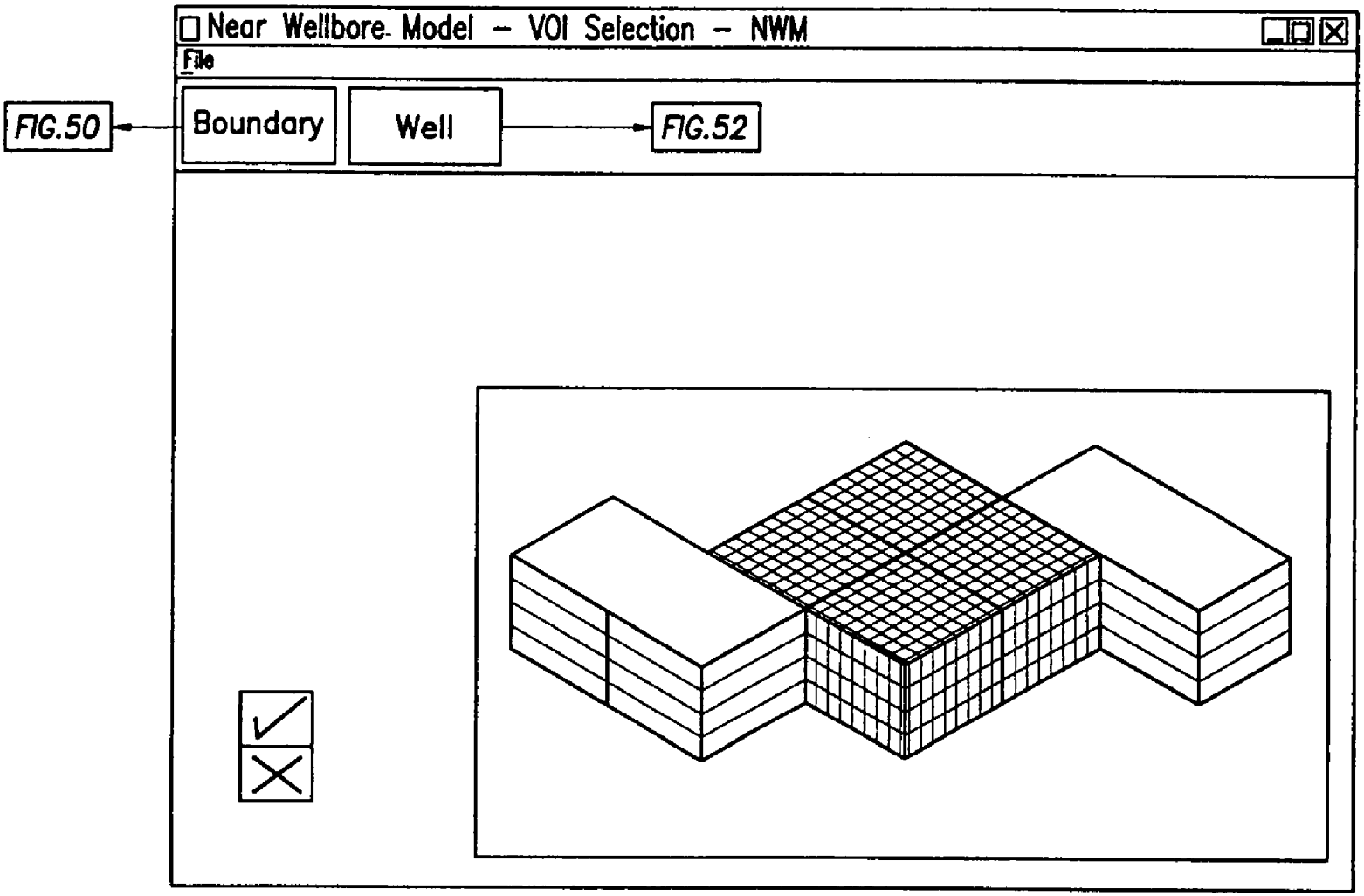

Referring to FIGS. 47, 48, and 49, the "Volume of Interest (VOI) Selection" is discussed in the following paragraphs with reference to FIGS. 47 through 49. In FIGS. 47 through 49, the "VOI selection" component of the NWM tool is used to identify the portion of the full field model (FFM) which is to constitute the volume of interest in the near wellbore modeler (NWM).

Inputs

The fundamental input to the "VOI Selector" is the FFM data set which must be based on a Cartesian geometry. The FFM data set is made available by the NWM Main Window of FIG. 46 from which the "VOI Selector" is launched. There is no other way of starting the VOI Selector.

Possible additional inputs are the well trajectory and well completion data. These will be available if the Well button has already been used to enter and specify data for the principal well.

Processing

The application is based on the FloViz 3-D viewer. "FloViz" is a software product available from GeoQuest, a division of Schlumberger Technology Corporation, Houston, Tex. Standard FloViz icons will be available for manipulating and viewing the images of the FFM and NWM grids.

The viewer will open with a plan view of the FFM simulation grid and wells. The grid can be grabbed and rotated away from the plan view in order to get an overall view of the model. At any time, the "snap to plan" icon can be used to return to a plan view of the grid. The identification of the volume of interest (VOI) can only be carried out with the plan view showing in the 3-D viewer.

If the application has been entered from the Main Window of FIG. 46 during the creation of a new near wellbore modeler (NWM), the viewer will show the trajectory of the well derived by interpolating between the cell centre depths of the cells in which the well is completed. This will be the only well trajectory information available at this stage. If the application has been entered after entry of the well data (medium priority additional requirement which may or may not be available in the first release) or with a previously completed NWM selected, the well trajectory and completed intervals, as derived from the deviation survey and completions table, will be shown. The point of intersection of each well with the top of the model (or the uppermost block in which the well is completed if the trajectory is not available) will be labelled with the well's name.

The user has control over the property used as the basis of the coloring of the 3-D display. The property displayed by default will be absolute permeability. However, any other property available from the FFM simulation grids can be specified. The choice of property is accessed through the standard FloViz menu structure. Clicking on the icon brings up a list of available gridded data. The user chooses the appropriate property and clicks on OK.

The default technique for identifying the area of interest on the plan view is by use of a poly-line. The user will be able to define a boundary around the area of interest by a series of mouse clicks. An available alternative is to identify the area of interest using a simple rectangle. The cells within the boundary will define the appropriate area. Once the volume has been defined, the user can strip away cells outside the VOI and view it from all sides using the 3-D viewer. At any time, the user can "snap to plan" and edit the poly-line before viewing the selected volume again.

The option to be able to identify the area by identifying the individual grid blocks to be included is to be considered as a low priority additional requirement.

The selection can be abandoned by clicking on the reject icon. Once the user is happy with the chosen area, her or she clicks on the commit icon. The un-selected part of the FFM may then be stripped away leaving only the chosen volume. At this point, the user can return to the area of interest selection window by clicking on the undo icon.

Assuming the user is satisfied with the selection of the area of interest, he or she may then choose to click on the select layers icon. This brings up a table of the FFM layer numbers. The default method for selection of the layers is by clicking on the layer numbers to be retained. A low priority additional requirement is to be able to click on the layer numbers to be rejected. A further low priority additional requirement is to be able to choose the layers to be retained or rejected by clicking directly on the layers in the 3-D viewer. The user clicks on OK to choose the layers. The rejected layers are stripped away from the NWM and only the chosen cells are shown. The user can undo the layer selection and return to all layers by clicking on the undo icon. The user can return to the area of interest selection window by clicking on the reject icon.

By clicking on the commit icon, the user can save the chosen VOI and return to the Main Window of FIG. 46. The Case Manager part of the Main Window of FIG. 46 will now show the Flux run as a child of the original FFM. By clicking on the Boundary icon, the user can save the VOI data and move directly to the Flux Run Manager. By clicking on the Well icon, the user can move to the Well functionality/application.

Error Handling

There are two errors and one warning which need to be trapped.

Well Partially Outside the VOI

It is not possible to have a well which crosses the boundary of the VOI. T he user should be warned and returned automatically to the area of interest selection display.

Too Few Cells Between the Edge of the NWM and the Edge of the FFM

It is necessary that there should be at least two rows of grid blocks between the edge of the VOI and the edge of the FFM.

No Principal Well Identified

This is not an error condition because the principal well may be identified later under the Well functionality. The user should however be warned if no principal well has been chosen.

Outputs

Files

The outputs from this section are as follows.

1. Identity of the principal well (optional).

2. Creation of a modified version of the FFM data set to identify the VOI as a separate flux region and to carry out a DUMPFLUX run.

Hardcopy

There will be no hardcopy generated by this component.

Performance

Achievement of many of the performance criteria will be dependent on the performance of FloViz rather than performance of the NWM tool. The following criteria can be regarded as specific to NWM.

1. Selections should take no more than one second to take effect.

2. Start up of the component with an FFM of benchmark size (see Appendix D) should take no more than five seconds.

3. Refresh of the display following a strip operation (layers or columns) should take no more than five seconds with an NWM and an FFM of benchmark size.

4. Undo and restore operations should take no more than five seconds with an NWM and an FFM of benchmark size.

Attributes

Maintainability

Most of the technology used in the 3-D Viewer is derived from FloViz. This imposes two constraints on the 3-D Viewer.

1. NWM tool releases must be coordinated with FloViz releases.

2. At each release, the NWM tool must use the contemporary release of FloViz.

Testability

The Main Window must satisfy the following high level test criteria.

1. Ability to start up with each of the FFM test data sets. Any constraints on the nature of the FFM data sets which can be used should be documented and appear in the manual.

2. Ability to create NWM VOIs from FFM grids. Any constraints on the nature of the VOIs which can be set up (e.g. if VOI boundaries cannot cut through LGRs) should be documented and appear in the manual.

3. Ability to export the coordinates of the boundary of the VOI to the Main Window.

4. Ability to transfer the identity of the principal well back to the Main Window.

5. Ability to create the appropriate flux run file.

Figure 50:
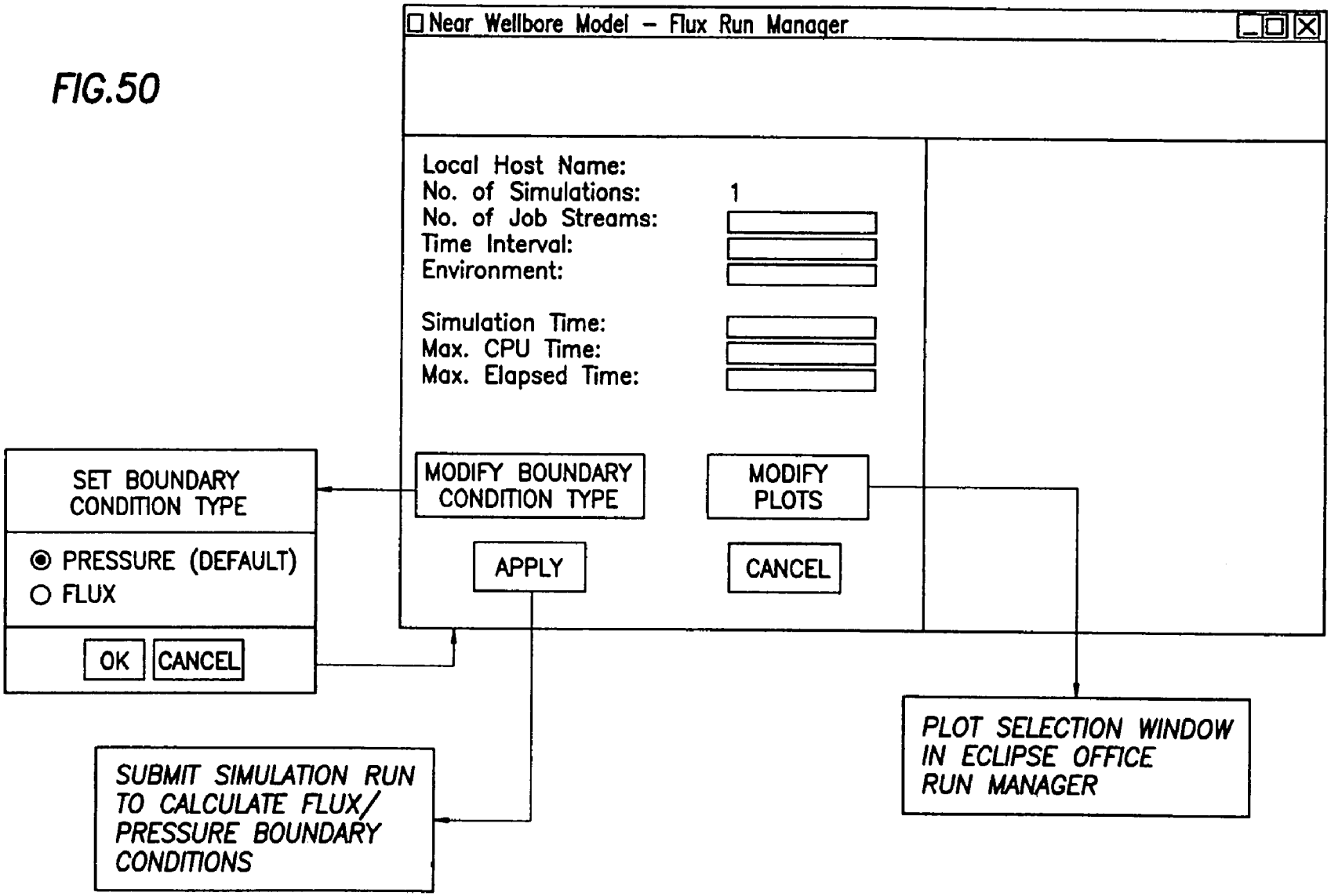
Figure 51:
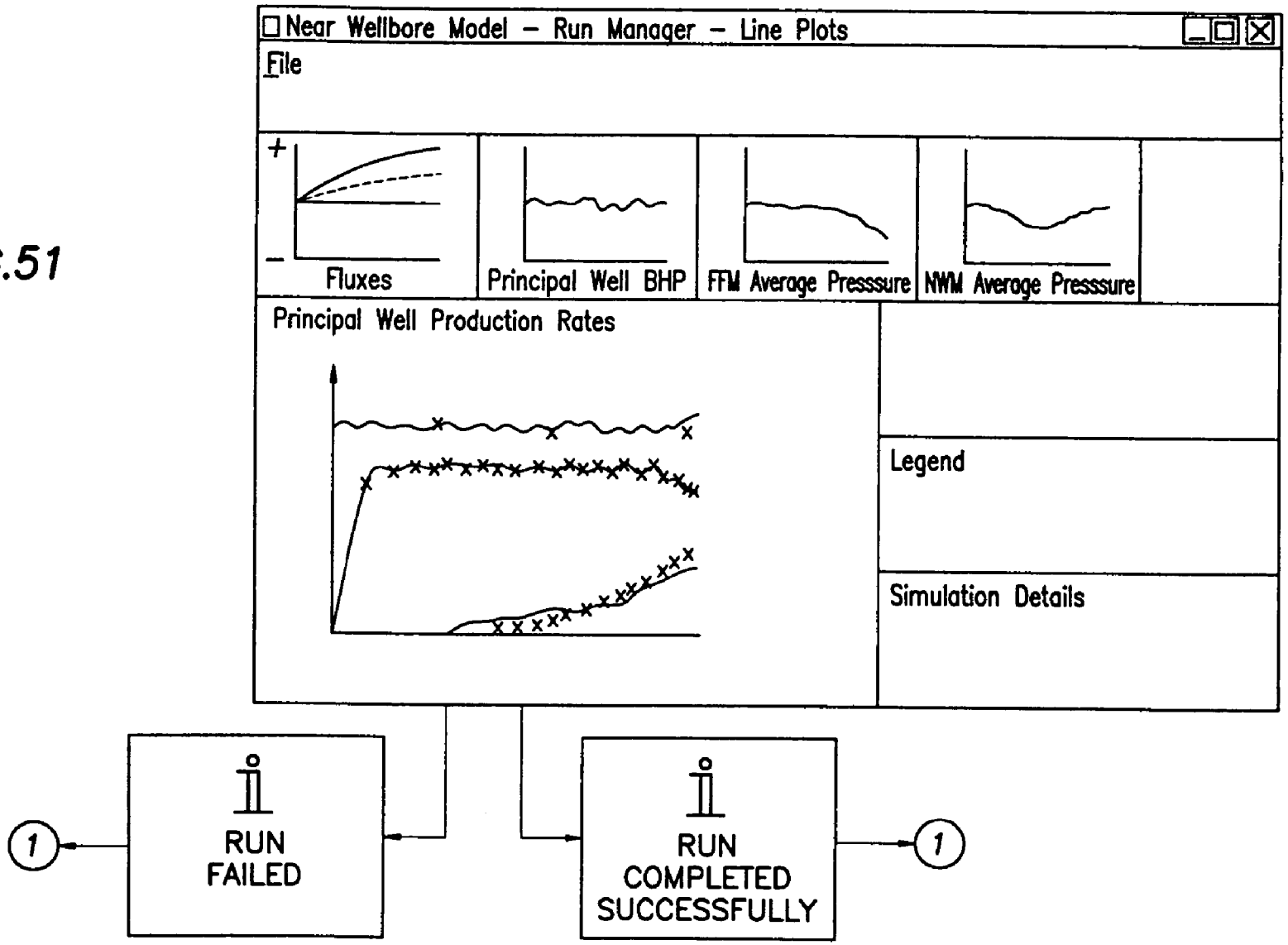

Referring to FIGS. 50 and 51, the "Flux Boundary Conditions Run Manager" is discussed below with reference to FIGS. 50 and 51.

The "Flux Boundary Conditions Run Manager" is used to submit, manage and monitor the run of the full field model FFM which generates the flux boundary conditions for the near wellbore modeler (NWM) run.

Inputs

The principal input is a version of the FFM data set, modified by the VOI Selector component to include the DUMPFLUX keyword and flux region numbers appropriate to the chosen VOI.

A secondary input will be production data observations for wells within the VOI, most notably the principal well. The loading and display this information will use standard ECLIPSE Office facilities. Data which may be included for each well are:

1. oil production rate 2. gas production rate 3. water production rate 4. flowing bottom hole pressure 5. flowing tubing head pressure 6. static pressure 7. watercut 8. gas oil ratio Processing The "Boundary" icon in either the "VOI Selector" component (FIGS. 47-49) or the Main Window (FIG. 46) takes the user into the "Flux Run Manager" (FIGS. 50-51), ready to execute the Flux Boundary run. Operation of the Run Manager is as in ECLIPSE Office, subject to the additions discussed below.

The "Flux Run Manager" has two buttons additional to those in the conventional ECLIPSE Office Run Manger. The "modify boundary condition type" button activities a panel enabling the user to choose the kind of boundary condition to use.

There are two options.

1. The Flux option is the conventional ECLIPSE option in which the flux across each cell interface at the boundaries of the VOI is calculated at each mini-timestep. The information for each mini-timestep is written to a file which is used to define the fluxes across the boundaries of the NWM during subsequent runs.

2. With the Pressure Flux option, the information written to the file at each mini-timestep is not the actual flux across the boundary of the model. Instead, the pressure in the block outside the NWM and fractional flow of each phase in flows into the NWM are recorded. This enables more realistic fluxes across the boundaries of the NWM to be calculated during subsequent runs of the NWM. It also overcomes the problem of fluid being inappropriately forced into the NWM or extracted from it when production and injection rates of wells within the NWM differ from those of the original DUMPFLUX run.

A medium priority additional requirement is the ability to configure the line plots generated during the DUMPFLUX run. If time and resources are available to implement this requirement, the capabilities will be as follows.

The NWM tool Run Manager will include a "Modify Plots" button. Once the run is initiated from the Flux Run Manager, the "Run Manager Line Plots" window is opened. This shows a series of plots diagnostic of the progress of the DUMPFLUX run. The plots which will be presented by default are as follows.

| | |
|---|---|
| Main plot | Oil, gas and water production rates of the principal well with observed data |
| Secondary plot 1 | Fluxes of oil, water and gas across the boundaries of the VOI in reservoir volume units |
| Secondary plot 2 | Principal well flowing bottom hole pressure |
| Secondary plot 3 | Average pressure in the VOI |
| Secondary plot 4 | Total oil, gas and water production rates of all the well within the VOI |
| Secondary plot 5 | Total water injection rate into the VOI |
| Secondary plot 6 | Total gas injection rate into the VOI |

By clicking on the Modify plots button, the user can configure any of the plots to show any of the time series data normally made available by the ECLIPSE Office Run Manager.

The Run Manager Line Plots window is specified exactly as the ECLIPSE Office Run Manager Line Plots window.

Both the Flux Run Manager and the Run Manager Line Plots windows can be minimized during simulation. At the end, a popup announces that the run has either finished or failed. When the user acknowledges the announcement, control is returned to the Main Window.

Error Handling

The principal kind of error is expected to be simulation runs which fail. Failure of the run will be announced by a popup. The user will then have to review the detailed simulation output to determine the cause of the failure and correct it. No additional facilities to help diagnosis of the reasons for failure are intended to be developed during this project.

It is assumed that the FFM which forms the basis of an NWM study has already been run successfully. In general, the addition of DUMPFLUX keywords should not cause a successful run to fail. We therefore expect that failure of simulation runs at this stage will be rare.

Outputs

Files

The only output from the DUMPFLUX run will be a file of Fluxes or Pressure Fluxes, according to the chosen option, at each mini-timestep.

Performance

The performance of this component is dictated by the performance of ECLIPSE itself. Performance considerations are therefore not relevant.

Attributes

Maintainability

Most of the technology used in the NWM Run Manager component is derived from the ECLIPSE Office Run Manger. This imposes two constraints on the NWM Run Manager.

1. NWM tool releases must be coordinated with ECLIPSE Office releases.

2. At each release, the NWM tool must use the contemporary release of the ECLIPSE Office Run Manager.

Testability

The Main Window in the released product must satisfy the following high level test criteria.

1. Ability select either of Pressure Flux or Flux boundary conditions.

2. Ability to specify line plots to be used to monitor the DUMPFLUX run.

3. Ability to launch a DUMPFLUX run on the local machine or an alternative machine across the network.

4. Ability to monitor DUMPFLUX run performance using default or customised plots.

Figure 52:
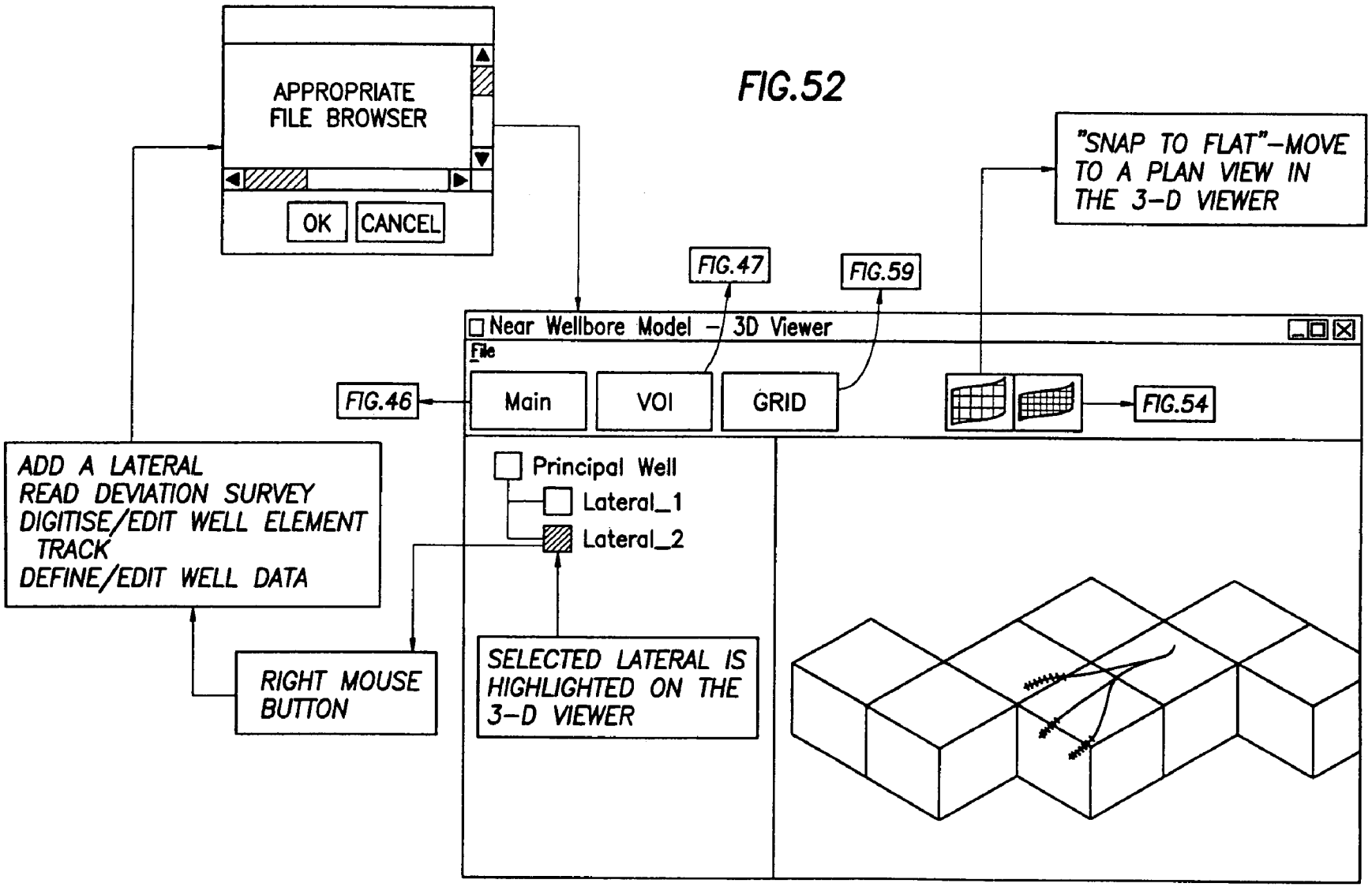

Referring to FIGS. 52, 53, and 54, the "Well Configuration Manager" is discussed below with reference to FIGS. 52 through 54.

This component of the application provides

1. A focal point for all well specification activities.

2. Visualization facilities to help understand the relationships between the well or wells, the laterals and the simulation grid.

3. Facilities for defining and editing the configuration of the principal well and its associated laterals.

4. Facilities for defining and editing the geometry of the principal well and its associated laterals, either interactively or from deviation survey data.

Inputs

The inputs to this component of the application are as follows:

1. The VOI simulation grid and the associated coarse grid block properties inherited from the FFM. (The FFM simulation grid and its associated grid block properties may be an alternative input at this stage. This will depend on the implementation of a low priority additional requirement enabling the engineer to specify the well in the context of the FFM before definition of the VOI.)

2. The configuration of the principal well and its associated laterals and the associated completions.

3. Deviation surveys for the well and its associated laterals.

Processing

The component is entered from the Main Window or the Boundary component. The point of entry is a passive 3-D viewer showing the VOI and associated grid. If the NWM is in the process of being created, the grid block outlines shown and the grid block properties represented by the colour cell painting will relate to the coarse FFM grid blocks. If the component is being used to work with an existing NWM, the grid and properties will relate to the NWM grid and grid block properties. The model shown in the viewer will be the model selected in the component from which the Well Configuration Manager component is launched (Main or Boundary).

If the user is working with a model for which the principal well is already chosen and defined, the well is shown. If no principal well has yet been chosen, the user is prompted to make a choice. A panel is presented listing the wells within the VOI and the additional option, 'Create a new well'. If the user chooses an existing well which was present in the FFM, the track of the well as inferred by interpolating between the centers of the blocks in which the well is completed is shown. The well appears in the configuration window, together with whatever configuration data is available. If the user chooses to create a new well, a panel prompts for the well name. When the user clicks on OK, the well appears in the Well Configuration part of the window. In either case, the well can then be defined using the right mouse button functions described below.

The cells are color painted to represent the value of a chosen property. The default property is permeability but this can be changed by the user to any other property for which grid block values are available in the FFM. As the FFM will always have been run successfully, these will include both geological variables and solution variables (pressure, water saturation etc.). The default cell transparency will be set to allow the well trajectories/completions to be seen while keeping the cell coloring visible. All of the standard FloViz facilities such as thresholding and sectioning will be available in the display.

Interaction with the individual elements of the well is achieved by clicking on the appropriate element with the right mouse button. This produces a drop down menu with the following options.

Read a Deviation Survey.

Choosing this option brings up a file browser so that the file containing the deviation survey information for the well element can be selected.

Digitize or Edit a Well Element

A well element is either the main wellbore itself or a lateral. Choosing this option brings up a the NWM VOI and available well information in plan view in the 3-D display window. Although initially shown in plan view, the image of the VOI can be rotated and manipulated using the full range of FloViz facilities. At any time, the display can be returned to the plan view by clicking on the "snap to flat" icon.

The grid cells are color coded according to the value of a prescribed property. The default option is color coding according to depth but any of the available grid cell properties can be used. If the NWM is in the process of being built, the grid cells and associated properties will be those derived from the parent FFM. If an existing NWM is being edited, the grid cells and associated properties will relate to the current NWM.

When creating a new well or lateral, the trace of the well trajectory on the top surface of the VOI can be digitized by clicking on the mouse. When editing an existing well trajectory, the points defining the track of the well will be displayed and can be dragged to new locations. These operations are only possible with the display in plan view. Individual sequential mouse clicks or edits can be deleted using the undo icon. The whole of a new well track can be deleted or all edits lost by clicking on the abandon icon.

Clicking on the commit icon moves the user to the third part of the ribbon display component. This is a view of the cells above and below the well track, with transparency set at a level which allows both the cell coloring and the well track to be seen. A newly created well track is initially shown running along the top of the model. An existing well track is shown at the appropriate depths. The individual points defining the well track can be dragged to the level required. The points can only be moved in the z direction in this display.

As in the plan view, the cells shown can be colour coded using any of the properties available for the subject grid. The default for this display is water saturation.

Clicking on the undo button undoes the last modification. Clicking on the abandon icon undoes all of the changes made since the display was opened. Clicking on the commit icon takes the user back to the 3-D viewer, updated to show the new well information. From the 3-D viewer, the user can move to the Main Window, the VOI window or the gridding window by clicking on the appropriate button.

At any time following the definition of the well, the user can move between the 3-D display, the plan display and the ribbon display by clicking on the appropriate icon in each window.

The Add a lateral option adds a new empty box to the well configuration diagram. The box appears with a default name which the user can change by typing a new name in the box. The user can then define the well track as set out above.

The Define/edit well data option takes the user to the Well schematic window with the chosen lateral selected in the well configuration tree.

Error Handling

There are a number of identifiable error conditions which need to be trapped.

Deviation Survey Which Positions all or Part of a Well Outside the VOI

This is not allowed. The component needs to identify when this condition exists and prompt the user to review the deviation data.

Starting Point of a Lateral does not Coincide with a Point on the Parent Well or Lateral There should be a tolerance for this of 10 feet or three meters. If the end of the lateral lies within the tolerance distance of the parent, the two should be regarded as connected. If the separation is greater than 10 feet, the user should be prompted to check the deviation survey data.

Tracks of a Well and a Lateral or Two Laterals come within 10 Feet of One Another This is not strictly an error condition but is unlikely to represent a real situation. The user should be warned.

Outputs

Files and Data

The outputs from the component are the configuration and geometry of the principal well for internal use by the application.

Hardcopy

The only hardcopy generation possible from this component will be by use of screen capture software. There is no intention to provide scaled hardcopy.

Performance

It should be possible to read in any deviation survey, display the well track and return control to the user in less than 30 seconds.

Remaining performance issues are associated with the ability of FloViz to present the NWM and FFM for visualization. The performance target is that no operation involving the 3-D visualization should take more than five seconds with an FFM of benchmark size. Rotation, re-orientation and zooming of the model should appear instantaneous to the user with an FFM of benchmark size.

Attributes

Maintainability

Most of the technology used in the NWM Well Configuration Manager component is derived from FloViz. This imposes two constraints on the NWM Well Configuration Manager.

1. NWM tool releases must be coordinated with FloViz releases.

2. At each release, the NWM tool must use the contemporary release of the FloViz libraries.

Referring to FIGS. 55, 56, 57, and 58, the "Well Data Manager" will be discussed in the following paragraphs with reference to FIGS. 55 through 58.

The "Well Data Manager" component provides the user with the facilities required to enter, edit and view data relating to the wellbore and near wellbore region of the principal well.

Inputs

The inputs to this component are as follows.

TABLE 1

| Input | Source |
|---|---|
| Configuration of the principal well and laterals | Inherited from the Well Configuration Manager |
| Existing completion, segment and zone of modified properties data | Inherited from files created during previous use of the Well Data Manager |
| New completion, segment and zone of modified properties data | Entered by the user |
| Saturation tables | Determined from table numbers in existing data files |

Figure 55:
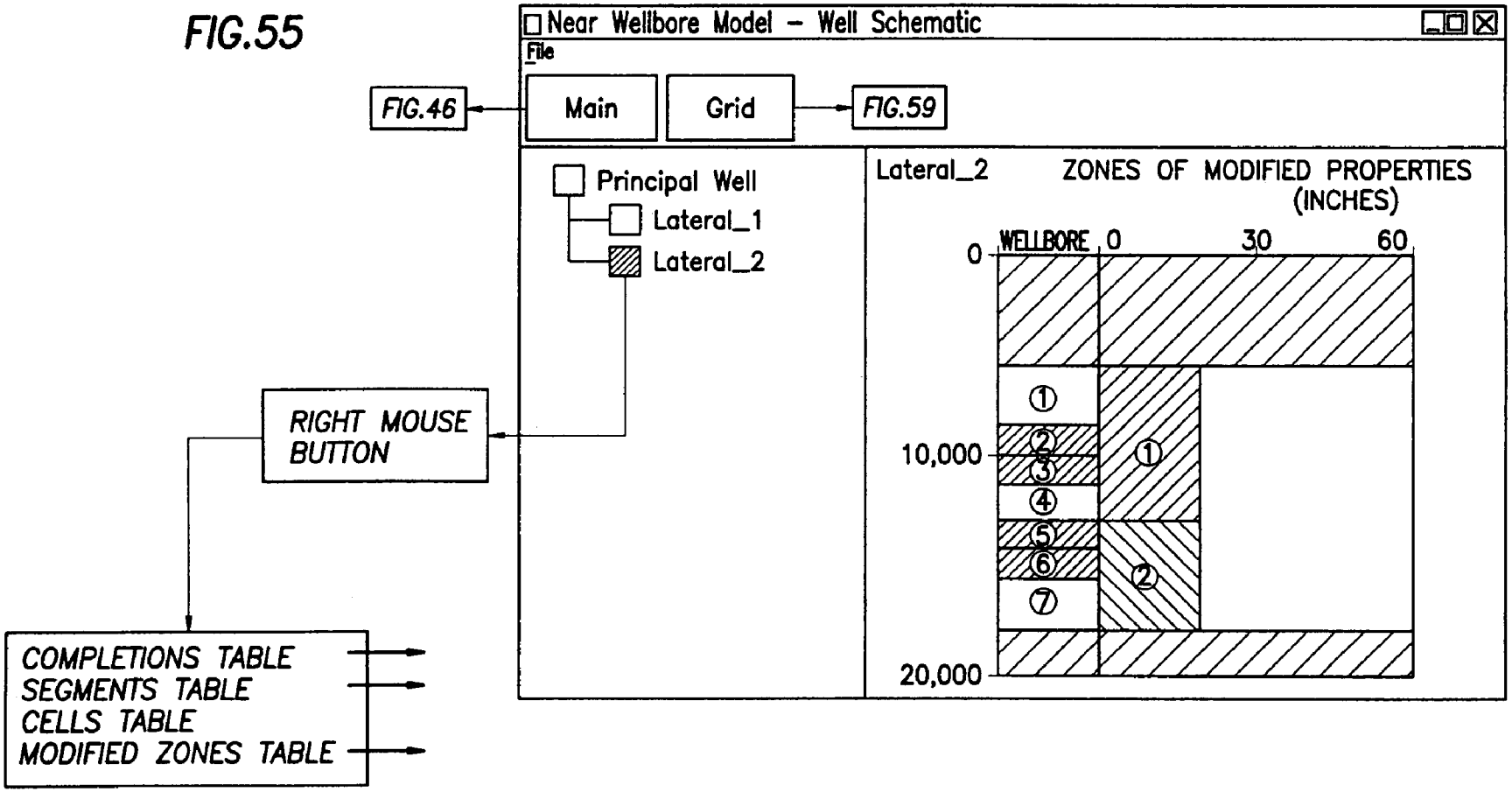

Processing—Well Schematic (FIG. 55)

The entry point for the "Well Data Manager" component of FIGS. 55 through 58 is the "Well Schematic" of FIG. 55 which is accessed from the well 3-D viewer. The "Well Schematic" display of FIG. 55 has two parts. The configuration hierarchy of the principal well is shown in the left hand window. The right hand window consists of a composite display of the completion, segmentation and damage zone data for the well.

The depth scale of the composite display is linear and set up between round numbers (rather than between the shallow depth of the well or lateral and the deeper depth). The depths above the shallow end of the well or lateral and below the deeper end are shaded. The left hand track of the display shows the completions and the segments into which the wellbore is divided. The right hand display shows the annular zones within which the properties of the near wellbore volume can be modified. The default scale on the damage zone is 0 to 60 inches but this can be modified if necessary. The composite display is a viewer only, displaying the depths and radii associated with the well characteristics.

In order to change the characteristics of the main wellbore or a lateral, the user clicks on the appropriate element in the well configuration display with the right mouse button. This produces a drop down menu giving access to the tables used to enter and modify the well data as described below.

Figure 56:
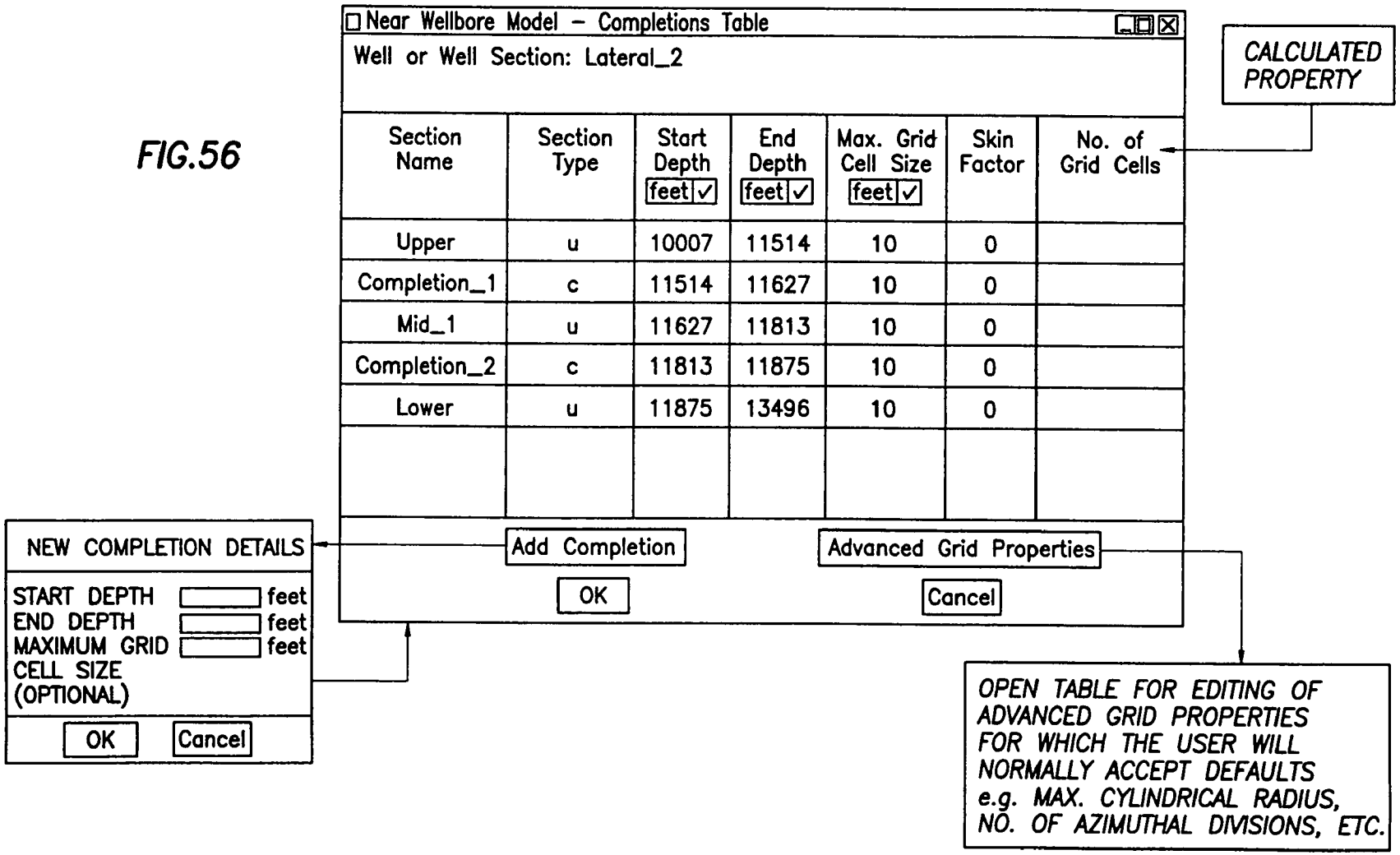

Completions Table (FIG. 56)

The completions table (FIG. 56) is used for the entry and editing of basic completion information. The information handled by the table is as follows.

1. Section name—An appropriate name is allocated by the software but can be modified by the user.

2. Section type—Whether the section is perforated or unperforated.

3. Completion top depth—Depth of the top of the completion. Can be specified in feet or meters.

4. Completion bottom depth—Depth of the bottom of the completion. Can be specified in feet or meters.

5. Maximum grid cell size—Both perforated and unperforated sections will commonly be represented using more than one cell in the z (along hole) direction. This is the maximum length (in the z direction) of each cell. An appropriate default value will provided which can be modified by the user.

6. No. of grid cells—The number of grid cells in the z direction used to represent the completion. This will be calculated by the software taking account of the maximum grid cell size entered in the previous field.

7. Skin factor—This is treated as a property of the completion rather than one of the zones of modified properties. The default value is zero.

8. Completion connection factor—This is a calculated quantity. Values will be determined during the gridding stage of the model preparation and entered in this column. They may subsequently be modified by the user. Whenever a user enters a value of completion connection factor, he or she will be prompted to specify whether it should be treated as fixed. If the user specifies the value as being fixed, it will not be over-written next time the NWM is gridded. If the user specifies the value as volatile, it will be over-written each time a re-gridding operation is carried out.

The user will have the option to specify additional completions by clicking on the Add completion button. The user will specify the top and bottom depths of the completion and, optionally, the maximum grid cell size. The software will add rows to the table to account for the new completed section and the un-perforated section on either side. The top and bottom depths of the unperforated sections will be calculated and defaults used for the maximum cell sizes.

There are additional parameters relating to the completions which will affect the nature of the cylindrical grid around the well e.g. maximum cylindrical radius, number of azimuthal divisions etc. Default values for these will be supplied. The user can view and edit the default values by clicking on the Advanced grid properties button which will open the table in which they are stored.

The Completions Table (FIG. 56) of the Well Data Manager is the only place in which completions can be created. Completions can be opened and closed in the scheduling data but cannot be created.

A medium priority additional requirement is to be able to represent zero phasing perforations i.e. perforations at one azimuth only. Implementation of this requirement will require extension of the completions table by one column. The column will define the direction of the perforations or define them as "spiral" if they are spirally phased.

Figure 57:
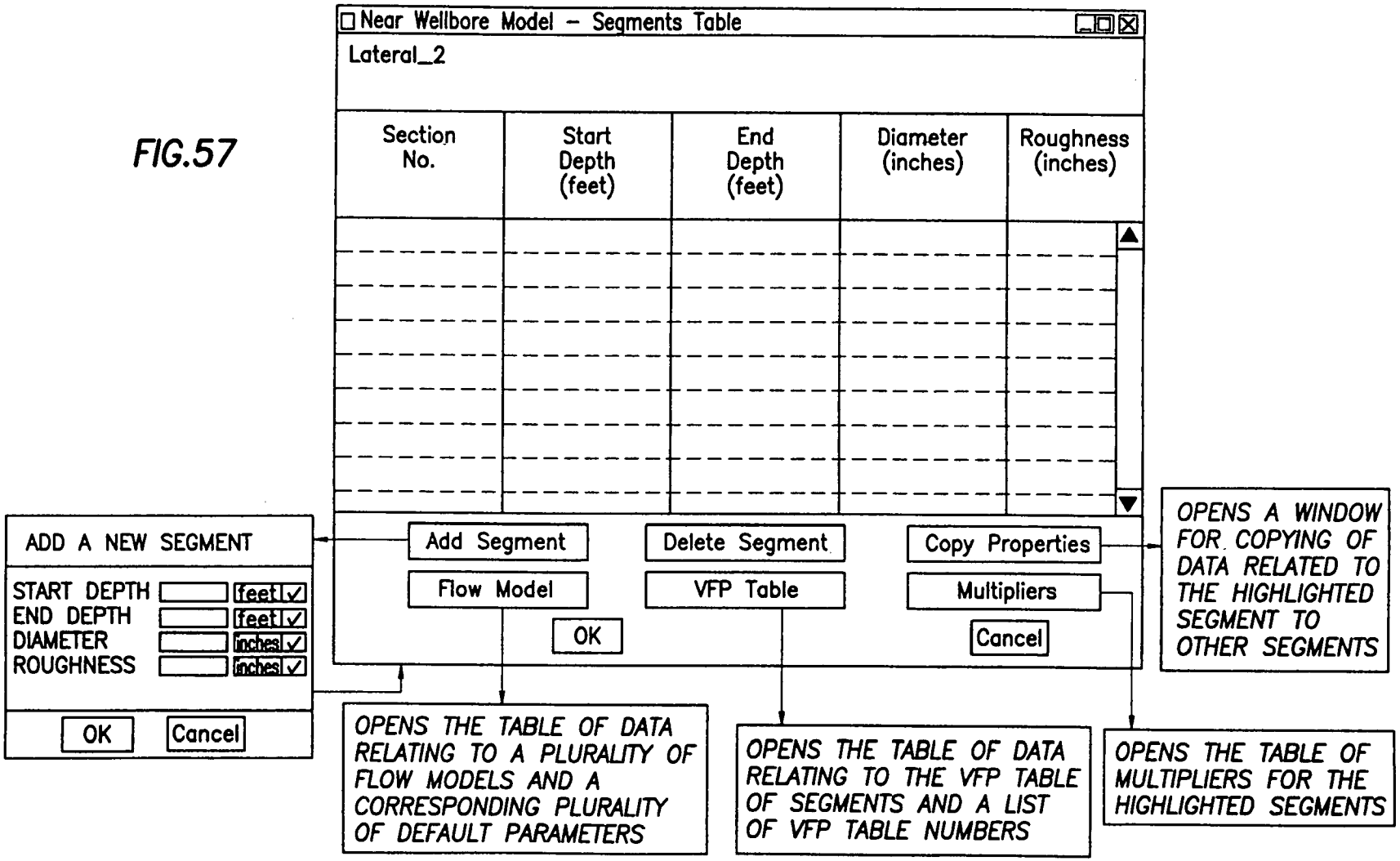

Segments Table (FIG. 57)

The use of the multi-segmented well (MSW) model is an essential element of the NWM tool. The Segments table (FIG. 57) is the place in which the characteristics of the segments will be accessed by the user and can be modified if appropriate.

Once the completions of the well have been defined, a default well segmentation will be determined by the software. When the user opens the Segments table, the columns Segment No., Start depth and End depth will be completed. It will be necessary for the user to specify Diameter (the internal diameter of the segment available for fluid flow) and Roughness for each segment. The Copy properties button can be used to enter values of diameter and roughness for one segment and then copy them to some or all of the other segments.

The experienced user can modify the well segmentation if he or she wishes. A segment can be added by clicking on the Add segment button. The user will specify the Start depth, End depth, Diameter and Roughness for the segment. The new segment will then be fitted into the table appropriately with existing segments modified as appropriate. Segments can also be deleted. Appropriate changes will be made to the start and end depths of adjoining segments. Top or bottom depths of segments can be modified by typing new values into the table. Appropriate changes will be made in the depths associated with adjacent segments. If the change in depth results in another segment being deleted, the user will be warned that this is the case before the change is executed.

By default, the MSW model will use the homogeneous flow model. The user will also have the opportunity to use the drift flux model or VFP tables to represent flow in the segments of the model. By clicking on the Flow model button, the user will be able to select which model to use. For each model, the application will supply a default set of parameters. The user will have access to and the ability to change these default parameters in tables accessed via the Flow model button.

If the user chooses to use VFP tables to represent the behavior of the well, the VFP table button will become sensitive. Clicking on this button will lead the user to a file browser in which the file containing the VFP tables can be selected. This in turn will lead to a table of segment numbers and a list of VFP table numbers available in the file which can be associated with the segments. The user will associate appropriate table numbers with appropriate segments. Any segments with which a table number is not associated will revert to use of the homogeneous flow model.

It is also possible for the user to apply multipliers to the pressure drops calculated for each segment. The default value for each segment is 1.0. The user can gain access to the values and modify them if appropriate by clicking on the Multipliers button.

A medium priority additional requirement is to be able to segment azimuthally as well as longitudinally. This will enable the user to represent, for example, perforation of the well on one side of the hole only as distinct from all around (i.e. zero phasing instead of spiral phasing). If progress suggests that this facility can be accommodated, a detailed specification will be included in the Addendum to Specification to be produced in Q3 1998.

Figure 58:
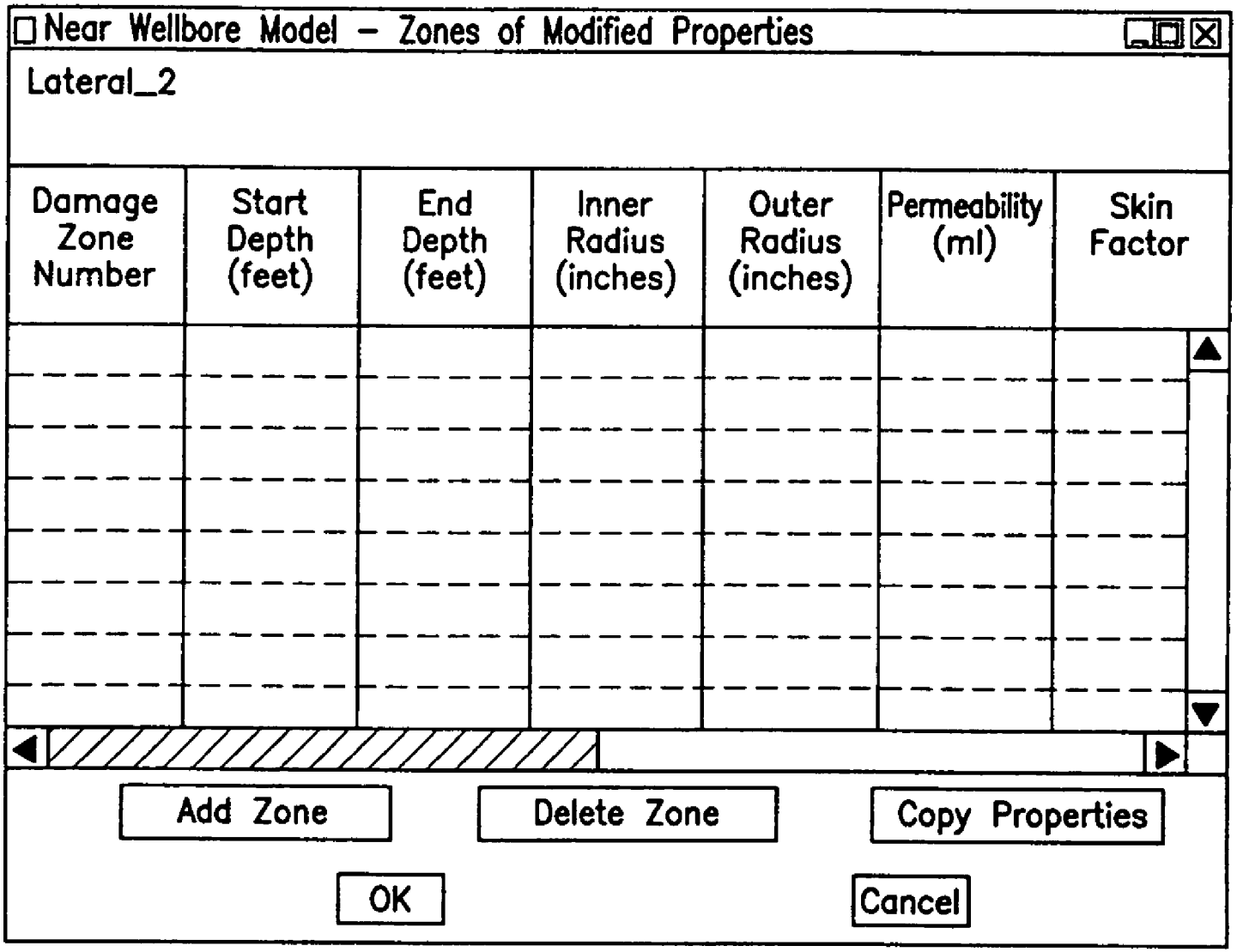

Zones of Modified Properties (FIG. 58)

A key element of the NWM model is the ability to modify the reservoir properties in the vicinity of the wellbore to reflect observed behaviour, to model well treatments or to represent local phenomena. These properties are defined in the Modified reservoir properties table (FIG. 58).

By default, there are no zones with modified properties and the original table has no rows. To define a zone of modified properties, the user clicks on Add zone. This adds a row to the table which the user has to complete. Available fields are as follows.

1. Damage zone number (calculated and not editable)

2. Start depth

3. End depth

4. Inner radius

5. Outer radius

6. Permeability

7. Saturation table number for imbibition oil water relative permeability curve

8. Saturation table number for drainage oil water relative permeability curve

9. Saturation table number for imbibition oil gas relative permeability curve

10. Saturation table number for drainage oil gas relative permeability curve

11. Hysteresis parameters for oil water hysteresis

12. Hysteresis parameters for oil gas hysteresis

Table numbers will be allocated to fields by selection from a list of the tables and associated numbers available. It will only be possible to allocate saturation tables which already exist in the saturation table numbers list.

Defaults will be used where specific data are not supplied. If permeability is not specified, it will be inferred from the geological model when the gridding is carried out. If no drainage curve saturation table is specified, it will be assumed that there is no hysteresis and that the imbibition curve applies to both imbibition and drainage. In this way, the opportunity to enter data will be maximized while minimizing the amount of work which the user has to do.

Zones of modified properties may be deleted. The remaining zones will be re-numbered.

The Copy properties button can be used to copy attributes of one zone of modified properties to some or all of the others.

For each table, clicking on OK or Cancel returns the user to the Well Schematic, with or without saving of changes as appropriate.

From the Well Schematic, the user can return to the Main Window or advance to the Grid section or return to the VOI section.

Error Handling

The following possible error conditions have been identified as needing to be trapped.

1. Completions which overlap—The user should be warned when trying to specify a completion which overlaps with another completion and prompted to modify the one of them.

2. Start or end of the completion beyond the top or bottom of the lateral or well—The user should be prompted to change the completion depth range to bring it within the extent of the lateral.

3. Completion across to two close to a branch in the well—It is not permissible to have a completion exist across a branch in a well for two reasons. Firstly, this is not a realistic operational scenario. Second, the cylindrical grids which are calculated around the individual wellbores will interfere. If the user specifies a completion which approaches too close to a well branch, a warning will be presented and a depth or depths will be offered which are acceptable (e.g. if a completion is specified which crosses a branch, top and bottom depths of an unperforated section across the branch will be suggested). These can be accepted by the user or the completion specification re-started.

4. Failure to specify one or more mandatory properties—Completion Start depth and End depth and Section type are mandatory properties. All others can be defaulted. Failure to specify any of the mandatory properties will prompt a warning. The property will need to be specified before the user is allowed to proceed.

5. Property outside viable range—The Maximum grid size and the Advanced grid properties will have acceptable ranges of values that they can take. If the value specified by the user lie outside the appropriate range, a warning will be given. The acceptable range for each parameter has yet to be defined.

6. Two completions with the same name—No two completions within one lateral or principal wellbore can have the same name. The user will be prompted to specify an alternative.

7. Modification of the start or end depth of a segment which is coincident with the starting point of a branch—The branching point of a lateral from another lateral or the principal wellbore is always the start and end of a segment in the parent. Such points will be highlighted in the segments table If the user attempts to move such a point, a warning will be posted and the user told it is not allowed.

8. Start or end of a segment beyond the top or bottom of the lateral or well—The user should be prompted to change the segment depth range to bring it within the extent of the lateral.

9. Failure to specify one or more mandatory properties—Diameter and Roughness are mandatory properties. All others can be defaulted. Failure to specify any of the mandatory properties will prompt a warning. The property will need to be specified before the user is allowed to proceed.

10. Property outside viable range—The Diameter, Roughness and Multipliers will have acceptable ranges of values that they can take. If the value specified by the user lie outside the appropriate range, a warning will be given. The acceptable range for each parameter has yet to be defined.

11. Diameter of lateral greater than diameter of parent—This is a physically unlikely scenario. The user will be prompted to reduce the diameter of the lateral to less than that of the parent lateral or wellbore.

12. Start or end of a Zone of modified properties beyond the top or bottom of the lateral or well—The user should be prompted to change the zone depth range to bring it within the extent of the lateral.

13. Inner radius of a Zone of modified properties greater than outer radius—This is not permissible. The user will be prompted to modify the inner radius or the outside radius.

14. Zone of modified properties overlapping with another zone of modified properties—This is not allowed. The user will be prompted to modify the dimensions of one of the zones.

15. Property outside viable range—The properties associated with Zones of modified properties will have acceptable ranges of values that they can take. If the value specified by the user lies outside the appropriate range, a warning will be given. The acceptable range for each parameter has yet to be defined.

16. Failure to specify one or more mandatory properties—Start depth, end depth, inner radius and outer radius are mandatory properties. All others can be defaulted. Failure to specify any of the mandatory properties will prompt a warning. The property will need to be specified before the user is allowed to proceed.

Outputs

Files and Data

This component creates multi-segment well model keywords which are automatically inserted into the schedule include file for the current NWM.

Hardcopy

It will be possible to obtain hardcopy output of the Well Schematic and each of the tables for inclusion in written reports.

Performance

Each of the displays in this component should appear within a couple of seconds of selection. All Read and Write operations should take no more than a couple of seconds.

In view of the modest amounts of data involved, it is not expected that performance will be a significant issue for this component.

Attributes

Maintainability

Beyond using the appropriate release of the Framework, there should be no significant maintainability issues associated with this component.

Testability

Testing will hinge around ensuring that data specified in the tables are accurately represented on the Well Schematic and then correctly transferred to the rest of the application. The way in which data are output to hardcopy will be structured to facilitate this kind of verification.

Figure 59:
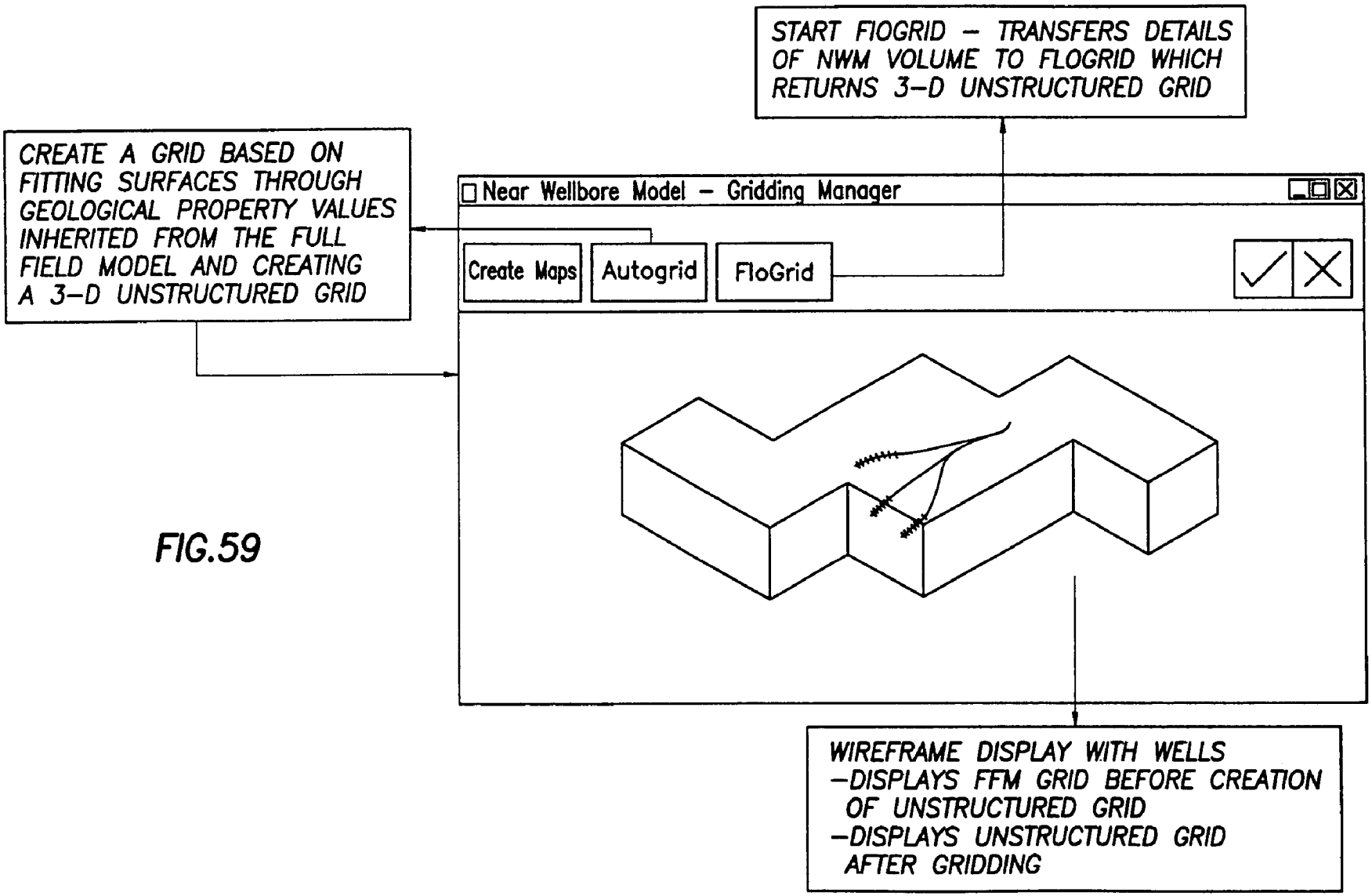

Referring to FIG. 59, the "Gridding Manager" will be discussed in the following paragraphs with reference to FIG. 59.

The purpose of the "Gridding Manager" of FIG. 59 is to provide a front-end for the task of creating the grid of the NWM.

Inputs

The principal inputs to this component are as follows.

1. The grid of the VOI. This will be made up of the coarse FFM grid blocks if the NWM is being created or the fine scale unstructured grid if working with an existing NWM.

2. The properties associated with the grid in the VOI. These will be the properties associated with the coarse FFM grid blocks if the NWM is being created or those associated with the fine scale unstructured grid if working with an existing NWM.

3. The FFM grid and grid properties. This will be required even if working with an existing NWM in case the user wishes to re-grid based on the FFM properties.

4. The trajectories of the principal wellbore and any laterals.

All geological information is assumed to be read in, managed and used by FloGrid.

Processing

The Gridding Manager can be entered from the Main Window of FIG. 46 or the Well Schematic of FIG. 55. If the medium priority additional requirement to allow the principal well to be implemented before the volume of interest (VOI) is defined, it will also be possible to enter the Gridding Manager from the VOI Selection of FIGS. 47-49.

The principal window within the Gridding Manager of FIG. 59 will be a 3-D visualization window. On entry, this will show the VOI of the selected NWM. If the NWM is being created, the parent FFM grid will be shown, together with the track of the principal well and the completions of any other wells in the VOI. If the Gridding Manager is entered with an existing NWM selected, the grid shown will be that of the NWM. By default, the cells will be colored according to permeability value. The user will have the option to color them according to the value of any other available grid property by clicking on the Property display button. Conventional FloViz visualization functionality will be available in the Grid Manager.

The Gridding Manager of FIG. 59 supports two ways of defining the unstructured simulation grid within the VOI. Clicking on the Create Maps and AutoGrid buttons handles the grid creation fully automatically and entirely within the component. When the user clicks the Create maps button, the component creates fine scale grids (surfaces) for each of the FFM simulation layers, based on the data available for the FFM grid blocks. The grid resolution will be set at a suitable value by the software. The gridded surfaces created will include depth surfaces, thickness surfaces and property surfaces (porosity, permeability, water and gas saturations etc.).

The structural surfaces will take account of any faults included in the FFM but property values will not.

In general, as discussed below, we foresee the Auto Grid option being used when the geology within the VOI is well behaved. The creation of the surfaces should therefore be straightforward and no provision will be made within the NWM application for reviewing or editing the surfaces created. However, facilities will be provided for exporting the maps in formats suitable for reviewing them in appropriate applications such as GRID. Also, warnings will be given if the values on the surfaces stray outside what are considered to be acceptable value ranges. These are discussed in more detail under Error handling below.

Once the surfaces have been created, the user will click on the Auto Grid button. The created surfaces will then be used as the basis for the creation of the grids throughout the VOI using the unstructured gridding routines.

The grid created will have the following characteristics.

1. It will respect the FFM layering

2. It will create a cylindrical grid around the wellbore and laterals. The radius of the cylindrical grid will be determined by the program.

3. It will respect fault planes inherited from the FFM.

4. It will sample the finely gridded property surfaces to populate the grid cells with property values.

The following properties will be sampled from the surfaces.

1. Porosity

2. Absolute permeability (in up to six directions)

3. Net to gross ratio

4. Saturation table number

5. PVT table number

6. Pressures (at a specified date)

7. Water saturation (at the specified date)

8. Gas saturation (at the specified date)

Some cells will lie within Zones of modified properties (FIG. 58). Where specific values have been assigned to a zone of modified properties, cells falling within these zones will take the specified values. Where no value has been specified, the cells will take values sampled from the surfaces.

Editing of property values on the grid will be carried out using the "PetraGrid" 64*a* (of FIG. 15) editing routines.

The detailed parameters governing the creation of the surfaces and the gridding will be accessible to the user but defaults will be supplied for all of them. It is intended that these parameters should not be changed during normal use of the software.

The gridding routines will also calculate the completion connection factor for each completion. These will be stored and will also appear in the Completions Table of the Well Data Manager.

On completion of the gridding operation, the display in the 3-D viewer will be refreshed to show the new grid. Again, the default colour painted property will be permeability but with the option to change it to show a different property.

The "grid and go" approach to the gridding is appropriate when the focus of the problem is on the well geometry. This is likely to be true when geology and geological geometry of the problem is simple and well represented by the FFM simulation grid. An example might be the drilling of an undulating well between a gas oil contact and an oil water contact in a massive, uniform sandstone. The results will depend on accurate representation of the geometry of the well in relation to the contacts rather than detailed representation of the geology.

Under other circumstances, more detailed representation of the geometry than is captured by the FFM will be essential to the development of meaningful results. This will be achieved by the use of FloGrid. The user will click on the FloGrid button which will start the software up. It will also transfer into FloGrid the coordinates of the points which are required to specify the outer faces of the VOI and the trajectory of the principal well.

The user will then use FloGrid in the conventional fashion to create the grids for the VOI. First, a series of maps or a geological model will be read into FloGrid. If the geological data is map based, the user will go through the usual steps of creation of a structural model and a property model. If the geological data is derived from a geological model which already contains the structural information, these steps can be omitted. The user will specify that the boundaries of the simulation model are defined by the coordinates of the outer faces of the VOI transferred in when FloGrid was started up. He or she will also read in the trajectory of the principal well. The user will select the unstructured grid option to create an unstructured grid within the VOI and to sample geological properties from the geological model. The unstructured grid so created will not not have any relationship to the layer structure of the FFM but will implicitly or explicitly incorporate the layering in the geological model.

Data will not be available within the geological model to set the values of saturation table number or PVT table number. During the gridding and sampling process, all the values will be assigned default values of 1. If the user wishes to modify these values, this will be done using the editing tools within the FloGrid/PetraGrid environment.

The gridding routines will also calculate and return the value of completion connection factor for each completion. This will become a part of the data set for the run and will appear in the Completions Table of the Well Data Manager.

Once the gridding is complete, the user will select the Export grid option in FloGrid to export all of grid and associated property information back to the Grid Manager within the NWM tool. This will bring up the Grid Manager window with the new grid shown.

At this point, the user can click on the commit icon. The software will write out new grid and schedule Include files and return control to the Main Window, showing the identity of the new Include files in region C of the window. Alternatively, he or she can click on the Saturation button. This will create the Include files and open the Saturation Manager component.

Error Handling

The following potential error conditions have been identified which need to be trapped and dealt with appropriately.

Problems with Created Surfaces.

As discussed above, we envisage that the AutoGrid function will be used with undemanding geological setups. It is therefore reasonable to expect that the creation of the surfaces will generally be problem free. Inevitably however, there will be problem cases. As indicated above, provision will be made to export the surfaces in formats which can be used by other applications to display them. This provides the means for quality checking the surfaces. In addition however, checks will be incorporated to identify error conditions. If an error condition is identified, a warning will be posted. Errors which will be checked for include:

1. Excessive gradients on the surface—Given the assumption that these models will be used on geologically simple configurations, excessive gradients on the surface will be an indication that something is wrong. These will be posted as warnings and an indication that the user should go and review the maps in a suitable application.

2. Values outside probable ranges—Warnings will be posted if values fall outside the range of probable values. An example might be porosities greater than 40 percent.

3. Values outside possible ranges—Error conditions will be posted if values fall outside possible ranges. An example would be net to gross ratios greater than 1.0.

Beyond this, responsibility for ensuring that the maps are reasonable will be left with the user.

VOI does not Lie Within the Volume for which the Geological Model is Defined.

There are a number of ways in which this condition might occur. First, the coordinate system of the FFM and that of the geological model may differ. Under these circumstances, the VOI and the geological model will commonly be in completely different places. There is likely to be little ambiguity concerning the error. The user will be prompted to review the two coordinate systems.

Another possibility is associated with small discrepancies which might position the corner of the VOI at a slightly shallower depth than the depth of the top of the geological model at that point. The software will include a default tolerance for this kind of mis-match which will be under user control. Only if the difference between the two z-coordinates exceeds the tolerance will a warning be posted.

The same problem may appear in reverse when the created and sampled grid is returned to the NWM application. The corners of the grids may not coincide exactly with the original corners of the VOI. Again, the difference will be tested against a tolerance which can be edited by the user. Only if the difference exceeds the tolerance will the user be warned.

Outputs

Files and Data

The output of this component is the fine scale unstructured grid with associated geological properties, saturation and PVT table numbers and well completion keywords (COMPSEGS).

Performance

The performance targets relate to the operations for the creation of maps and creation of grids, both of which are potentially time consuming.

For creation of maps, the target time will be to carry out all gridding and create the new surfaces in 30 seconds when using the benchmark dataset on the benchmark platform.

For gridding in the Auto grid mode, the objective will be to grid the benchmark dataset on the benchmark platform in less than 30 seconds.

The default parameters governing the surface fitting and gridding operations will be tuned to try to meet or exceed these targets.

The target time for starting FloGrid and transferring in data from the NWM Grid Manager and the target for closing FloGrid and returning to the NWM Grid Manager are both 15 seconds.

The performance of operations within FloGrid will be dependent on speed of FloGrid itself and is outside the scope of the NWM project.

Attributes

Maintainability

The Grid Manager will use much of the FloViz technology for 3-D visualisation. It will therefore be necessary to keep evolution of the NWM synchronised with the ongoing development of the FloViz technology. It will also be necessary to ensure that any implications of changes in FloGrid are absorbed into the facilities for transferring data into and out of FloGrid.

Testing

Testing of the component will need to focus on the following elements.

1. Ability to derive appropriate and representative surfaces from the grid and properties of the FFMs which are parts of the test data sets.

2. Ability to create representative grids from the surfaces which conform to the well trajectories, the FFM layering scheme and the VOI boundaries.

3. Ability to transfer the VOI boundaries and well trajectories into FloGrid.

4. Ability to transfer a grid generated in FloGrid and based on an appropriate geological model back into the Grid Manger.

Figure 60:
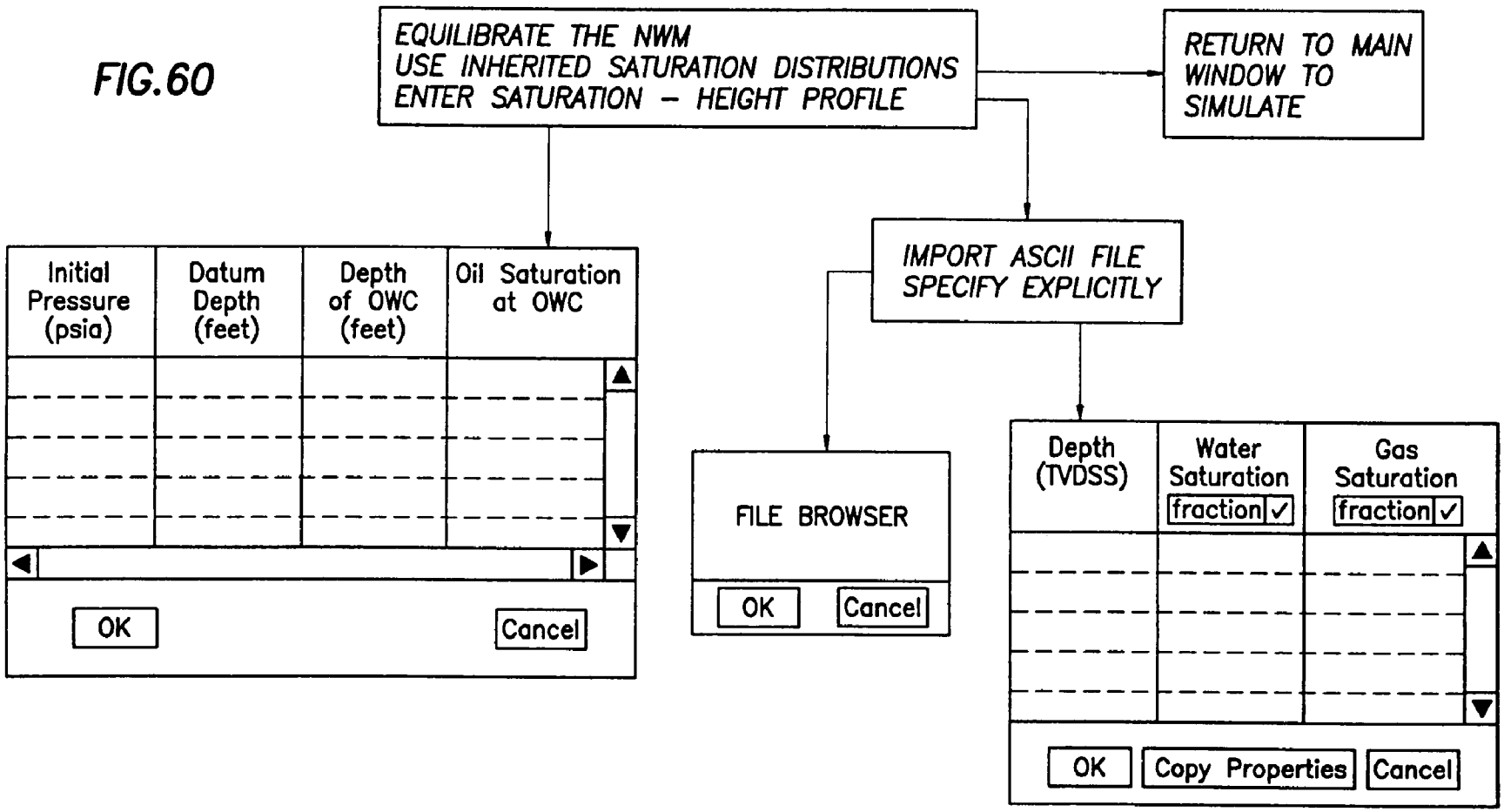

Referring to FIG. 60, the "Saturation Distribution Specification" will be discussed in the following paragraphs with reference to FIG. 60.

The "Saturation Distribution Specification" function is intended to establish the initial saturation distribution within the VOI prior to running the NWM.

Inputs

The options of using saturation distributions inherited from the FFM or equilibrating the NWM and then running from the start date of the FFM will not require any additional data inputs.

The option to specify a saturation-height profile or profiles will require the data to be entered by hand or in the form of an ASCII file.

Processing

The Saturation Distribution component will be entered from either the Grid component or the Main Window by clicking on the Saturation Distribution button. This will produce a drop down menu listing the three options which are available for defining the initial saturation distribution. They are:

1. Use saturation distributions inherited from the FFM

2. Equilibrate the NWM

3. Enter saturation-height profiles

Each option is discussed below.

Use Saturation Distributions Inherited from the FFM

The option to use the saturation distribution inherited from the FFM is only available if the grid has been generated direct from the FFM grid, properties and output. It is not available if the grid has been generated from the geological model because this would give a saturation distribution which would inevitably be inconsistent with the geological distribution.

A medium priority additional requirement is to provide this facility in an acceptably consistent fashion for grids generated using FloGrid.

Clicking on this option in the drop down menu returns the user to the Main Window. The sampling carried out during the gridding of the FFM derived surfaces will include sampling of the pressures and saturations at the prescribed date. These values are therefore available.

Once returned to the Main Window, the user must modify the scheduling section using the Data Manager. By implication, the sampling of pressures and saturations at a particular date is analogous to carrying out a restart run from that date. It is therefore necessary for the user to modify the NWM start date to the date corresponding to the pressures and saturations sampled from the FFM. The simulation can then be executed.

If the grid and grid information were created using Flo-Grid, this option is insensitive.

Equilibrate the NWM

Choice of this option will bring up a table of initialization data populated with the initialisation parameters inherited from the FFM. The user can modify the data but would need to have good reason to do so. When satisfied with the data, the user clicks on OK to return to the Main Window or Cancel to return without saving any modifications.

When using this option, the engineer needs to run the NWM from the start date of the FFM. This provides the opportunity to develop a saturation distribution within the NWM which is consistent with the geological model and the fluxes to and from the rest of the field.

It is important to realize that this approach is quite likely to develop a saturation distribution which does not result in a good match between the observed watercut behavior of the principal well and the predictions of the NWM. Some degree of history matching is likely to be required in order to ensure that the model reflects observed well behaviour closely.

Enter a Saturation Height Profile

Under some circumstances, the water saturation profile in the vicinity of the well will be known with a greater or lesser degree of certainty. This may be the case if, for example, a carbon/oxygen log has been run in a well prior to perforation. A facility is needed to be able to honor this known distribution.

This will be achieved by allowing the engineer to enter a saturation-measured depth profile (or profiles if both water saturations and gas saturations are available) for the well. Selection of this option will drop down a menu allowing the user to choose between an ASCII file as the source of the data and entry of the data by hand. If the user chooses an ASCII file as the source of the data, a file browser will appear, allowing selection of the appropriate file. Clicking on OK will then return the user to the Main Window. Choosing the keyboard entry option will bring up a table within which water saturation, gas saturation and measured depth combinations can be entered. Clicking on OK will again return the user to the Main Window.

The software will not contain any facilities for "blocking" saturations. Linear interpolation will be used to determine saturations at depths between those at which values are specified. Once the OK button is clicked, the software will use the grid block centre depth of each grid block to calculate its associated water and gas saturations.

As with the "Use inherited saturation distribution", this option is analogous to specifying a non-equilibrium solution corresponding to a particular time. The practical steps involved in using this option are as follows.

1. Select the "Equilibrate the NWM" saturation distribution option.

2. Run the model from the start date of the FFM, creating a restart file at the date for which the saturation distributions in the vicinity of the well are known.

3. Choose the "Enter saturation-height profile" option.

4. Re-run the model from the date of the known saturation distribution.

5. The first run using the "Equilibrate the NWM" option is required to ensure that a viable pressure distribution is available at the re-start date.

It is important to recognize that saturation distribution used will normally only be valid for the immediate vicinity of the wellbore. It is thus unrealistic to expect this kind of model to provide valid predictions for any extended period.

Error Handling

Error conditions arising from each of the options are discussed separately below.

Saturation Distributions Inherited from the FFM

Error conditions arising from the creation of saturation surfaces and the gridding are discussed in the gridding section above.

The saturation distribution or distributions derived from the FFM are necessarily non-equilibrium solutions. In principle, they should be consistent with the other properties within the NWM and the and the production history up to the restart date. In practice however, it is probable that there will be some degree of inconsistency between the production history, the geological model, the pressure distribution and the saturation distributions. This may lead to problems with fluid re-distributions when the run is restarted. Such problems will result in the model taking very small time-steps and perhaps significant vertical flows of fluids. A warning that this may happen will be posted on the screen when this kind of restart run is attempted but remedial action will be left to the user.

Equilibration of the NWM

There are no major error conditions which need to be trapped for this option.

Specification of a Saturation Distribution

The following checks should be made on the entered saturation distributions.

1. At any depth, the water and gas saturations should sum to no more than 1.0.

2. The saturation should cover the full length of each of the well and any laterals within the reservoir section.

The saturation distribution or distributions specified will normally be non-equilibrium solutions. There is not reason to expect them to be consistent with the other properties within the NWM and the and the production history up to the restart date. This may lead to problems with fluid re-distributions when the run is restarted. Such problems will result in the model taking very small timesteps and perhaps significant vertical flows of fluids. A warning that this may happen will be posted on the screen when this kind of restart run is attempted but remedial action will be left to the user.

Outputs

Files and Data

The output of this component is appropriate saturation associated with each grid block in the NWM.

Hardcopy

This component will not generate any hardcopy output.

Performance

There are no significant performance issues associated with the inheritance of a saturation distribution from the parent FFM or the equilibration of the NWM.

When water and gas saturation profiles are input, the gridding of saturation should take no more than five seconds with the benchmark NWM data set running on the benchmark platform.

Attributes

Testing

Testing of this component will need to focus on the following issues.

Ensure that the NWM is able to equilibrate and run correctly using equilibration derived from the test data sets.

Ensure that the component can take water saturation and gas saturation profiles and generate appropriate saturation grids.

It is not clear how the use of non-equilibrium pressure and saturation distributions will affect performance of the model at early time. Testing will need to be carried out using the example data sets to establish that the inevitable re-distribution of fluids that will occur at early time does give unacceptable degradation of performance.

Finalizing the Data Set

At this stage, most of the data required to run the NWM has been loaded. However, the scheduling data will normally need modification.

It will be possible to launch Schedule from the modified ECLIPSE Office desktop which is the starting point for ECLIPSE Office activities. It will also be possible to use the ECLIPSE Office Data Manager to modify any part of the scheduling section of the ECLIPSE data set. No additional facilities for handling scheduling data will be provided as a part of this project.

Running the Near Wellbore Model

A run of an NWM will be carried out using the Run Manager. In the Main Window, the user will select the appropriate run and then click on the Run button. This will bring up the standard ECLIPSE Office Run Manager window which is used to initiate the run. It will be possible to monitor the progress of the run using standard ECLIPSE Office facilities.

The only embellishment of the ECLIPSE Office Run Manager facilities in the NWM environment will be pre-selection of a default set of plots for monitoring progress. By default, the plots viewed will consist of the following.

1. Main Plot
   Principal well production rates of oil water and gas.

2. Secondary Plots
   Fluxes in and out of the VOI.
   Principal well flowing bottom hole pressure.
   Principal well tubing head pressure (if available).
   Flow rates from lateral 1 (if available)
   Flow rates from lateral 2 (if available)

On conclusion of the run, all of the standard ECLIPSE output files will be generated.

Figure 61:
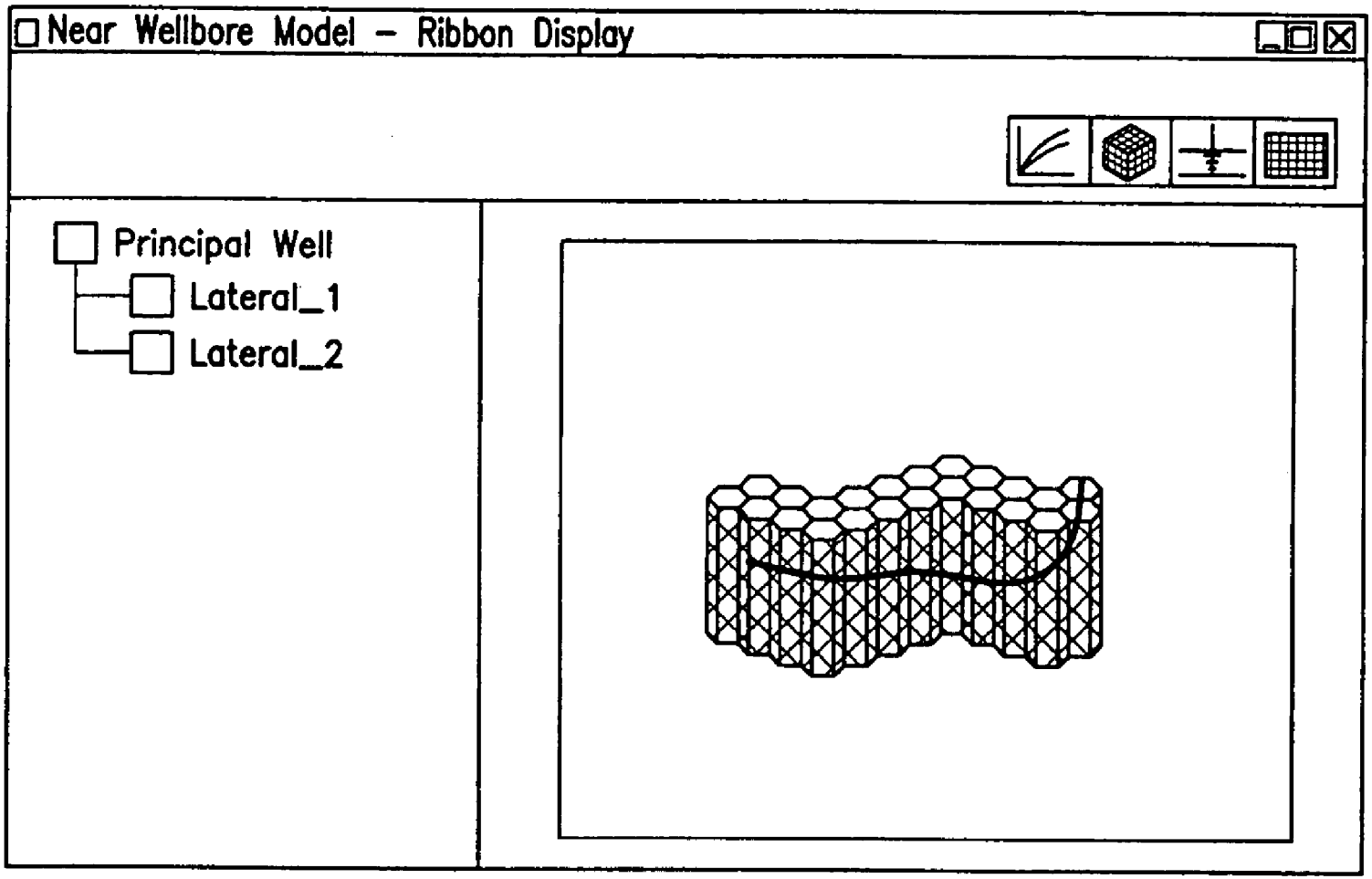
Figure 62:
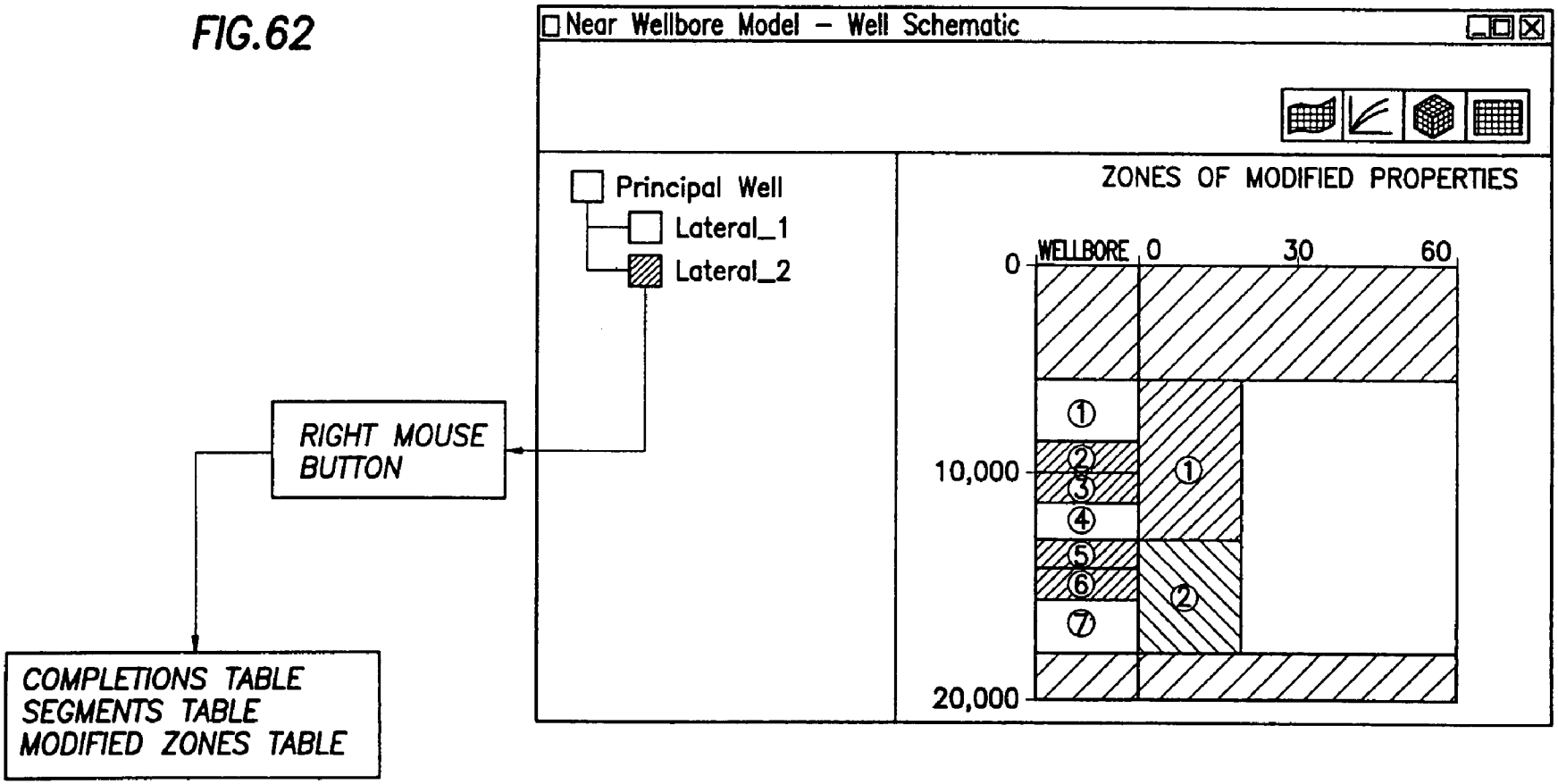

Referring to FIGS. 61 and 62, the "Results Viewer" will be discussed below with reference to FIGS. 61 and 62. The "results viewer" is a series of five linked displays which are intended to enable the engineer to gain insight into and interact with the NWM and the NWM results.

Inputs

The inputs to the Results Viewers are as follows.

1. Include files making up the NWM selected in the Main Window Case Manager

2. Output files from the NWM selected in the Main Window Case Manager

3. The well data (trajectory, configuration, completions, segments, cells and zones of modified properties) relating to the principal well in the NWM.

4. Available production history data.

Processing

The five linked viewers of the Results Viewer are each discussed briefly below. Each viewer is accessible from the others by clicking on the appropriate icon, The viewers fall into two categories, those which are specific to the principal well and those which are general for the model. The Solution Display viewer, the Line Plots viewer and the 3-D viewer are general to the model. The functionality provided by each of these viewers is identical to that provided by their ECLIPSE Office equivalents, with the exception of the buttons provided to move between the viewers. No further detail of these viewers will be supplied as a part of this specification.

In FIGS. 61 and 62, the Ribbon Display viewer of FIG. 61 and the Well Schematic viewer of FIG. 62 apply to the principal well. When either is accessed from one of the general viewers, it opens with the principal wellbore selected.

The Ribbon Section viewer of FIG. 61 is identical to the Ribbon Display editor described above with the exception of the icons used to move between the five Results Viewers. The user is able to view the track of the selected wellbore displayed within the cells which lie above and below it, along the projection of the well on to the upper surface of the model. The cells are color coded according to the value of one of the properties of the NWM grid. The user can choose any of the static or dynamic properties to be displayed. The default property on moving into the viewer for the first time will be water saturation. If the displayed property is changed, the same property will be displayed when the user moves into the viewer on subsequent occasions. The displayed property will also retained when the project is saved and used on future occasions.

The Well Schematic viewer of FIG. 62 is identical to the Well Schematic tool described above with the exception of the icons used to move between the five Results Viewers.

Error Handling

The elements of this component are viewers. Errors are therefore likely to be associated with missing data.

The elements will be arranged to work with what is available and not give access to functionality dependent on data which is not available. For example, in those displays which can show static or dynamic properties, the dynamic property choices will be insensitive if the data are not available.

Outputs

The outputs from the three elements which are taken from the ECLIPSE Office suite of functionality will provide the same outputs as in Office.

Files and Data

The Well Schematic and Ribbon Display viewer of FIGS. 61 and 62 will not create any Files or Data output.

Hardcopy

Output from the Ribbon Display will only be available as screen captures.

Output from the Well Schematic viewer will be available as scaled hardcopy for inclusion in reports.

Performance

All of the viewers should produce their displays within a couple of seconds when dealing with benchmark size problems on the benchmark platform.

Attributes

Maintainability

The viewer suite relies heavily on the viewers provided within ECLIPSE Office. It will therefore be necessary to coordinate the development and releases of the NWM tool with Office.

Testability

Testing of the viewers will centre on being able to display the data and results of the data sets successfully and within the target time.

Figure 63:
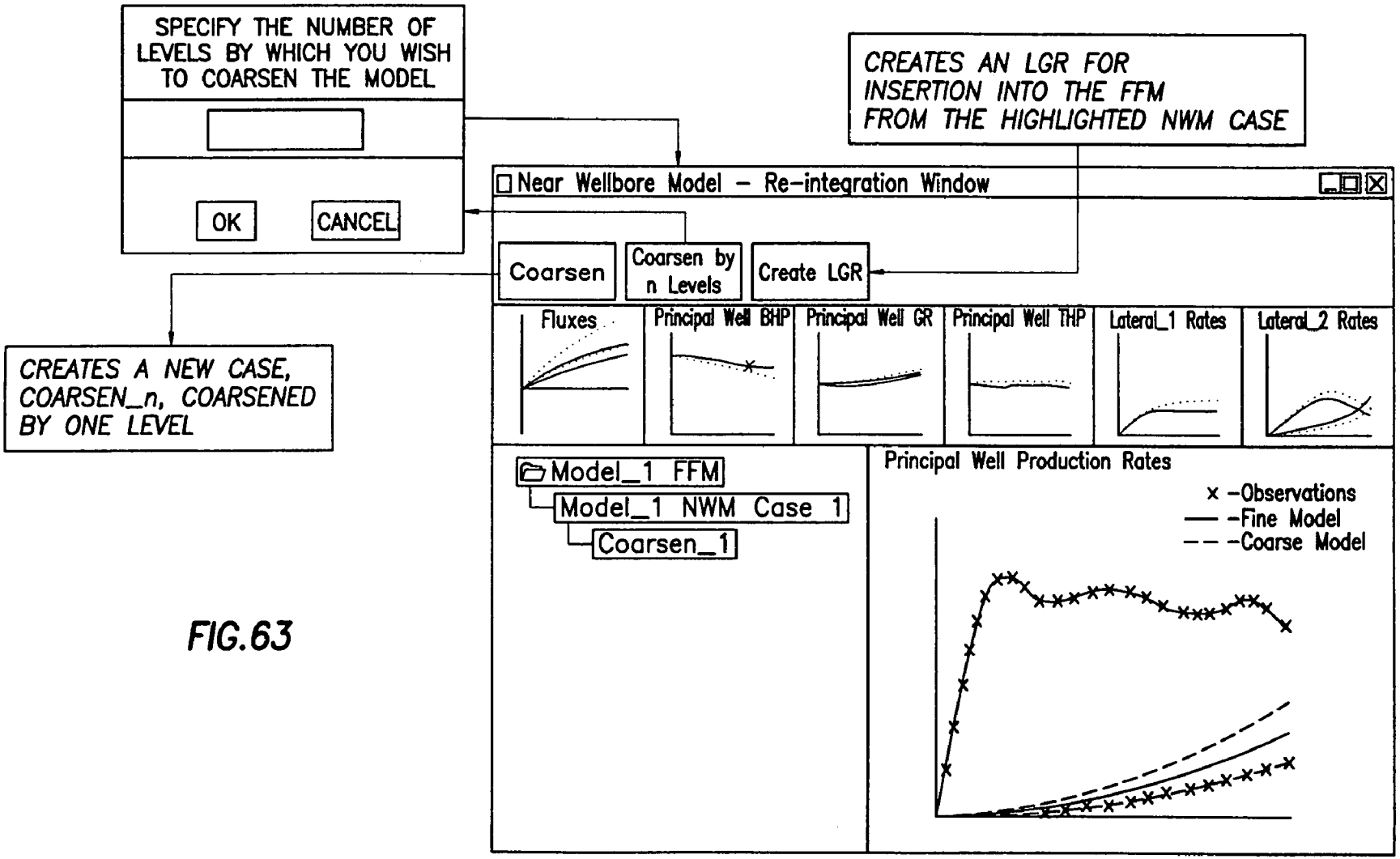
Figure 64:
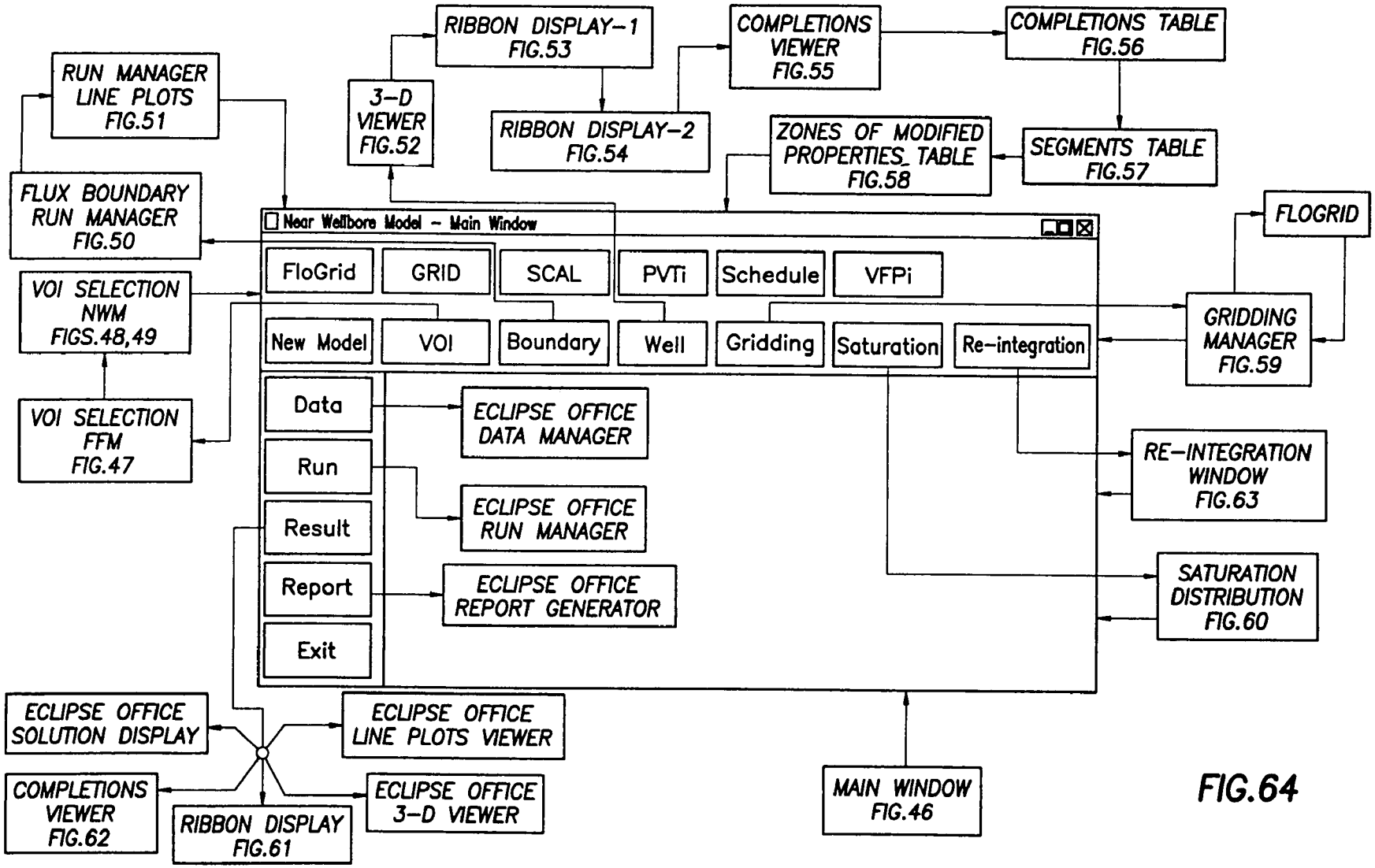
FIG. 64 illustrates the "main window" of FIG. 46 and, in addition, all the other sub-windows of FIGS. 47 through 63 which are called-up by using the "main window" of FIG. 46.

Referring to FIG. 63, the "Re-integration Window" will be discussed reference to FIG. 63.

The NWM tool will enable the user to take a small section of a full field model and model it in more detail. At the end of the modelling exercise, results will have been obtained which have validity in their own right. However, for maximum value, it would be advantageous to be able to incorporate the results of the NWM work back into the FFM.

The NWM will normally be based on a (probably very fine) unstructured gird. The FFM will for the foreseeable future usually be a relatively coarse corner point geometry. The full solution for this task will therefore involve upscaling from the NWM to a small number of FFM type grid blocks which can be re-inserted into the FFM as an LGR. This will require work with other projects which are dealing with upscaling such as the FloGeo project.

The concept at the heart of this simple implementation will be "coarsening" of the NWM grid as far as possible without having the match between the model results and the "fine scale" model deteriorate unacceptably. Once the grid has been coarsened as far as possible, the model will be incorporated into the FFM as an LGR.

Inputs

The only input to this component will be the Case Manager information and data sets relating to the FFM and cases run in the current NWM study.

Processing

The starting point for incorporation of the NWM results into the FFM will be the re-integration window and an existing NWM on which work has been concluded. The various files which have been created during the NWM study will be shown in a Case Manager window in the lower left part of the Re-integration Window.

The user will then click on the Coarsen button. This will pop up a menu allowing the user to choose whether coarsening should be applied only to the near well region, only to the bulk reservoir region or both. This will allow the user to retain the detail where he and she considers it most important. The selection can be made every time the Coarsen button is used. When the user clicks on OK, the application will create a grid which is coarser by one level. A level in this context means that the new grid will have half as many grid blocks the original. Alternatively, the user can choose to coarsen by n levels at one go, each one corresponding to a reduction in the number of blocks by a factor of two. Coarsening by three levels for example would result in a model with one eighth of the number of grid blocks of the original. The new model will be created as a sub-case of the NWM and will be shown as such in the Case Manager window. The coarsened model will be an NWM like any other and will be amenable to viewing and editing using the standard NWM tools in the same way.

The new model will then be run, the run being initiated from the Run Manager. As the run progresses, a set of NWM plots will be plotted in the Re-integration Window. The default set of plots will be those defined above for the NWM line manager but the choice of plots will be user configurable. On each plot, there will be shown:

1. the data generated by the executing run 2. the data generated by the original fine scale NWM 3. any available history data The run can be abandoned at any time if the evolving plots show that the results are not what is required.

If the run is allowed to run to completion, the user has a number of options. If the match between the coarsened model and the fine scale model is still good, he or she can click on the Coarsen button or the Coarsen by n levels button to create another model. This model will appear in the Case Manager as another sub-case and can then be run from the Run Manager.

If the results of the coarsened model are considered to be just acceptable, the user can click on the Create LGR button. This will write out all of the files needed to incorporate the coarsened grid into the FFM as an LGR. Work with the NWM is then effectively finished and the application can be closed.

If the results of the coarsened model are considered to be unacceptable, the user can select the model corresponding to the previous level of coarsening in the Case Manager window and click on the Create LGR button. This will create all of the files defining an LGR based on the selected data set. Work with the NWM is then effectively finished and the application can be closed.

Error Handling

Simulation errors and reporting relating to the errors will be handled by the simulation Run Manager.

Gridding errors and reporting relating to the errors will be handled by the gridding routines of Petragrid.

Outputs

Files and Data

The outputs from this component will be as follows.

1. standard simulation outputs for runs carried out.

2. files required to define the coarsened grid as an LGR in the FFM

Hardcopy

There will be no specific hardcopy outputs from this component. Standard outputs from the ECLIPSE Run Manager and Line Plots Window will be available.

Performance

Performance issues will be as for the related components (Run Manager, Run Manager Line Plots) discussed above.

Attributes

Maintainability

The Re-integration Window will use much of the technology of the ECLIPSE Office Run Manager and Run Manager Line Plots windows. Its development and releases will therefore need to be coordinated with development and release of Office.

Testing

Testing of the component will focus on the following elements for the test data sets.

1. Successful creation of a coarsened model by the gridding routines

2. Allocation of appropriate property to the grid blocks coarsened grid by the gridding routines 3. Creation of viable Include file sets which fully specify the LGR for inclusion in the FFM.

Referring to FIG. 64, the "main window" of FIG. 46 is illustrated again; but this time, the main window of FIG. 46 is illustrated in FIG. 64 in connection with each of the sub-windows illustrated in FIGS. 47 through 63. For example, when one of the buttons in the "main window" of FIG. 64 is actuated, one or more of the sub-windows of FIGS. 47 through 63 will be presented to the operator by way of the "display" 60 of the workstation 50 in FIG. 12. When one of the sub-windows is presented to the operator, the above description sets forth the subsequent actions which can be taken by the operator.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of modeling a reservoir field including a plurality of wellbores, comprising the steps of:

(a) receiving a data set which represents said reservoir field comprised of said plurality of wellbores, one of the plurality of wellbores being a specific wellbore;

(b) in response to the receiving step (a), modeling and simulating a region of said reservoir field located within a boundary around the region of said reservoir field which includes said specific wellbore and is in an immediate vicinity of said specific wellbore without also simulating a remaining portion of said reservoir field thereby focusing said modeling and simulating step on said region of the reservoir field which is located in the immediate vicinity of said specific wellbore;

(c) in response to the modeling and simulating step (b), determining a first plurality of simulation results that are representative of said region of the reservoir field located in said immediate vicinity of said specific wellbore; and (d) displaying said first plurality of simulation results representative of a set of earth formation characteristics in said vicinity of said specific wellbore.

2. The method of claim 1, wherein the modeling and simulating step (b) comprises the steps of:

(b1) establishing a boundary around said region of said reservoir field which includes said specific wellbore;

(b2) determining a plurality of fluxes or pressure values at said boundary, the fluxes or pressure values mimicking characteristics of said reservoir field located outside the boundary;

(b3) imposing a fine scale unstructured grid including a plurality of tetrahedrally shaped grid cells on said region of said reservoir field located inside said boundary and imposing a fine scale structured grid about a plurality of perforated sections of said specific wellbore; and (b4) assigning one or more properties to each tetrahedral cell of the fine scale unstructured grid imposed on said region located inside said boundary.

3. The method of claim 2, wherein the determining step (c), for determining said first plurality of simulation results that are representative of said region of the reservoir field located in said immediate vicinity of said specific wellbore, comprises the step of:

(c1) in response to the assigning step (b4), running a first simulation, using said fluxes or pressure values at said boundary to mimic said region of the reservoir field located outside the boundary and using the fine scale grid inside said boundary, to thereby determine said first plurality of simulation results corresponding, respectively, to the plurality of grid cells located inside said boundary, said first plurality of simulation results being representative of a set of earth formation characteristics corresponding to said region of the reservoir field located inside said boundary and situated in said immediate vicinity of said specific wellbore.

4. The method of claim 3, further comprising the step of: analyzing said specific wellbore in detail by importing a set of deviation surveys to improve a description of a welltrack of said specific wellbore.

5. The method of claim 3, wherein the running step (c1) of running a first simulation further comprises the step of: determining a multi-segment well model by dividing said welltrack of said specific wellbore into a plurality segments and generating a plurality of sets of solution variables corresponding, respectively, to said plurality of segments of said specific wellbore.

6. The method of claim 3, further comprising the step of: defining modified property zones located inside said boundary but outside and adjacent to said specific wellbore.

7. The method of claim 3, wherein said plurality of tetrahedrally shaped grid cells of said unstructured grid imposed on said region of said reservoir field located inside said boundary consists of a first number of grid cells, and wherein said method further comprises the steps of:

(e) decreasing the number of said grid cells of said unstructured grid located inside said boundary from said first number of grid cells to a second number of grid cells, where said second number is less than said first number;

(f) imposing another grid on that part of said reservoir field which is located outside said boundary, said another grid also including a plurality of grid cells;

(g) running a second simulation, without using said fluxes or pressure values at said boundary, to thereby determine a second plurality of simulation results corresponding, respectively, to a plurality of said grid cells enclosed by the entire said reservoir field, said second plurality of simulation results being representative of a set of earth formation characteristics corresponding to the entire said reservoir field; and (h) displaying said second plurality of simulation results.

8. The method of claim 7, wherein the decreasing step (e) comprises the step of: (e1) decreasing the number of said grid cells of said unstructured grid by a factor of "n", said first number of grid cells being "X" in number, said second number of grid cells being "X/n" in number.

9. The method of claim 8, wherein "n" is selected from the group consisting of: two point seven five (2.75), three (3), and four (4).

10. Apparatus responsive to a set of input data which includes a data set that further includes a reservoir field comprised of a plurality of wellbores adapted for modeling said reservoir field, said plurality of wellbores including a specific wellbore, comprising:

near wellbore modeling means for modeling a region of said reservoir field located within a boundary around the region of said reservoir field which includes said specific wellbore and is in the immediate vicinity of said specific wellbore without simultaneously modeling a remaining portion of said reservoir field thereby focusing said modeling on said region of said reservoir field located in said immediate vicinity of said specific wellbore, said near wellbore modeling means including, means for establishing a the boundary around said specific wellbore of said reservoir field, means for imposing a fine scale grid inside said boundary, said fine scale grid including a plurality of grid cells, means for determining a plurality of fluxes or pressure values at said boundary, said fluxes or pressure values mimicking that part of said reservoir field located outside said boundary, simulation means responsive to said plurality of fluxes or pressure values at said boundary for simulating that part of said reservoir field located inside said boundary without simultaneously simulating that part of said reservoir field located outside said boundary thereby generating a plurality of simulation results corresponding, respectively, to said plurality of grid cells of said fine scale grid inside said boundary, said plurality of simulation results being representative of characteristics of an earth formation located inside said boundary, and display means for displaying said plurality of simulation results.

11. The apparatus of claim 10, wherein said grid imposed inside said boundary by said means for imposing comprises an un-structured grid including a plurality of tetrahedrally shaped grid cells, and wherein said near wellbore modeling means further comprises:

means for assigning properties to each tetrahedrally shaped grid cell of said unstructured grid, said simulation means being responsive to said plurality of fluxes or pressure values at said boundary and to said properties assigned to each tetrahedrally shaped grid cell of said fine scale grid for simulating that part of said reservoir field located inside said boundary without simultaneously simulating that part of said reservoir field located outside said boundary thereby generating said plurality of simulation results corresponding, respectively, to said plurality of tetrahedrally shaped grid cells inside said boundary.

12. The apparatus of claim 11, wherein said input data includes well deviation surveys and wherein said near wellbore modeling means further comprises: means responsive to said well deviation surveys for improving a description of a welltrack associated with said specific wellbore, said simulation means being responsive to said plurality of fluxes or pressure values at said boundary and to said properties and to the improved description of said welltrack of said specific wellbore generated by the means for improving for simulating that part of the reservoir field located inside said boundary and generating said plurality of simulation results.

13. The apparatus of claim 12, wherein said specific wellbore includes a plurality of segments, and wherein said near wellbore modeling means further comprises: solution variable generation means for generating a plurality of solution variables corresponding, respectively, to said plurality of segments of said specific wellbore, said simulation means being responsive to said plurality of fluxes or pressure values at said boundary and to said properties and to said improved description of said welltrack and to said plurality of solution variables generated by said solution variable generation means for simulating that part of the reservoir field located inside said boundary and generating said plurality of simulation results.

14. The apparatus of claim 13, wherein said near wellbore modeling means further comprises: modified property zone definition means for defining modified property zones located inside said boundary but outside and adjacent to said specific wellbore, said simulation means being responsive to said plurality of fluxes or pressure values at said boundary and to said properties and to said improved description of said welltrack and to said plurality of solution variables and to said modified property zones defined by said modified property zone definition means for simulating that part of the reservoir field located inside said boundary and generating said plurality of simulation results.

15. The apparatus of claim 11, wherein said plurality of tetrahedrally shaped grid cells of said fine scale un-structured grid consists of a first number of grid cells, and wherein said apparatus further comprises:

means for reducing the number of tetrahedrally shaped grid cells of said un-structured grid located inside said boundary from said first number of grid cells to a second number of grid cells;

means for imposing another grid on that part of said reservoir field located outside said boundary, said reservoir field now including another plurality of grid cells, said simulation means being responsive to said second number of the tetrahedrally shaped grid cells located inside said boundary and to said another grid imposed on that part of said reservoir field located outside said boundary for simulating the entire said reservoir field thereby generating a second plurality of simulation results corresponding, respectively, to said another plurality of grid cells located inside said reservoir field, said display means displaying said second plurality of simulation results.

16. The apparatus of claim 15, wherein said means for reducing reduces the number of tetrahedrally shaped grid cells of said unstructured grid located inside said boundary by a factor of "n", said first number of grid cells consisting of "X" grid cells, said second number of grid cells consisting of "X/n" grid cells.

17. The apparatus of claim 16, wherein said "n" is selected from a group consisting oft two point seven five (2.75), three (3), and four (4).

18. A program storage device for storing instructions which, when executed by a processor of a computer, conducts a process comprising the steps of:

modeling a reservoir field including a plurality of wellbores, the modeling step comprising the steps of:

(a) receiving a data set which represents said reservoir field comprised of said plurality of wellbores, one of the plurality of wellbores being a specific wellbore, (b) in response to the receiving step (a), modeling and simulating a region of said reservoir field located within a boundary around the region of said reservoir field which includes said specific wellbore and is in an immediate vicinity of said specific wellbore without also simulating a remaining portion of said reservoir field by thereby focusing said modeling and simulating step on said region of the reservoir field which is located in the immediate vicinity of said specific wellbore;

(c) in response to the modeling and simulating step (b), determining a first plurality of simulation results that are representative of said region of the reservoir field located in said immediate vicinity of said specific wellbore; and (d) displaying said first plurality of simulation results representative of a set of earth formation characteristics in said vicinity of said specific wellbore.

19. The program storage device of claim 18, wherein the modeling and simulating step (b) comprises the steps of (b1) establishing a boundary around said region of said reservoir field which includes said specific wellbore;

(b2) determining a plurality of fluxes or pressure values at said boundary, the fluxes or pressure values mimicking characteristics of said reservoir field located outside the boundary;

(b3) imposing a fine scale unstructured grid including a plurality of tetrahedrally shaped grid cells on said region of said reservoir field located inside said boundary and further imposing a fine scale structured grid about perforated sections of said specific wellbore; and (b4) assigning one or more properties to each tetrahedrally shaped grid cell of the unstructured grid and to each grid cell of the structured grid imposed on said region located inside said boundary.

20. The program storage device of claim 19, wherein the determining step (c), for determining said first plurality of simulation results that are representative of said region of the reservoir field located in said immediate vicinity of said specific wellbore, comprises the step of:

(c1) in response to the assigning step (b4), running a first simulation, using said fluxes or pressure values at said boundary to mimic said region of the reservoir field located outside the boundary and using the fine scale grid inside said boundary, to thereby determine said first plurality of simulation results corresponding, respectively, to the plurality of grid cells located inside said boundary, said first plurality of simulation results being representative of a set of earth formation characteristics corresponding to said region of the reservoir field located inside said boundary and situated in said immediate vicinity of said specific wellbore.

21. The program storage device of claim 20, further comprising the step of: analyzing said specific wellbore in detail by importing a set of deviation surveys to improve a description of a welltrack of said specific wellbore.

22. The program storage device of claim 21, wherein the running step (c1) of running a first simulation further comprises the step of: determining a multi-segment well model by dividing said welltrack of said specific wellbore into a plurality segments and generating a plurality of sets of solution variables corresponding, respectively, to said plurality of segments of said specific wellbore.

23. The program storage device of claim 22, further comprising the step of: defining modified property zones located inside said boundary but outside and adjacent to said specific wellbore.

24. The program storage device of claim 20, wherein said plurality of tetrahedrally shaped grid cells of said unstructured grid imposed on said region of said reservoir field located inside said boundary consists of a first number of grid cells, and wherein said process further comprises the steps of:

(e) decreasing the number of said grid cells of said unstructured grid located inside said boundary from said first number of grid cells to a second number of grid cells, where said second number is less than said first number;

(f) imposing another grid on that part of said reservoir field which is located outside said boundary, said another grid also including a plurality of grid cells;

(g) running a second simulation, without using said fluxes or pressure values at said boundary, to thereby determine a second plurality of simulation results corresponding, respectively, to a plurality of said grid cells enclosed by the entire said reservoir field, said second plurality of simulation results being representative of a set of earth formation characteristics corresponding to the entire said reservoir field; and (h) displaying said second plurality of simulation results.

25. The program storage device of claim 24, wherein the decreasing step (e) comprises the step of: (e1) decreasing the number of said grid cells of said unstructured grid by a factor of "n", said first number of grid cells being "X" in number, said second number of grid cells being "X/n" in number.

26. The program storage device of claim 25, wherein "n" is selected from the group consisting of: two point seven five (2.75), three (3), and four (4).

* * * * *